US008863963B2

(12) United States Patent
Hardy

(10) Patent No.: US 8,863,963 B2
(45) Date of Patent: Oct. 21, 2014

(54) PRODUCT MANAGEMENT DISPLAY SYSTEM WITH TRACKLESS PUSHER MECHANISM

(75) Inventor: Stephen N Hardy, Wadsworth, OH (US)

(73) Assignee: RTC Industries, Inc., Rolling Meadows, IL (US)

( * ) Notice: Subject to any disclaimer, the term of this patent is extended or adjusted under 35 U.S.C. 154(b) by 114 days.

(21) Appl. No.: 13/564,575

(22) Filed: Aug. 1, 2012

(65) Prior Publication Data

US 2013/0031815 A1 Feb. 7, 2013

Related U.S. Application Data

(63) Continuation-in-part of application No. 12/639,656, filed on Dec. 16, 2009, now Pat. No. 8,322,544, which (Continued)

(51) Int. Cl.

| | |
|---|---|
| ***A47F 1/04*** | (2006.01) |
| ***A47F 7/00*** | (2006.01) |
| ***A47B 73/00*** | (2006.01) |
| ***A47F 1/12*** | (2006.01) |
| ***A47F 5/00*** | (2006.01) |
| *A47F 7/28* | (2006.01) |

(52) U.S. Cl.

CPC . *A47F 1/126* (2013.01); *A47F 1/04* (2013.01); *A47F 7/28* (2013.01); *A47F 5/005* (2013.01); *A47F 1/12* (2013.01)

USPC ..... 211/59.3; 211/74; 211/119.003

(58) Field of Classification Search

CPC ..... A47F 1/12; A47F 1/125; A47F 1/126; A47F 1/04; A47F 1/06; A47F 1/065; A47F 1/08; A47F 1/123; A47F 1/00; A47F 1/10; A47F 7/28; A47F 7/285; A47F 7/283; A47F 5/005; A47F 5/0043; A47F 3/02; A47F 3/0486; A47B 73/00; A47B 73/006; B25H 3/06; B25H 3/04; B65G 1/07; B65G 1/08

USPC ..... 211/59.2, 59.3, 184, 119.003, 74, 211/126.1, 43; 221/227, 255, 279; 312/61, 312/71, 35; 248/309.1; D6/408, 515

See application file for complete search history.

(56) References Cited

U.S. PATENT DOCUMENTS

| | | | |
|---|---|---|---|
| 153,227 | A | 7/1874 | Walker |
| 159,940 | A | 2/1875 | Leverich |

(Continued)

FOREIGN PATENT DOCUMENTS

| | | |
|---|---|---|
| BE | 906083 | 4/1987 |
| BE | 1013877 | 11/2002 |

(Continued)

OTHER PUBLICATIONS

*RTC Industries, Inc.*, v. *Fasteners for Retail, Inc., and SuperValu, Inc. d/b/a Cub Foods*, Stipulation of Dismissal, Civil Action No. 05 C 6940, Apr. 2006.

(Continued)

*Primary Examiner* — Jennifer E Novosad
(74) *Attorney, Agent, or Firm* — Banner & Witcoff, Ltd.

(57) ABSTRACT

A product management display system for merchandising product on a shelf includes at least one tray having a front rounded portion and defining a plurality of apertures and having two sides. A lip may extend upward from the front rounded portion of the at least one tray. A front shelf may extend forward from the lip. The at least one tray may include one divider extending upwardly from each of the two sides and a front wall. The front wall may include a top wall, a bottom wall, and two side legs. The front wall, bottom wall, and two side legs may form a wall aperture and the front wall may include a plurality of projections configured to engage with the plurality of apertures on the tray.

16 Claims, 37 Drawing Sheets

Related U.S. Application Data is a continuation-in-part of application No. 12/357,860, filed on Jan. 22, 2009, now Pat. No. 8,453,850, which is a continuation-in-part of application No. 11/760,196, filed on Jun. 8, 2007, now Pat. No. 8,312,999, which is a continuation-in-part of application No. 11/411,761, filed on Apr. 25, 2006, now Pat. No. 7,823,734.

(60) Provisional application No. 60/716,362, filed on Sep. 12, 2005, provisional application No. 60/734,692, filed on Nov. 8, 2005, provisional application No. 61/530,736, filed on Sep. 2, 2011, provisional application No. 61/542,473, filed on Oct. 3, 2011, provisional application No. 61/553,545, filed on Oct. 31, 2011.

(56) References Cited

U.S. PATENT DOCUMENTS 355,511 A 1/1887 Danner
431,373 A 7/1890 Mendenhall
436,704 A 9/1890 Green
452,673 A 5/1891 Hunter
551,642 A 12/1895 Kleine
607,890 A 7/1898 Smith
607,891 A 7/1898 Smith
632,231 A 9/1899 Blades
808,067 A 12/1905 Briggs
847,863 A 3/1907 Watts
927,988 A 7/1909 Massey
1,030,317 A 6/1912 Middaugh
1,156,140 A 10/1915 Hair
1,271,508 A 7/1918 Hall
1,282,532 A 10/1918 Bochenek
1,674,582 A 6/1928 Wheeler
1,703,987 A 3/1929 Butler
1,712,080 A 5/1929 Kelly
1,714,266 A 5/1929 Johnson
1,734,031 A 11/1929 Carlston
1,910,516 A 5/1933 Besenberg et al.
1,964,597 A 6/1934 Rapellin
1,971,749 A 8/1934 Hamilton
1,991,102 A 2/1935 Kemaghan
2,013,284 A 9/1935 Michaud
2,057,627 A 10/1936 Ferris
2,076,941 A 4/1937 Farr
2,079,754 A 5/1937 Waxgiser
2,085,479 A 6/1937 Shaffer et al.
2,110,299 A 3/1938 Hinkle
2,111,496 A 3/1938 Scriba
2,129,122 A 9/1938 Follett
2,218,444 A 10/1940 Vineyard
2,284,849 A 6/1942 Schreyer
2,308,851 A 1/1943 Anderson
2,499,088 A 2/1950 Brill et al.
2,516,122 A 7/1950 Hughes
2,538,908 A 1/1951 McKeehan
2,555,102 A 5/1951 Anderson
2,563,570 A 8/1951 Williams
2,652,154 A 9/1953 Stevens
2,670,853 A 3/1954 Schneider
2,678,045 A 5/1954 Erhard
2,738,881 A 3/1956 Michel
2,750,049 A 6/1956 Hunter
2,775,365 A 12/1956 Mestman et al.
2,893,596 A 7/1959 Gabrielsen
2,918,295 A 12/1959 Milner
2,934,212 A 4/1960 Jacobson
2,948,403 A 8/1960 Vallez
3,083,067 A 3/1963 Vos et al.
3,103,396 A 9/1963 Portnoy
3,110,402 A 11/1963 Mogulescu
3,121,494 A 2/1964 Berk
3,151,576 A 10/1964 Patterson
3,161,295 A 12/1964 Chesley
3,166,195 A 1/1965 Taber
3,285,429 A 11/1966 Propst
3,308,961 A 3/1967 Chesley
3,308,964 A 3/1967 Pistone
3,348,732 A 10/1967 Schwarz
3,405,716 A 10/1968 Cafiero et al.
3,452,899 A 7/1969 Libberton
3,497,081 A 2/1970 Field
3,501,016 A * 3/1970 Eaton ..... 211/49.1
3,501,019 A 3/1970 Armstrong
3,501,020 A 3/1970 Krikorian
D219,058 S 10/1970 Kaczur
3,550,979 A 12/1970 Protzmann
3,598,246 A 8/1971 Galli
3,652,154 A 3/1972 Gebel
3,667,826 A 6/1972 Wood et al.
3,698,568 A 10/1972 Armstrong
3,709,371 A 1/1973 Luck
3,751,129 A 8/1973 Wright et al.
3,776,388 A 12/1973 Mattheis
3,780,876 A 12/1973 Elkins
3,814,490 A 6/1974 Dean et al.
3,815,519 A 6/1974 Meyer
3,830,169 A 8/1974 Madey
3,836,008 A 9/1974 Mraz
3,848,745 A 11/1974 Smith
3,868,021 A 2/1975 Heinrich
3,870,156 A 3/1975 O'Neill
3,893,739 A 7/1975 Bernard
3,949,880 A 4/1976 Fortunato
3,960,273 A 6/1976 Weston
4,007,841 A 2/1977 Seipel
4,015,886 A 4/1977 Wickenberg
4,042,096 A * 8/1977 Smith ..... 211/85.18
4,106,668 A 8/1978 Gebhardt et al.
4,205,763 A * 6/1980 Merl ..... 221/173
4,269,326 A 5/1981 Delbrouck
4,300,693 A 11/1981 Spamer
4,303,162 A 12/1981 Suttles
4,314,700 A 2/1982 Dylag
4,331,243 A 5/1982 Doll
4,351,439 A 9/1982 Taylor
4,378,872 A 4/1983 Brown
4,397,606 A 8/1983 Bruton
4,416,380 A 11/1983 Flum
4,448,653 A 5/1984 Wegmann
4,454,948 A 6/1984 Spamer
4,454,949 A 6/1984 Flum
4,460,096 A 7/1984 Ricci
D275,058 S 8/1984 Flum
4,463,854 A 8/1984 MacKenzie
4,467,927 A 8/1984 Nathan
4,470,943 A 9/1984 Preis
4,478,337 A 10/1984 Flum
4,482,066 A 11/1984 Dykstra
4,488,653 A 12/1984 Belokin
4,504,100 A 3/1985 Chaumard
4,550,838 A 11/1985 Nathan et al.
4,588,093 A 5/1986 Field
4,589,349 A 5/1986 Gebhardt et al.
4,590,696 A 5/1986 Squitieri
4,593,823 A 6/1986 Fershko et al.
4,602,560 A 7/1986 Jacky
4,615,276 A 10/1986 Garabedian
4,620,489 A 11/1986 Albano
4,629,072 A 12/1986 Loew
4,651,883 A 3/1987 Gullett et al.
4,685,574 A 8/1987 Young et al.
4,705,175 A 11/1987 Howard et al.
4,706,821 A 11/1987 Kohls et al.
4,712,694 A 12/1987 Breslow
4,724,968 A 2/1988 Wombacher
4,729,481 A 3/1988 Hawkinson et al.
4,730,741 A 3/1988 Jackle, III et al.
4,742,936 A 5/1988 Rein
4,762,235 A 8/1988 Howard et al.
4,762,236 A 8/1988 Jackle, III et al.

(56) References Cited

U.S. PATENT DOCUMENTS 4,771,898 A 9/1988 Howard et al.
4,775,058 A 10/1988 Yatsko
4,776,472 A 10/1988 Rosen
4,790,037 A 12/1988 Phillips
4,801,025 A 1/1989 Flum et al.
4,809,855 A 3/1989 Bustos
4,809,856 A 3/1989 Muth
4,828,144 A 5/1989 Garrick
4,830,201 A 5/1989 Breslow
4,836,390 A 6/1989 Polvere
4,846,367 A 7/1989 Guigan et al.
4,883,169 A 11/1989 Flanagan, Jr.
4,887,724 A 12/1989 Pielechowski et al.
4,887,737 A 12/1989 Adenau
4,896,779 A 1/1990 Jureckson
4,899,668 A 2/1990 Valiulis
4,899,893 A 2/1990 Robertson
4,901,853 A 2/1990 Maryatt
4,901,869 A 2/1990 Hawkinson et al.
4,901,872 A 2/1990 Lang
4,907,707 A 3/1990 Crum
4,923,070 A 5/1990 Jackle et al.
4,934,645 A 6/1990 Breslow
4,944,924 A * 7/1990 Mawhirt et al. ..... 422/562
4,958,739 A 9/1990 Spamer
RE33,515 E 1/1991 Fershko et al.
4,981,224 A 1/1991 Rushing
4,997,094 A 3/1991 Spamer et al.
5,012,936 A 5/1991 Crum
5,024,336 A 6/1991 Spamer
5,025,936 A 6/1991 Lamoureaux
5,027,957 A 7/1991 Skalski
5,054,629 A 10/1991 Breen
5,082,125 A 1/1992 Ninni
5,088,607 A 2/1992 Risafi et al.
5,110,192 A 5/1992 Lauterbach
5,111,942 A 5/1992 Bernardin
5,123,546 A 6/1992 Crum
5,131,563 A 7/1992 Yablans
5,148,927 A 9/1992 Gebka
5,159,753 A 11/1992 Torrence
5,161,702 A 11/1992 Skalski
5,161,704 A 11/1992 Valiulis
5,178,258 A 1/1993 Smalley
5,183,166 A 2/1993 Belokin, Jr. et al.
5,190,186 A 3/1993 Yablans et al.
5,197,610 A 3/1993 Bustos
5,203,463 A 4/1993 Gold
5,215,199 A 6/1993 Bejarano
5,255,802 A 10/1993 Krinke et al.
5,265,738 A 11/1993 Yablans et al.
5,295,596 A 3/1994 Squitieri
5,316,154 A 5/1994 Hajec, Jr.
5,322,668 A * 6/1994 Tomasso ..... 422/561
5,341,945 A 8/1994 Gibson
5,351,839 A 10/1994 Beeler et al.
5,366,099 A 11/1994 Schmid
5,381,908 A 1/1995 Hepp
5,390,802 A 2/1995 Pappagallo et al.
5,397,006 A * 3/1995 Terrell ..... 211/88.01
5,397,016 A 3/1995 Torrence et al.
5,405,193 A 4/1995 Herrenbruck
5,413,229 A 5/1995 Zuberbuhler et al.
5,415,297 A 5/1995 Klein et al.
5,439,122 A 8/1995 Ramsay
5,450,969 A 9/1995 Johnson et al.
5,458,248 A 10/1995 Alain
5,464,105 A 11/1995 Mandeltort
5,469,975 A 11/1995 Fajnsztajn
5,469,976 A 11/1995 Burchell
5,505,315 A 4/1996 Carroll
5,542,552 A 8/1996 Yablans et al.
5,562,217 A * 10/1996 Salveson et al. ..... 211/59.3
5,597,150 A 1/1997 Stein et al.
5,613,621 A 3/1997 Gervasi
D378,888 S 4/1997 Bertilsson
5,615,780 A 4/1997 Nimetz et al.
5,634,564 A 6/1997 Spamer et al.
5,638,963 A 6/1997 Finnelly et al.
5,641,082 A 6/1997 Grainger
5,645,176 A * 7/1997 Jay ..... 211/59.2
5,655,670 A 8/1997 Stuart
5,657,702 A 8/1997 Ribeyrolles
5,665,304 A 9/1997 Heinen et al.
5,673,801 A 10/1997 Markson
D386,363 S 11/1997 Dardashti
5,682,824 A 11/1997 Visk
5,685,664 A 11/1997 Parham et al.
5,695,076 A 12/1997 Jay
5,695,077 A 12/1997 Jay
5,707,034 A 1/1998 Cotterill
5,711,432 A 1/1998 Stein et al.
5,720,230 A 2/1998 Mansfield
5,730,320 A 3/1998 David
5,738,019 A 4/1998 Parker
5,740,944 A 4/1998 Crawford
5,743,428 A 4/1998 Rankin, VI
5,746,328 A 5/1998 Beeler et al.
5,749,478 A 5/1998 Ellis
5,788,090 A 8/1998 Kajiwara
5,803,276 A 9/1998 Vogler
5,806,690 A 9/1998 Johnson et al.
5,826,731 A 10/1998 Dardashti
5,839,588 A 11/1998 Hawkinson
D402,490 S 12/1998 Parham
5,848,709 A 12/1998 Gelphman et al.
5,855,283 A 1/1999 Johnson
D405,632 S * 2/1999 Parham ..... D6/509
5,865,324 A * 2/1999 Jay et al. ..... 211/59.2
5,873,473 A 2/1999 Pater
5,873,489 A 2/1999 Ide et al.
5,878,895 A 3/1999 Springs
5,887,732 A 3/1999 Zimmer et al.
5,904,256 A 5/1999 Jay
5,906,283 A 5/1999 Kump et al.
5,944,201 A 8/1999 Babboni et al.
5,970,887 A 10/1999 Hardy
5,971,173 A 10/1999 Valiulis et al.
5,971,204 A 10/1999 Apps
5,975,318 A 11/1999 Jay
5,992,652 A 11/1999 Springs
6,006,678 A 12/1999 Merit
6,021,908 A 2/2000 Mathews
6,026,984 A 2/2000 Perrin
6,041,720 A 3/2000 Hardy
6,044,982 A 4/2000 Stuart
6,068,142 A * 5/2000 Primiano ..... 211/183
6,082,556 A * 7/2000 Primiano et al. ..... 211/59.2
6,082,557 A 7/2000 Leahy
6,112,938 A * 9/2000 Apps ..... 221/194
6,129,218 A 10/2000 Henry et al.
6,142,316 A * 11/2000 Harbour et al. ..... 211/59.2
6,142,317 A 11/2000 Merl
6,164,462 A 12/2000 Mumford
6,164,491 A 12/2000 Bustos et al.
6,173,845 B1 1/2001 Higgins et al.
6,189,734 B1 * 2/2001 Apps et al. ..... 221/193
6,209,731 B1 4/2001 Spamer et al.
6,209,733 B1 4/2001 Higgins et al.
6,227,385 B1 5/2001 Nickerson
6,234,325 B1 5/2001 Higgins et al.
6,234,326 B1 5/2001 Higgins et al.
6,234,328 B1 5/2001 Mason
6,237,784 B1 * 5/2001 Primiano ..... 211/59.2
D445,615 S 7/2001 Burke
6,253,954 B1 7/2001 Yasaka
6,299,004 B1 10/2001 Thalenfeld et al.
6,305,559 B1 10/2001 Hardy
6,308,839 B1 10/2001 Steinberg et al.
6,311,852 B1 11/2001 Ireland
6,325,221 B2 * 12/2001 Parham ..... 211/59.2
6,325,222 B1 * 12/2001 Avery et al. ..... 211/65
6,330,758 B1 12/2001 Feibelman
6,357,606 B1 3/2002 Henry

(56) References Cited

U.S. PATENT DOCUMENTS 6,375,015 B1 4/2002 Wingate
6,382,431 B1 5/2002 Burke
6,398,044 B1 6/2002 Robertson
6,401,942 B1 6/2002 Eckert
6,405,880 B1 6/2002 Webb
6,409,027 B1 6/2002 Chang et al.
6,409,028 B2 6/2002 Nickerson
6,419,100 B1 7/2002 Menz et al.
6,428,123 B1 8/2002 Lucht et al.
6,435,359 B1 8/2002 Primiano
6,439,402 B2 8/2002 Robertson
6,464,089 B1 10/2002 Rankin, VI
6,471,053 B1 10/2002 Feibelman
6,484,891 B2 11/2002 Burke
6,497,326 B1 12/2002 Osawa
6,505,747 B1 1/2003 Robertson
6,523,702 B1 * 2/2003 Primiano et al. ..... 211/59.2
6,523,703 B1 2/2003 Robertson
6,527,127 B2 3/2003 Dumontet
6,533,131 B2 3/2003 Bada
D472,411 S 4/2003 Burke
6,554,143 B1 4/2003 Robertson
6,598,754 B2 7/2003 Weiler
6,604,638 B1 8/2003 Primiano et al.
6,615,995 B2 * 9/2003 Primiano et al. ..... 211/59.2
6,622,874 B1 9/2003 Hawkinson
6,637,604 B1 10/2003 Jay
6,648,151 B2 * 11/2003 Battaglia et al. ..... 211/59.2
6,655,536 B2 12/2003 Jo et al.
6,659,293 B1 * 12/2003 Smith ..... 211/59.2
6,666,533 B1 12/2003 Stavros
D485,699 S 1/2004 Mueller et al.
6,679,033 B2 1/2004 Hart et al.
6,679,389 B1 * 1/2004 Robertson et al. ..... 211/59.2
6,695,152 B1 * 2/2004 Fabrizio et al. ..... 211/59.2
6,715,621 B2 * 4/2004 Boron ..... 211/59.2
6,722,509 B1 * 4/2004 Robertson et al. ..... 211/59.2
6,739,461 B1 * 5/2004 Robinson ..... 211/59.2
6,745,905 B2 6/2004 Bernstein
6,749,070 B2 6/2004 Corbett, Jr. et al.
6,756,975 B1 6/2004 Kishida et al.
6,758,349 B1 7/2004 Kwap et al.
6,769,552 B1 8/2004 Thalenfeld
6,772,888 B2 8/2004 Burke
6,779,670 B2 8/2004 Primiano et al.
6,786,341 B2 9/2004 Stinnett
6,796,445 B2 9/2004 Cyrluk
6,799,523 B1 10/2004 Cunha
6,820,754 B2 11/2004 Ondrasik
6,824,009 B2 11/2004 Hardy
6,843,382 B2 1/2005 Kanouchi et al.
6,860,046 B1 3/2005 Squitieri
6,866,156 B2 3/2005 Nagel et al.
6,867,824 B2 3/2005 Eiraku et al.
6,874,646 B2 4/2005 Jay
6,889,854 B2 5/2005 Burke
6,889,855 B2 5/2005 Nagel
6,902,285 B2 6/2005 Eiraku et al.
6,918,495 B1 7/2005 Hoy
6,918,736 B2 7/2005 Hart et al.
6,919,933 B2 7/2005 Zhang et al.
6,923,330 B1 8/2005 Nagel
6,929,133 B1 8/2005 Knapp, III et al.
6,948,900 B1 9/2005 Neuman
6,955,269 B2 10/2005 Menz
6,957,941 B2 10/2005 Hart et al.
6,962,260 B2 11/2005 Jay et al.
6,963,386 B2 11/2005 Poliakine et al.
6,964,235 B2 11/2005 Hardy
6,964,344 B1 11/2005 Kim
6,976,598 B2 12/2005 Engel
6,981,597 B2 1/2006 Cash
7,004,334 B2 2/2006 Walsh et al.
7,028,450 B2 4/2006 Hart et al.
7,028,852 B2 4/2006 Johnson et al.
7,080,969 B2 7/2006 Hart et al.
7,083,054 B2 8/2006 Squitieri
7,086,541 B2 * 8/2006 Robertson ..... 211/59.3
7,093,546 B2 8/2006 Hardy
7,104,026 B2 9/2006 Welbom et al.
7,104,410 B2 * 9/2006 Primiano ..... 211/59.2
7,108,143 B1 9/2006 Lin
7,124,898 B2 10/2006 Richter et al.
7,140,499 B2 11/2006 Burke
7,140,705 B2 11/2006 Dressendorfer et al.
7,150,365 B2 12/2006 Hardy et al.
7,152,536 B2 12/2006 Hardy
7,168,579 B2 1/2007 Richter et al.
7,182,209 B2 * 2/2007 Squitieri ..... 211/59.2
7,195,123 B2 3/2007 Roslof et al.
7,198,340 B1 4/2007 Ertz
7,201,281 B1 4/2007 Welker
7,216,770 B2 5/2007 Mueller
7,229,143 B2 6/2007 Gilman
7,293,663 B2 11/2007 Lavery, Jr.
7,299,934 B2 11/2007 Hardy et al.
7,318,532 B1 1/2008 Lee
7,347,335 B2 3/2008 Rankin
1,786,392 A1 4/2008 Kemp
7,357,469 B2 4/2008 Ertz
7,395,938 B2 7/2008 Merit et al.
7,404,494 B2 7/2008 Hardy
7,419,062 B2 * 9/2008 Mason ..... 211/59.3
7,424,957 B1 9/2008 Luberto
7,451,881 B2 11/2008 Hardy et al.
7,458,473 B1 12/2008 Mason
7,497,342 B2 3/2009 Hardy
7,500,571 B2 3/2009 Hawkinson
7,626,913 B2 12/2009 Usami
7,681,743 B2 3/2010 Hanretty et al.
7,681,744 B2 3/2010 Johnson
7,703,614 B2 4/2010 Schneider et al.
7,784,623 B2 8/2010 Mueller et al.
7,823,734 B2 11/2010 Hardy
7,828,158 B2 11/2010 Colelli
7,918,353 B1 4/2011 Luberto
7,931,156 B2 4/2011 Hardy
7,934,609 B2 5/2011 Alves et al.
7,980,398 B2 * 7/2011 Kahl et al. ..... 211/59.2
8,016,139 B2 9/2011 Hanners et al.
8,025,162 B2 9/2011 Hardy
8,096,427 B2 1/2012 Hardy
8,113,360 B2 2/2012 Olson
D655,107 S * 3/2012 Clark et al. ..... D6/476
8,127,944 B2 3/2012 Hardy
8,162,154 B2 * 4/2012 Trulaske, Sr. ..... 211/59.2
8,167,149 B2 5/2012 Wamsley
8,177,076 B2 5/2012 Rataiczak, III et al.
8,215,520 B2 7/2012 Miller
8,225,946 B2 7/2012 Yang
8,360,253 B2 1/2013 Hardy
8,397,922 B2 * 3/2013 Kahl et al. ..... 211/59.2
8,485,391 B2 7/2013 Vlastakis
8,579,123 B2 11/2013 Mueller
8,622,227 B2 1/2014 Bird
2001/0002658 A1 * 6/2001 Parham ..... 211/59.2
2001/0010302 A1 8/2001 Nickerson
2001/0019032 A1 9/2001 Battaglia et al.
2001/0020604 A1 * 9/2001 Battaglia et al. ..... 211/59.2
2001/0042706 A1 11/2001 Ryan, Jr. et al.
2001/0045403 A1 11/2001 Robertson
2002/0036178 A1 3/2002 Tombu
2002/0066706 A1 6/2002 Robertson
2002/0108916 A1 8/2002 Nickerson
2002/0148794 A1 10/2002 Marihugh
2002/0170866 A1 11/2002 Johnson et al.
2002/0179553 A1 12/2002 Squitieri
2002/0182050 A1 12/2002 Hart et al.
2002/0189201 A1 12/2002 Hart et al.
2002/0189209 A1 12/2002 Hart et al.
2003/0000956 A1 1/2003 Maldonado
2003/0007859 A1 1/2003 Hart et al.
2003/0010732 A1 1/2003 Burke
2003/0057167 A1 3/2003 Johnson et al.

(56) References Cited

U.S. PATENT DOCUMENTS

| | | | | |
|---|---|---|---|---|
| 2003/0061973 | A1 | 4/2003 | Bustos | |
| 2003/0080075 | A1 | 5/2003 | Primiano et al. | |
| 2003/0085187 | A1 | 5/2003 | Johnson et al. | |
| 2003/0132178 | A1 | 7/2003 | Jay et al. | |
| 2003/0132182 | A1 | 7/2003 | Jay | |
| 2003/0136750 | A1 | 7/2003 | Fujii et al. | |
| 2003/0141265 | A1 | 7/2003 | Jo et al. | |
| 2003/0168420 | A1 | 9/2003 | Primiano | |
| 2003/0217980 | A1 | 11/2003 | Johnson et al. | |
| 2003/0226815 | A1 | 12/2003 | Gaunt | |
| 2004/0000528 | A1 | 1/2004 | Nagel | |
| 2004/0004046 | A1 | 1/2004 | Primiano et al. | |
| 2004/0079715 | A1 | 4/2004 | Richter et al. | |
| 2004/0084390 | A1 | 5/2004 | Bernstein | |
| 2004/0094493 | A1 | 5/2004 | Higgins | |
| 2004/0104239 | A1 | 6/2004 | Black, Jr. et al. | |
| 2004/0105556 | A1 | 6/2004 | Grove | |
| 2004/0140278 | A1 | 7/2004 | Mueller et al. | |
| 2004/0140279 | A1 | 7/2004 | Mueller et al. | |
| 2004/0182805 | A1 | 9/2004 | Harper | |
| 2004/0206054 | A1 | 10/2004 | Welborn et al. | |
| 2004/0232092 | A1 | 11/2004 | Cash | |
| 2004/0245197 | A1 | 12/2004 | McElvaney | |
| 2005/0040123 | A1 | 2/2005 | Ali | |
| 2005/0072747 | A1 | 4/2005 | Roslof et al. | |
| 2005/0076817 | A1 | 4/2005 | Boks et al. | |
| 2005/0098515 | A1 | 5/2005 | Close | |
| 2005/0127014 | A1 | 6/2005 | Richter et al. | |
| 2005/0133471 | A1 | 6/2005 | Squitieri | |
| 2005/0139560 | A1 | 6/2005 | Whiteside | |
| 2005/0189310 | A1 | 9/2005 | Richter et al. | |
| 2005/0199563 | A1 | 9/2005 | Richter et al. | |
| 2005/0199564 | A1* | 9/2005 | Johnson et al. | 211/59.3 |
| 2005/0199565 | A1 | 9/2005 | Richter et al. | |
| 2005/0218094 | A1 | 10/2005 | Howerton et al. | |
| 2005/0224437 | A1 | 10/2005 | Lee | |
| 2005/0249577 | A1 | 11/2005 | Hart et al. | |
| 2005/0263465 | A1 | 12/2005 | Chung | |
| 2006/0001337 | A1 | 1/2006 | Walburn | |
| 2006/0032827 | A1 | 2/2006 | Phoy | |
| 2006/0049122 | A1 | 3/2006 | Mueller et al. | |
| 2006/0049125 | A1 | 3/2006 | Stowell | |
| 2006/0104758 | A1 | 5/2006 | Hart et al. | |
| 2006/0163272 | A1 | 7/2006 | Gamble | |
| 2006/0186064 | A1 | 8/2006 | Merit et al. | |
| 2006/0186066 | A1 | 8/2006 | Johnson et al. | |
| 2006/0196840 | A1 | 9/2006 | Jay et al. | |
| 2006/0213852 | A1 | 9/2006 | Kwon | |
| 2006/0226095 | A1 | 10/2006 | Hardy | |
| 2006/0237381 | A1 | 10/2006 | Lockwood et al. | |
| 2006/0260518 | A1 | 11/2006 | Josefsson et al. | |
| 2006/0263192 | A1 | 11/2006 | Hart et al. | |
| 2006/0273053 | A1 | 12/2006 | Roslof et al. | |
| 2006/0283150 | A1 | 12/2006 | Hart et al. | |
| 2006/0283151 | A1 | 12/2006 | Welbom et al. | |
| 2007/0006885 | A1 | 1/2007 | Shultz et al. | |
| 2007/0108142 | A1 | 5/2007 | Medcalf et al. | |
| 2007/0138114 | A1 | 6/2007 | Dumontet | |
| 2007/0170127 | A1 | 7/2007 | Johnson | |
| 2007/0175839 | A1 | 8/2007 | Schneider et al. | |
| 2007/0175844 | A1 | 8/2007 | Schneider | |
| 2008/0011696 | A1 | 1/2008 | Richter et al. | |
| 2008/0129161 | A1 | 6/2008 | Menz et al. | |
| 2008/0156751 | A1 | 7/2008 | Richter et al. | |
| 2008/0156752 | A1 | 7/2008 | Bryson et al. | |
| 2008/0164229 | A1 | 7/2008 | Richter et al. | |
| 2008/0314852 | A1 | 12/2008 | Richter et al. | |
| 2009/0272705 | A1 | 11/2009 | Francis | |
| 2010/0252519 | A1 | 10/2010 | Hanners et al. | |
| 2011/0174750 | A1 | 7/2011 | Poulokefalos | |

FOREIGN PATENT DOCUMENTS

| | | | |
|---|---|---|---|
| CH | 412251 | | 4/1966 |
| DE | 969003 | | 4/1958 |
| DE | 1819158 | | 7/1960 |
| DE | 2002720 | | 7/1971 |
| DE | 2232398 | | 1/1974 |
| DE | 2825724 | A1 | 12/1979 |
| DE | 8308485 | | 9/1983 |
| DE | 8426651 | | 7/1985 |
| DE | 8717386.7 | U1 | 4/1988 |
| DE | 3707410 | A1 | 9/1988 |
| DE | 9300431.1 | | 4/1993 |
| DE | 29618870 | U1 | 1/1997 |
| DE | 29902688 | | 7/1999 |
| DE | 731113 | | 2/2009 |
| EP | 0004921 | | 4/1979 |
| EP | 0018003 | | 7/1984 |
| EP | 0176209 | | 4/1986 |
| EP | 0224107 | A2 | 11/1986 |
| EP | 270016 | | 6/1988 |
| EP | 0337340 | | 10/1989 |
| EP | 0408400 | A1 | 7/1990 |
| EP | 0398500 | A1 | 11/1990 |
| EP | 0454586 | B1 | 10/1991 |
| EP | 0568396 | A1 | 11/1993 |
| EP | 0587059 | A2 | 3/1994 |
| EP | 986980 | | 3/2000 |
| EP | 0779047 | B1 | 4/2000 |
| EP | 1174060 | A1 | 1/2002 |
| EP | 1510156 | A2 | 3/2003 |
| EP | 1256296 | A3 | 10/2003 |
| EP | 1395152 | | 2/2005 |
| EP | 1857021 | A1 | 11/2007 |
| FR | 2385365 | | 10/1978 |
| FR | 2526338 | | 11/1983 |
| FR | 2617385 | | 1/1989 |
| FR | 2724098 | | 9/1994 |
| GB | 697994 | | 4/1951 |
| GB | 740311 | | 11/1955 |
| GB | 881700 | | 11/1961 |
| GB | 1082150 | | 9/1967 |
| GB | 2027339 | A | 2/1980 |
| GB | Des.2037553 | | 7/1994 |
| GB | 2281289 | | 1/1995 |
| GB | 2283407 | A | 5/1995 |
| GB | 229077 | | 12/1995 |
| GB | 2297241 | A | 7/1996 |
| GB | 2392667 | A | 3/2004 |
| GB | 1088654 | | 4/2008 |
| JP | 54168195 | | 11/1979 |
| JP | 59 218113 | | 8/1984 |
| JP | 62060521 | A | 3/1987 |
| JP | 6329463 | | 2/1988 |
| JP | 63-97114 | A | 4/1988 |
| JP | S63-099810 | A | 5/1988 |
| JP | 1-86856 | U | 6/1989 |
| JP | 02-191413 | | 7/1990 |
| JP | 3-45766 | A | 2/1991 |
| JP | 4-23463 | A | 1/1992 |
| JP | 05-277023 | | 10/1993 |
| JP | 6-77614 | A | 3/1994 |
| JP | 6202945 | | 7/1994 |
| JP | 3005457 | | 12/1994 |
| JP | 9-238787 | A | 9/1997 |
| JP | 10263710 | | 10/1998 |
| JP | 11-18889 | A | 1/1999 |
| JP | 11006284 | | 1/1999 |
| JP | 11313737 | | 11/1999 |
| JP | 11342054 | | 12/1999 |
| JP | 2000157378 | | 6/2000 |
| JP | 2000350642 | | 12/2000 |
| JP | 2001104117 | | 4/2001 |
| JP | 2003210286 | | 7/2003 |
| JP | 3099639 | U | 11/2003 |
| JP | 3115289 | Y | 9/2005 |
| JP | 3115812 | U | 10/2005 |
| JP | 2007-307244 | A | 11/2007 |
| JP | 4708539 | B2 | 3/2011 |

(56) References Cited

FOREIGN PATENT DOCUMENTS

| | | | |
|---|---|---|---|
| NL | 106617 | | 11/1963 |
| NL | 8520125 | | 1/1986 |
| NL | 1018330 | | 7/2002 |
| SE | 394537 | | 6/1977 |
| SU | 1600615 | | 10/1990 |
| WO | 9115141 | A | 10/1991 |
| WO | 9201614 | | 2/1992 |
| WO | 9806305 | | 2/1998 |
| WO | 0071004 | | 11/2000 |
| WO | 02091885 | | 11/2002 |
| WO | 02091885 | A1 | 11/2002 |
| WO | 03005862 | A2 | 1/2003 |
| WO | 03/013316 | A3 | 2/2003 |
| WO | 03032775 | A2 | 4/2003 |
| WO | 2004105556 | A | 12/2004 |
| WO | 2006019947 | A2 | 2/2006 |
| WO | 2006094058 | | 8/2006 |
| WO | 2007/073294 | A1 | 6/2007 |
| WO | 2007133086 | A1 | 11/2007 |
| WO | 2008/153561 | A1 | 12/2008 |

OTHER PUBLICATIONS

*RTC* vs. *Fasteners for Retail*, Case No. 05C 6940, Document No. 26, filed Apr. 25, 2006.

*RTC Industries, Inc.*, v. *HMG Worldwide Corporation*, Complaint, Civil Action No. 00C 3300, dated May 31, 2000.

*RTC Industries, Inc.* v. *HMG Worldwide Corporation*, Amended Complaint, dated Jan. 19, 2001.

*RTC Industries, Inc.* v. *HMG Worldwide Corporation*, RTC's Reply to HMG Worldwide Corporation's Amended Counterclaims, Civil Action No. 00 CV 3300, dated Mar. 7, 2001.

*RTC Industries, Inc.*, v. *Fasteners for Retail, Inc., and SuperValu, Inc. d/b/a Cub Foods*, Complaint, Civil Action No. 05C 6940.

*RTC Industries, Inc.* v. *HMG Worldwide Corporation*, Notice of Motion, Civil Action No. 00 Civ. 3300 (JHL), dated Feb. 22, 2001.

*RTC Industries, Inc.* v. *William Merit & Associates, Inc.*, Evidentiary Objections to RTC Industries, Inc.'s Memorandum in Opposition to William Merit & Associates' Motion for Partial Summary Judgment, Civil Action No. 04 C 1254, dated Jul. 2, 2004.

*RTC Industries, Inc.*, v. *William Merit & Associates, Inc.*, William Merit & Associates' Reply to RTC Industries, Inc.'s Response to William Merit & Associates' Statement under Local Rule 56.1 of Material Facts to Which There is No Genuine Issue and Statement of Additional Facts that Require the Denial of Summary Judgment, Civil Action No. 04 C 1254, dated Jul. 2, 2004.

*RTC Industries, Inc.* v. *William Merit & Associates, Inc.*, Exhibits and Declarations in Support of William Merit & Associates, Inc.'s Reply to RTC Industries, Inc.'s Memorandum in Opposition to William Merit & Associates' Motion for Partial Summary Judgment, Civil Action No. 04 C 1254, dated Jul. 2, 2004.

*RTC Industries, Inc.*, v. *William Merit & Associates, Inc.*, Notice of RTC Industries, Inc.'s Motion for Leave to File its Sur-Reply to William Merit's Motion for Partial Summary Judgment, Civil Action No. 04 C 1254, dated Jul. 6, 2004.

*RTC Industries, Inc.*, v. *William Merit & Associates, Inc.*, RTC Industries, Inc.'s Sur-Reply to William Merit's Motion for Partial Summary Judgment, Civil Action No. 04 C 1254, dated Jul. 6, 2004.

*RTC Industries, Inc.* v. *William Merit & Associates, Inc.* RTC's Response to Defendant's Evidentiary Objections to RTC Industries, Inc.'s Memorandum in Opposition to William Merit & Associates' Motion for Partial Summary Judgment, Civil Action No. 04 C 1254, dated Jul. 6, 2004.

*RTC Industries, Inc.* v. *Fasteners for Retail Inc.*, Plaintiff RTC Industries Inc.'s Complaint, Civil Action No. 03C 3137, dated May 12, 2003.

*RTC Industries, Inc.*, v. *Fasteners for Retail Inc., and CVS Corporation*, Amended Complaint, Civil Action No. 03C 3137, dated Aug. 6, 2003.

*RTC Industries, Inc.* v. *Semasys, Inc., and Uni-Sun, Inc.*, Complaint, Civil Action No. 04C 4081, dated Jun. 17, 2004.

*RTC Industries, Inc.* v. *Display Specialties, Inc.*, Complaint, Civil Action No. 04C 3370, dated May 12, 2004.

*RTC Industries, Inc.* v. *William Merit & Associates, Inc.*, Complaint, Civil Action No. 04C 1254, dated Feb. 18, 2004.

*RTC Industries, Inc.* v. *William Merit & Associates, Inc.*, Defendant's Notice of Motion for Partial Summary Judgment of Non-Infringement that Claims 1-8 of U.S. Patent No. 4,830,201 are Not infringed, Civil Action No. 04C 1254, dated Apr. 29, 2004.

*RTC Industries, Inc.*, v. *William Merit & Associates*, William Merit & Associates, Inc.'s Statement Under Local Rule 56.1 of Material Facts to Which There is no Genuine Issue, Civil Action No. 04 C 1254, dated Apr. 29, 2004.

*RTC Industries, Inc.* v. *William Merit & Associates, Inc.*, Defendant's Notice of Motion for Leave to File Memorandum in Support of Motion for Partial Summary Judgment in Excess of Page Limit, Civil Action No. 04 C 1254, dated Apr. 29, 2004.

*RTC Industries, Inc.* v. *William Merit & Associates, Inc.*, Declaration of William Merit in Support of Defendant's Motion for Partial Summary Judgement that Claims 1-8 of U.S. Patent No. 4,830,201 are Not Infringed, Civil Action No. 04 C 1254, dated Apr. 29, 2004.

*RTC Industries, Inc.* v. *William Merit & Associates, Inc.*, RTC Industries, Inc.'s Responses to Defendant William Merit & Associates, Inc.'s First Set of Requests for Admission to Plaintiff RTC Industries, Inc., Civil Action No. 04 C 1254, dated Jun. 1, 2004.

*RTC Industries, Inc.*, v. *William Merit & Associates, Inc.*, RTC Industries, Inc.'s Memorandum in Opposition to William Merit & Associates' Motion for Partial Summary Judgment, Civil Action No. 04 C 1254, dated Jun. 18, 2004.

*RTC Industries, Inc.* v. *William Merit & Associates, Inc.*, Notice of Filing of Additional Exhibit (the Chesley Patent) to RTC Industries, Inc.'s Memorandum in Opposition to William Merit & Associates' Motion for Partial Summary Judgment, Civil Action No. 04 C 1254, dated Jun. 22, 2004.

*RTC Industries, Inc.* v. *William Merit & Associates, Inc.*, William Merit & Associates Inc.'s Reply to RTC Industries, Inc.'s Memorandum in Opposition to William Merit & Associates' Motion for Partial Summary Judgment, dated Jul. 2, 2004.

*RTC Industries, Inc.*, v. *William Merit & Associates, Inc.*, Memorandum Opinion, Civil Action No. 04 C 1254, dated Jul. 15, 2004.

*RTC Industries, Inc.* v. *Fasteners for Retail Inc., and CVS Corporation*, Reply, Civil Action No. 03C 3137, dated Sep. 17, 2003.

*RTC Industries, Inc.* v. *Fasteners for Retail, Inc. and CVS Pharmacy, Inc.*, to Vulcan Spring & Mfg. Co., Subpoena in a Civil Case, Case No. 03C 3137 N.D. Illinois, dated Oct. 28, 2003.

*RTC Industries, Inc.* v. *Fasteners for Retail Inc., and CVS Pharmacy, Inc.*, to Rexam Beauty and Closures, Inc., Subpoena in a Civil Case, Case No. 03C 3137 N.D. Illinois, dated Nov. 11, 2003.

*RTC Industries, Inc.* v. *Fasteners for Retail Inc., and CVS Pharmacy, Inc.* to Rexam Cosmetic Packaging, Inc., Subpoena in a Civil Case, Case No. 03C 3137 N.D. Illinois, dated Nov. 11, 2003.

*RTC Industries, Inc.*, v. *Henschel-Steinau, Inc.*, Complaint, Case: 1:10-cv-07460 Document #:1 Filed Nov. 19, 2010.

*RTC Industries, Inc.* v. *Fasteners for Retail Inc., and CVS Corporation*, Notice of Motion to Modify and Temporarily Quash Five Subpoenas for Violation of Federal Rule of Civil Procedure 45, Civil Action No. 03C 3137, dated Dec. 8, 2003.

*RTC Industries, Inc.* v. *Fasteners for Retail, Inc. and CVS Pharmacy, Inc.*, Defendants' Opposition to Plaintiff's Motion to Modify and Temporarily Quash Five Subpoenas for Violation of Federal Rule of Civil Procedure 45, Case No. 03C 3137, dated Dec. 10, 2003.

*RTC Industries, Inc.* v. *Fasteners for Retail Inc., and CVS Corporation*, RTC Industries' Reply to Defendants' Opposition to RTC's Motion to Modify and Temporarily Quash Five Subpoenas for Violation of Federal Rule of Civil Procedure 45, Civil Action No. 03C 3137, dated Dec. 11, 2003.

*RTC Ind. Inc.* v. *Fasteners for Retail*, Minute Order of Dec. 12, 2003 by Honorable Joan B. Gottschall, Case No. 1:03-cv-03137.

*RTC Industries, Inc.*, v. *William Merit & Associates, Inc.*, RTC Industries, Inc.'s Response to William Merit & Associates Statement under Local Rule 56.1 of Material Facts to Which There is No Genuine Issue and Statement of Additional Facts that Require the Denial of Summary Judgment, Civil Action No. 04 C 1254, dated Jun. 18, 2004.

(56) References Cited

OTHER PUBLICATIONS

*RTC Industries, Inc.*, v. *William Merit & Associates, Inc.*, Index of Exhibits, Civil Action No. 04 C 1254, dated Jun. 18, 2004.
http://www.posexpert.pl/public/files/PDF/Popychacze%20produkt%C3%B3w.pdf; Sep. 2006.
http://www.hl-display.sk/eng/Catalogue2005/Optimal-eng.pdf; 2005.
http://www.triononline.com/trionshelfworks/sw2.php; May 2007.
http://web.archive.org/web/20070516135906/http://www.triononline.com/productlines/wonderBar.php; May 2007.
http://www.lpportal.com/feature-articles/item/15-product-protection%E2%80%94beyond-eas.html; Mar. 2004.
http://www.posexpert.pl/public/files/PDF/Zarz%C4%85dzanie%20p%C3%B3%C5%82k%C4%85%20(ang.).pdf; 2006.
http://www.postuning.de/fileadmin/PDF-Downloads/Prospekte/EN_Tabak.pdf; 2006.
http://www.postuning.de/fileadmin/PDF-Downloads/Prospekte/EN_ePusher.pdf: Feb. 2005.
Vue 3040 Sanden; Apr. 2005.
http://www.storereadysolutions.com/srs.nsf/t_rinc/A56F52CF98E12B9386257449006D11DD!OpenDocument; 2006.
http://ers.rtc.com/SRSFiles/SRS_Flyer_ProfitPusher.pdf; 2006.
http://www.displaypeople.com/pdf/BOX_TO_SHELF_SELL_SHEET_Jan_19_V3.pdf.
http://www.triononline.com/pdf/ExpWTray.pdf.
http://www.ffr-dsi.com/sell-sheets/Power%20Zone%20Trak-Set%20Self-facing%20System.pdf.
International Search Report & Written Opinion for PCT/US2012/053374 mailed Nov. 27, 2012, (12 pages).
International Search Report & Written Opinion for PCT/US2012/053357 mailed Nov. 22, 2012, (13 pages).
FFr Yello Pages® 2003 Product Catalog, "Merchandising Ideas Made Easy for Every Retain Environment", Cover pg., 9-11, 48-49, 52-58, Back Cover.
*RTC Ind* v. *William Merit Assoc*., United States District Court Northern District of Illinois (Chicago), Case #:1:04-cv-01254.
*RTC Ind* v. *Fasteners for Retail, et al*., United States District Court Northern District of Illinois (Chicago), Case #:1:03-cv-03137.
*RTC Ind* v. *HMG Worldwide Corp*., United States District Court Northern District of Illinois (Chicago), Case #:1:00-cv-03300.
*RTC Ind* v. *Display Specialties*, United States District Court Northern District of Illinois (Chicago), Case #:1:04-cv-03370.
*RTC Ind* v. *Semasys Inc., et al*., United States District Court Northern District of Illinois (Chicago), Case #:1:04-cv-04081.
*RTC Ind* v. *Fasteners for Retail, et al*., United States District Court Northern District of Illinois (Chicago), Case #:1:05-cv-06940.
*VIDPRO International Inc*. v. *RTC Industries, Inc*., U.S. District Court Northern District of Texas (Dallas), Case #:3:95-cv-01055-G.
*RTC Industries, Inc*. v. *Henschel-Steinau, Inc*., Complaint, Case: 1:11-cv-05497 Document #: 1 Filed: Aug. 12, 2011 p. 1 of 6 Page ID #:1.
*RTC Industries, Inc*. v. *Henschel-Steinau, Inc*., Plaintiff's Notice of Dismissal Pursuant to Fed. R. Civ. P. 41(a)(1)(A)(i) Case: 1:11-cv-05497 Document #: 15 Filed: Oct. 21, 11 p. 1 of 3 Page ID#:51.
Final Office Action and English Translation dated Nov. 5, 2013 for Japanese Application No. 2012-8725, 8 pages.

* cited by examiner

FIG.9
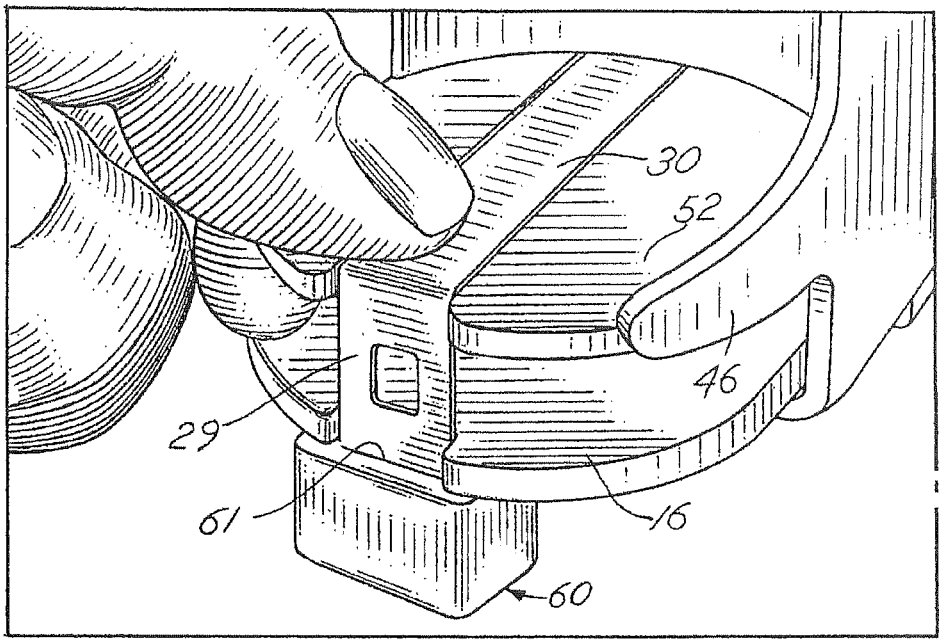
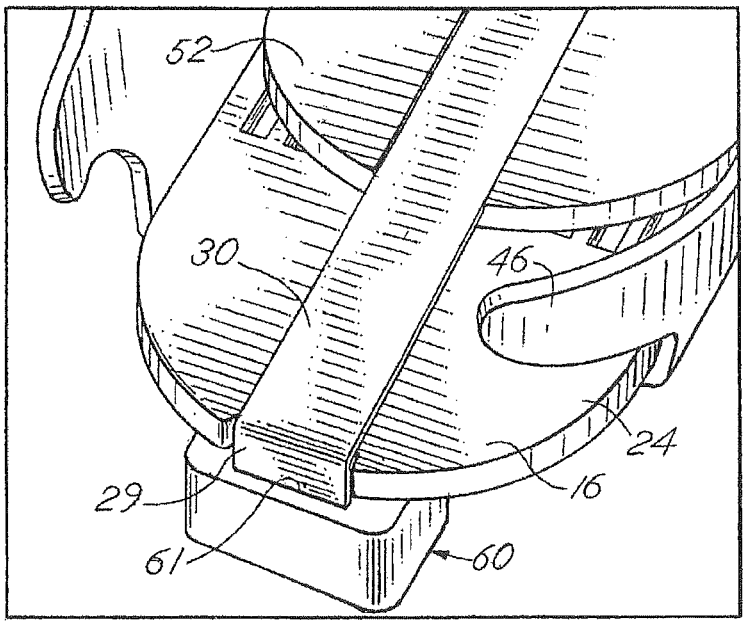
FIG.10

FIG.11
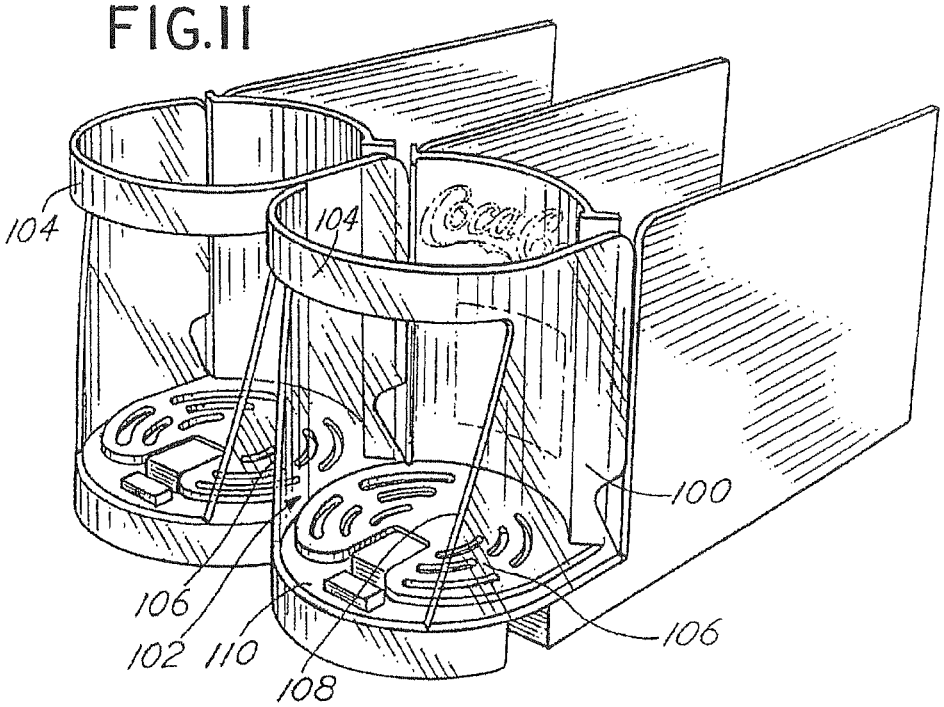
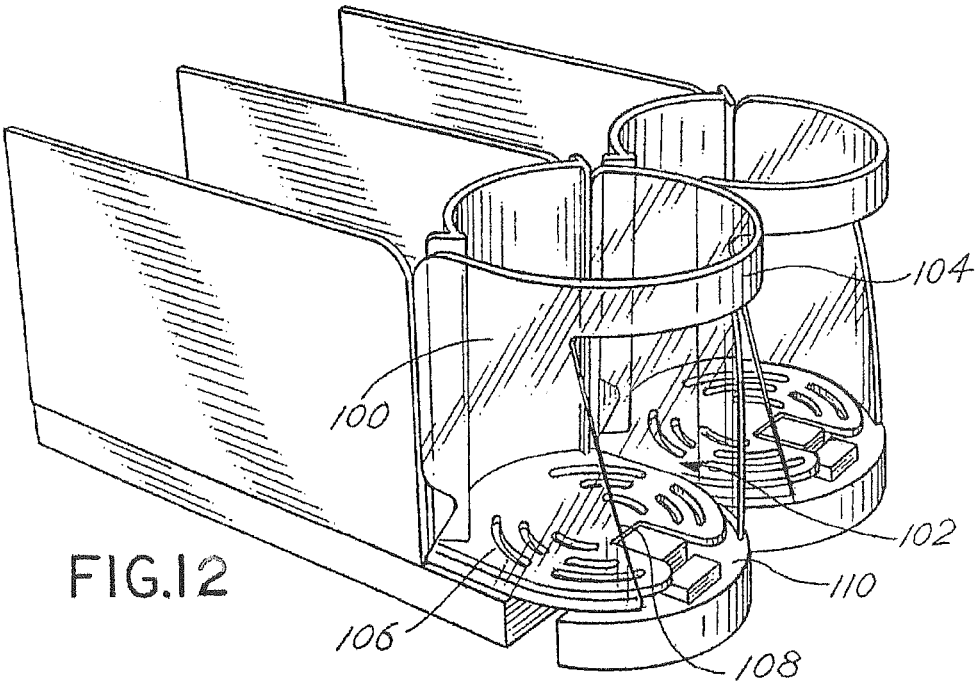
FIG.12

FIG.13
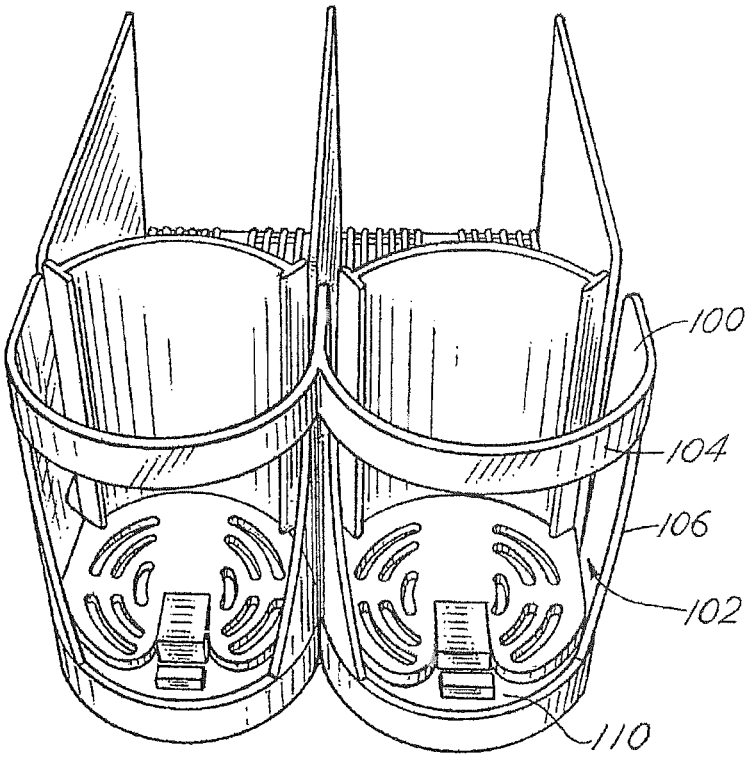
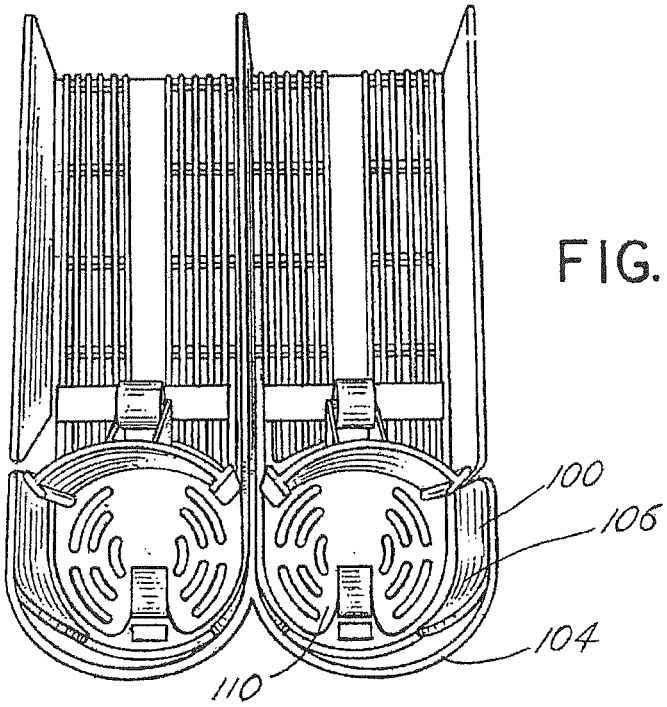
FIG.14

FIG. 21
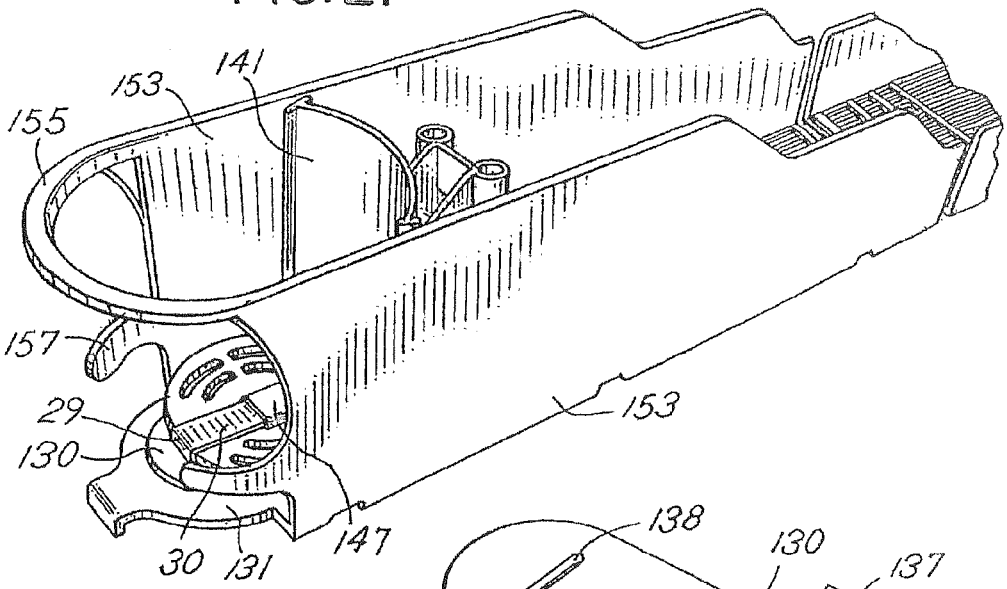
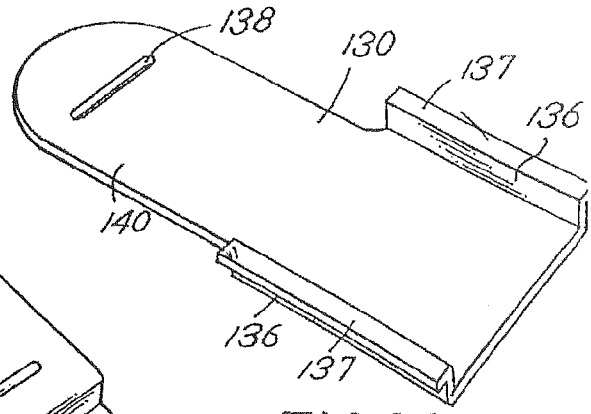
FIG. 22
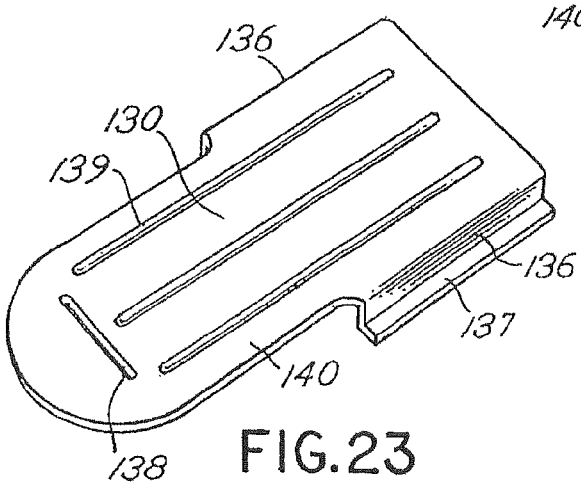
FIG. 23

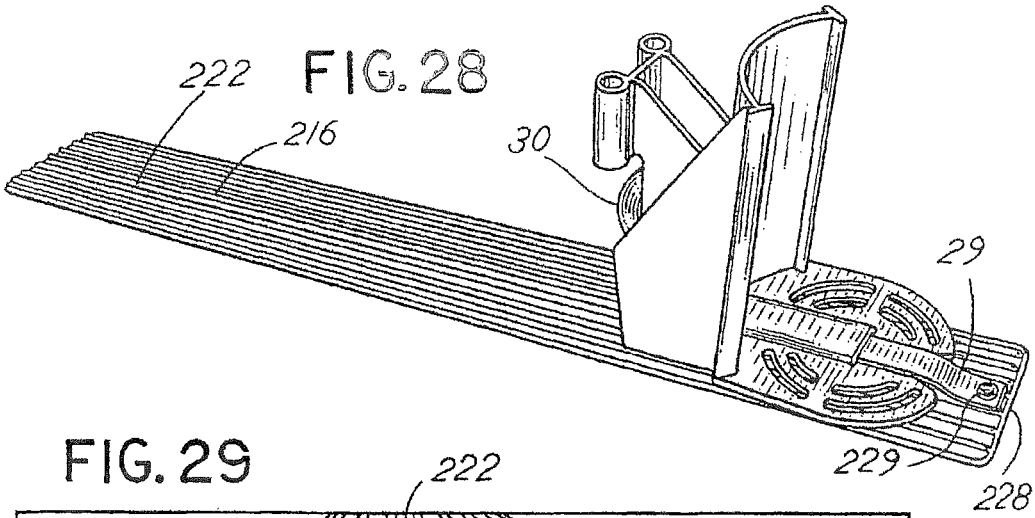
FIG. 28
FIG. 29
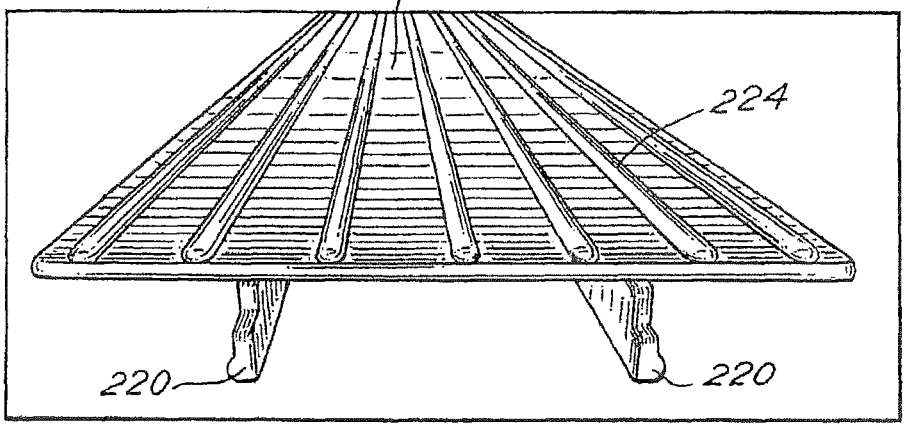
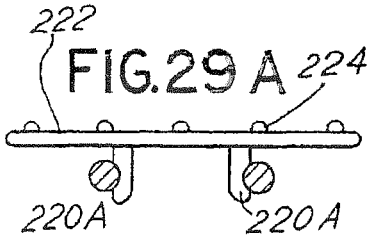
FIG. 29 A
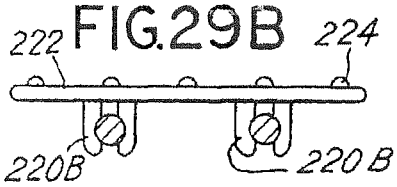
FIG. 29B
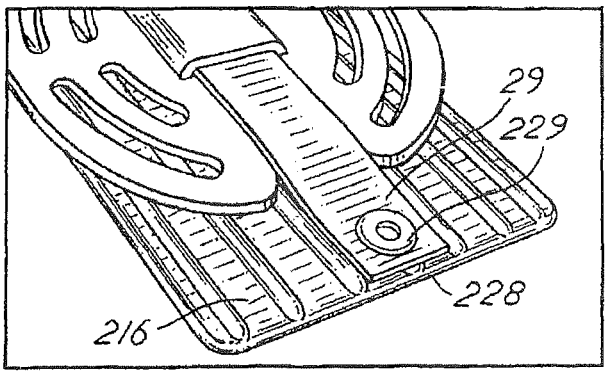
FIG. 30

FIG.31
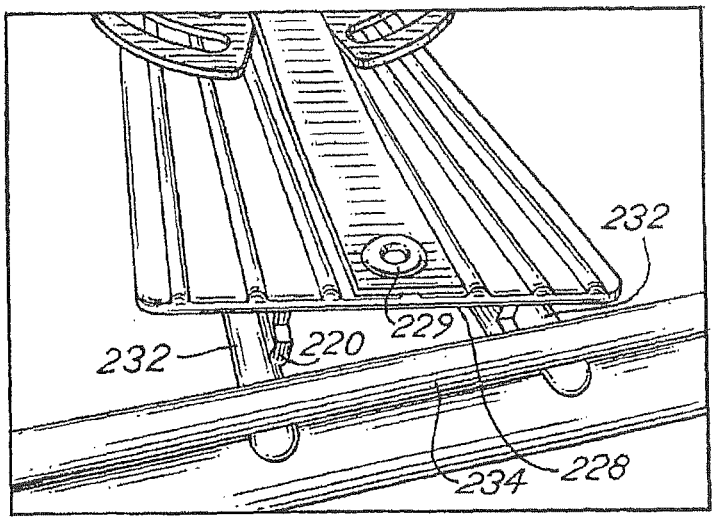
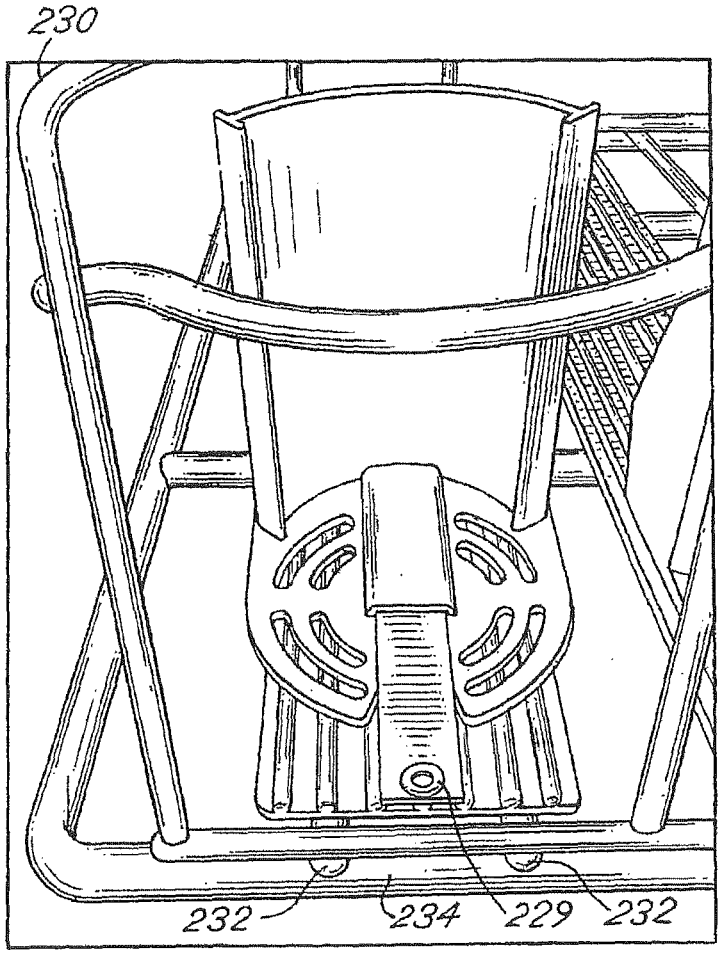
FIG.32

PRODUCT MANAGEMENT DISPLAY SYSTEM WITH TRACKLESS PUSHER MECHANISM

CROSS REFERENCE TO RELATED APPLICATION

This application is a continuation-in-part of U.S. application Ser. No. 12/639,656 filed Dec. 16, 2009, which is a continuation-in-part application of U.S. application Ser. No. 12/357,860 filed Jan. 22, 2009, which is a continuation-in-part application of U.S. application Ser. No. 11/760,196 filed Jun. 8, 2007, which is a continuation-in-part application of U.S. application Ser. No. 11/411,761 filed Apr. 25, 2006, and granted as U.S. Pat. No. 7,823,734, which claims benefit to U.S. Provisional Application Nos. 60/716,362 filed Sep. 12, 2005 and 60/734,692 filed Nov. 8, 2005, all of which are incorporated herein by reference. This application also claims benefit to U.S. Provisional Application Nos. 61/530,736 filed Sep. 2, 2011, 61/542,473 filed Oct. 3, 2011, and 61/553,545 filed Oct. 31, 2011, all of which are incorporated herein by reference.

FIELD OF THE INVENTION

The exemplary embodiments of the invention relate generally to a shelf assembly for use in merchandising product and more particularly to a shelf assembly having improved mechanisms for displaying and pushing product on the shelves.

BACKGROUND OF THE INVENTION

It is known that retail and wholesale stores, such as convenience stores, drug stores, grocery stores, discount stores, and the like, require a large amount of shelving both to store product and to display the product to consumers. In displaying product, it is desirable for the product on the shelves to be situated toward the front of the shelf so that the product is visible and accessible to consumers. In the case of coolers or refrigerators that are used to store and display such products as soft drinks, energy drinks, bottled water, and other bottled or canned beverages, it is desirable for these products to also be situated toward the front of the shelf and visible and accessible to the consumers.

To accomplish this placement of product, known systems may include inclined trays or floors that through gravity will cause the product to move toward the front of the shelf. Many of these systems include floors or shelves made of a plastic material such as polypropylene that due its low coefficient of friction permit the product to easily slide along the inclined floor or surface. However, over time, these surfaces can become obstructed with debris or sticky substances that inhibit the product from properly sliding, sometimes causing several products to tip over thus blocking additional product from moving to the front of the shelf.

Other systems include the use of a pusher system to push the product toward the front of the shelf as the product at the front of the shelf is removed. The known pusher systems are typically mounted to a track and include a pusher paddle and a coiled spring to urge the product forward. Occasionally, as the system is used, and over time, the track becomes obstructed with dirt or sticky materials that hinder the proper operation of the pusher system in the track. In addition, depending on the size, shape and weight of the product to be merchandised, the known pusher paddles may occasionally tip or bend backwards, thereby causing a binding of the pusher mechanism in the track. In those situations, the pusher mechanism may not properly push product toward the front of the shelf.

One exemplary embodiment is directed at improving upon existing merchandising systems by providing a trackless pusher system that works with gravity-fed merchandise systems (i.e., inclined shelves or trays) and non-gravity-fed merchandise systems.

SUMMARY OF THE INVENTION

One exemplary embodiment is directed to a product management display system for merchandising product on a shelf. This embodiment includes using a trackless pusher mechanism that travels along a surface on which product is placed. The trackless system overcomes the known problems with the use of tracks to hold and guide the known pusher mechanisms. It should be understood however that the teachings of this embodiment may be used with systems that include tracks for mounting a pusher mechanism or the like.

The pusher mechanism can include a pusher paddle and a floor that extends forward of the pusher paddle. A flat coiled spring or other biasing element can be operatively connected behind the pusher paddle and extend across the floor of the pusher mechanism and to the front of the shelf. Alternatively, the flat coiled spring or biasing element can extend across the divider to the front of the shelf assembly. With this configuration, the pusher paddle is prevented from tipping or bending backwards during operation.

An exemplary embodiment also includes the use of a pushing mechanism with the merchandising of product on horizontal or non-inclined shelves or surfaces, as well as with gravity-fed systems, or systems that use gravity as a mechanism to urge product toward the front of the shelf.

In accordance with an exemplary illustrative embodiment of the invention, the pusher paddle may define a concave pushing surface for pushing cylindrical products, such as soft drink bottles or cans, and to keep the paddle centered on the track and behind the product. Alternatively, the pusher paddle may define a flat pushing surface that may further include at its upper edge a curved rib or similar structure that can also be used to push cylindrical products.

In accordance with another exemplary illustrative embodiment of the invention, the floor of the pusher mechanism can include a notched or cut-out portion to align the pusher mechanism relative to the coiled spring. Also, the floor of the system also can include a notch or cut-out portion for receiving and mounting a flat end of the coiled spring to the floor. A spring tip may be placed on the end of the coiled spring to mount the coiled spring to the floor of the system. Alternatively, the end of the coiled spring can mount to the divider of the assembly.

In accordance with yet another exemplary embodiment, an adaptor for a product management display system may be positioned on a floor surface of the display system. The adaptor may include a planar surface with at least two ribs extending outwardly from the planar surface and across the planar surface in a substantially parallel manner. A coiled spring may be positioned between the parallel extending ribs. With this configuration, product to be merchandised may sit on the ribs, and not directly on the coiled spring, to enhance the forward movement of certain types of product, such as cans of a beverage.

In yet another alternative aspect, a mounting member may be used to mount the end of the coiled spring to the floor of the system. For those systems that include spaced-apart glide rails that are joined together by connecting ribs, the mounting member may be snap-fit to or otherwise mounted on the floor and between the glide rails.

In yet another alternative aspect, the trackless pusher system is retrofitted into an existing shelf assembly. This allows for the placement of the trackless pusher system in an existing shelving system as a low cost alternative to purchasing the entire trackless pusher assembly.

In another exemplary embodiment, the coil spring can be mounted to the retainer. An end of the coil spring can be directly mounted to the retainer or alternatively the end can be mounted to the retainer via an adapter. The adapter can have a curved portion which is received in a correspondingly shaped curved slot in the retainer to secure the end of the spring to the display assembly.

In another exemplary embodiment, the trays can be attached via a dovetail connection to form a shelf assembly. Additionally the dividers can be adjusted such that the width of the product rows can be adapted to receive different sized products.

In accordance with yet another exemplary embodiment, the product management display system can be arranged in a stackable arrangement. The assembly can be provided with a first tray and a second tray each having a first wall and a second wall. The first and second trays are each adapted to receive a pusher mechanism, and a retainer mechanism. First and second spacers are mounted to the first and second trays for stacking the first and second trays on top of one another. The first and second spacer can be provided with a plurality of detents, and the first tray and the second tray can each be provided with a plurality of correspondingly shaped sockets for receiving the plurality of detents.

In accordance with yet another exemplary embodiment, the product management display system may include at least one tray having a front rounded portion and defining a plurality of apertures and having two sides. A lip may extend upward from the front rounded portion of the at least one tray. A front shelf may extend forward from the lip. The at least one tray may include one divider extending upwardly from each of the two sides and a front wall. The front wall may include a top wall, a bottom wall, and two side legs. The front wall, bottom wall, and two side legs may form a wall aperture and the front wall may include a plurality of projections configured to engage with the plurality of apertures on the tray.

BRIEF DESCRIPTION OF THE DRAWINGS

FIG. 9 depicts the exemplary tip of FIG. 7 being mounted to an end of a coiled spring.

FIG. 10 depicts the exemplary tip of FIG. 7 mounted to an end of a coiled spring.

FIG. 11 depicts an isometric view of an alternative exemplary embodiment of a product management display system of the present invention.

FIG. 12 depicts another isometric view of the system of FIG. 11.

FIG. 13 depicts a front view of the system of FIG. 11.

FIG. 14 depicts a top view of the system of FIG. 11.

FIG. 21 depicts an isometric view of an alternative exemplary embodiment of a product management display system of the present invention.

FIG. 22 depicts an isometric bottom view of an exemplary mounting member that may be used to mount the end of the coiled spring to the floor of the display system.

FIG. 23 depicts an isometric top view of the exemplary mounting member of FIG. 22.

FIG. 28 depicts an isometric view of an alternative exemplary embodiment of a product management display system of the present invention.

FIG. 29 depicts a close-up isometric view of the tray of the exemplary embodiment of FIG. 28.

FIG. 29A depicts a cross-sectional view of the exemplary embodiment of FIG. 28 illustrating a first securing method.

FIG. 29B depicts a cross-sectional view of the exemplary embodiment of FIG. 28 illustrating a second securing method.

FIG. 30 depicts a close-up isometric view of the embodiment of FIG. 28 illustrating a rivet attaching the spring to the tray.

FIG. 31 depicts an isometric view of the embodiment of FIG. 28 being assembled in a preexisting wire shelf.

FIG. 32 depicts an isometric view of the embodiment of FIG. 28 assembled in a preexisting wire shelf.

Figure 1:
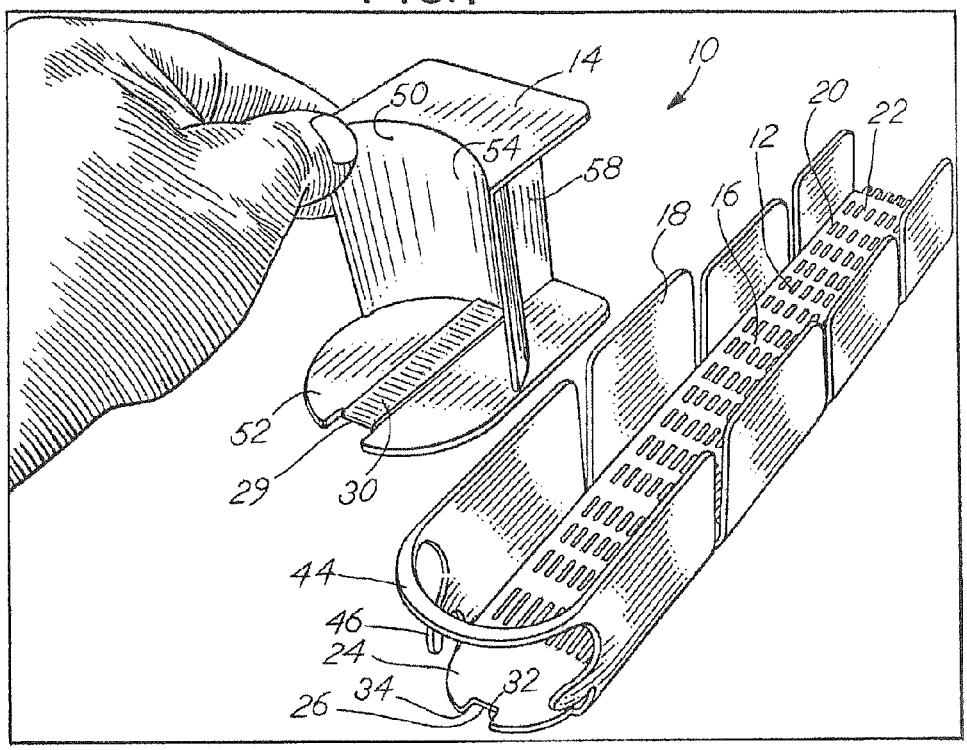
FIG. 1 depicts an isometric exploded view of an exemplary embodiment of a product management display system of the present invention.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, the use of the term "mount," "mounted" or "mounting" is meant to broadly include any technique or method of mounting, attaching, joining or coupling one part to another, whether directly or indirectly.

DETAILED DESCRIPTION OF THE EMBODIMENTS

The invention may be embodied in various forms. Referring to the Figures wherein like numerals indicate like elements, there is depicted in FIG. 1 an isometric exploded view of an exemplary embodiment. Exemplary merchandise system 10 includes a product dispensing tray 12 in which is mounted an exemplary trackless pusher mechanism 14. As described in more detail below, the pusher mechanism 14 will fit in the tray 12 and will slide along the surface of the tray without the use of tracks, rails, or guides typically used to hold a conventional pusher mechanism to the tray or floor of the tray. The pusher mechanism defines a pusher paddle and a pusher floor that extends forward of the pusher paddle. A coiled spring may extend across the pusher floor and operatively connect to the tray at a forward position on the tray. In one aspect of the invention, product to be merchandised may be placed in the tray in front of the pusher paddle and may sit on the pusher floor as well as the coiled spring. With this configuration, the weight of the product will prevent the pusher paddle from tipping to ensure proper pushing of the product. In addition, the problems associated with debris or sticky materials hindering the effectiveness of known pusher systems that use tracks, rails or guides have been eliminated. Other aspects, embodiments and features of the invention and its teachings are set forth in more detail below.

The exemplary tray 12 may define a surface 16 and one or more dividing panels or dividers 18 to separate the tray into numerous rows for placement of product. In an alternative aspect, the tray 12 may be a shelf or any other surface on which products may be placed for merchandising. The surface 16 may be a solid surface or a surface defining a plurality of spaced-apart apertures 20 separated by a plurality of support ribs 22. The apertures 20 and ribs 22 provide a surface that permits the slidable movement of product placed on this surface and also permits liquids and dirt to pass through the apertures 20 so that they do not collect on the surface 16. The surface 16 may be made of any suitable material that permits the slidable movement of product on the surface 16. Other surface or floor configurations are known and may be used with the principles of the invention.

As depicted in FIGS. 9 and 10, the surface 16 may define a rounded end portion 24 that includes a notch or cut-out portion 26. The end portion 24 may be rounded to match the shape of the product that is placed on the tray. For example, the depicted end portion 24 is rounded or defines a semicircular shape to match the contour of a bottle or can that may be placed in the tray and on the end portion 24. Other shapes of the end portion may be used with the invention depending on the product to be merchandised.

The notch 26 may be used to receive and mount an end 29 of a coiled spring 30 or similar biasing element. The notch 26 may define opposing angled edge surfaces 32 that are joined by edge 34. The edge 34 is preferably centered across the width of the product row formed in the tray 12 and extends perpendicular to the length of the tray. This configuration will center the coiled spring 30 relative to the tray 12 and will permit the spring to extend in a substantially parallel manner relative to the length of the tray. In other words, the depicted edge 34 of the notch 26 will permit the spring 30 to extend along the length of the tray 12 at or near the center of the product row formed by the tray. One skilled in the art will appreciate that the location and configuration of the notch may vary depending on the desired placement of the spring.

The coiled spring 30 may define an end 29 that is configured to be placed across the notch 26 and onto the edge 34. In one aspect, the end 29 of the coiled spring may be V-shaped and function as a hook such that the end 29 will wrap around the edge 34 with a portion of the end 29 of the coiled spring extending beneath the end portion 24 of the surface 16. This configuration permits an easy installation of the coiled spring onto the tray.

Figure 7:
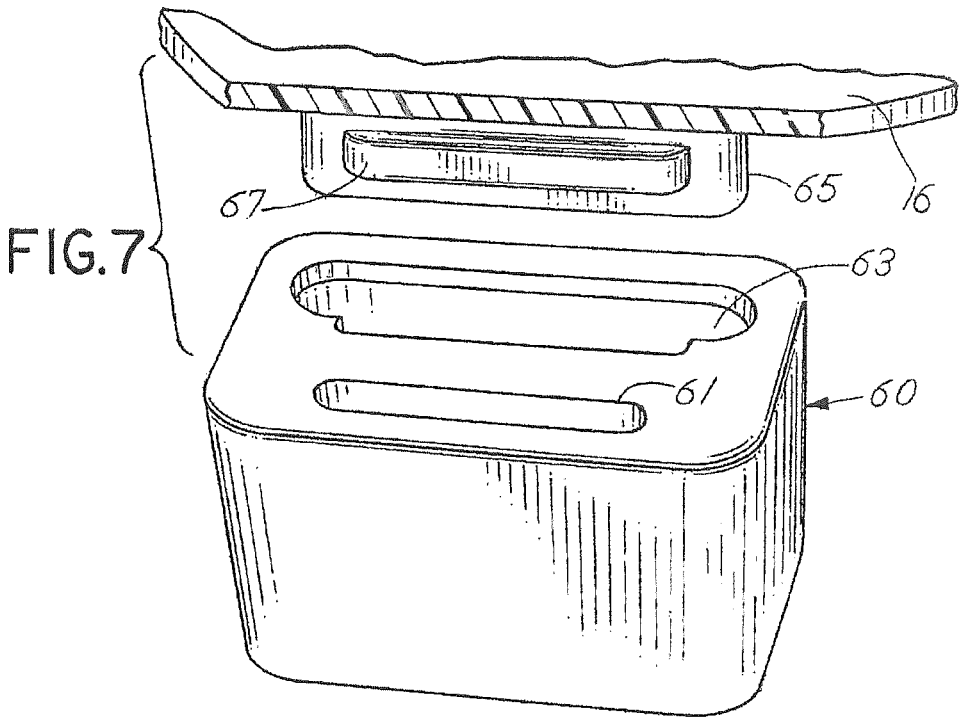
FIG. 7 depicts an exemplary tip for an end of a coiled spring that may be used with the product management display system of the invention.

In another aspect, and referring to FIG. 7, a spring tip 60 may be added to the end 29 of the spring 30 to assist with the mounting of the spring to the system. The spring tip 60 may define numerous shapes and configurations depending on the configuration of the tray and the surface on which the spring end needs to attach. The spring tip 60 may be permanently attached to the end 29 of the coiled spring 30 or it may be detachable to permit the interchange or replacement of the spring tip 60. The spring tip 60 may be made of plastic and may define one or more apertures. Aperture 61 may be used to receive the end 29 of the coiled spring 30. A second aperture 63 may be used to receive a mating tongue or mounting member 65 extending from the surface 16 of the tray 12, as discussed below. With this configuration, the end 29 of the coiled spring 30 may be operatively connected to the tray 12.

In another aspect, the end 29 of the coiled spring may snap-fit into an aperture formed in the surface 16, or may be otherwise inserted and secured to an aperture or opening in the tray, thereby securing the end 29 of the coiled spring 30 in position.

Referring back to FIG. 1, dividers 18 may also be used to separate product into rows. The dividers 18 extend substantially upwardly from the surface 16 and as illustrated in FIG. 1, may be positioned on opposing sides of the surface 16. Alternatively, the dividers 18 may be positioned at any desired position on the tray 12 or to the surface 16. The dividers 18 may be formed as a unitary structure with the surface 16, or the dividers 18 may be detachable to provide added flexibility with the system. The dividers may be attached to a front or back rail depending on the system. The dividers 18 may define numerous configurations and may extend upwardly any desired distance to provide the desired height of the dividers between the rows of product to be merchandised. This height may be adjustable by adding divider extenders or the like.

Figure 6:
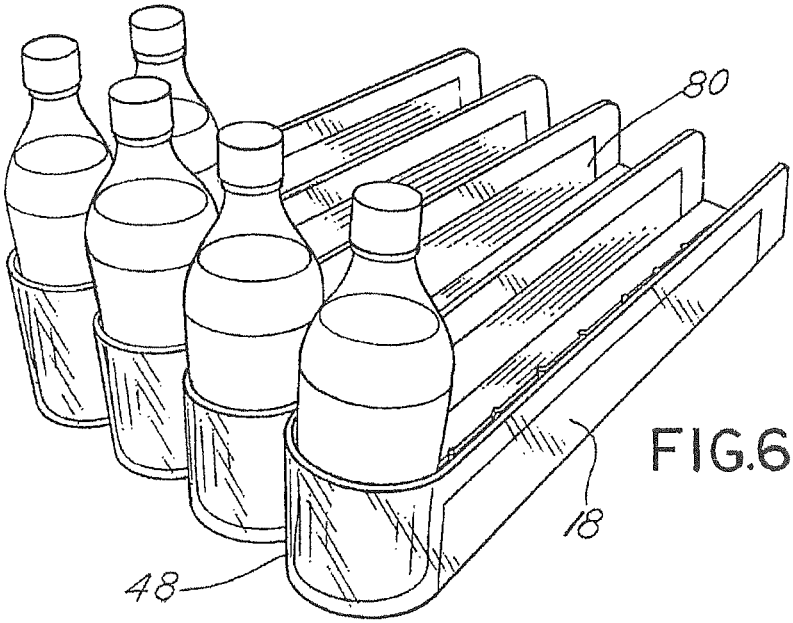
FIG. 6 depicts an alternative embodiment of the tray or product channel of the present invention.

Located at the front of the tray 12 and extending between the dividers 18 may be one or more product-retaining members 44. The product-retaining members 44 serve as a front retaining wall or bar to hold the product in the tray 12 and to prevent the product from falling out of the tray 12. These members are also configured to permit the easy removal of the forward-most product positioned in the tray 12. The product-retaining member 44 may be one or more curve-shaped retaining ribs as depicted in FIG. 1. These illustrated retaining ribs may extend from one divider to another divider thereby joining the dividers. The retaining ribs may also extend part-way between the dividers, as also shown in FIG. 1 as rib 46, to also assist in retaining the product in the tray. Alternatively, and as shown in FIG. 6 the product-retaining member 44 may be a curve-shaped solid retaining wall 48 that extends between dividers. The retaining wall 48 may be transparent or semi-transparent to permit visualization of the product on the shelf. In another aspect, the retaining wall 48 may also extend part-way between the dividers 18. In yet another embodiment depicted in FIGS. 11-15, the retaining wall 100 may be attached to the surface of the tray and not connect to the dividers. In this embodiment, the retaining wall 100 may form an opening 102 defined by an upper member 104, opposing, curved side walls 106 that further define an angled edge 108, and a floor member 110. The side walls 106 may also be straight and not curved depending on the system. The end of the coiled spring may also snap-fit into the floor 110 or otherwise attached to the tray using any of the techniques described herein. One of skill in the art will readily appreciate that there are numerous shapes and configurations possible for the product-retaining member 44 and that the depicted configurations are merely exemplary embodiments of these numerous configurations.

Referring back to FIG. 1, the exemplary trackless pusher mechanism 14 defines a pusher paddle 50 and a pusher floor 52. The pusher paddle 50 and pusher floor 52 may be formed as a single, unitary structure or may be separate structures that are joined together using known techniques. In addition, the pusher paddle 50 and pusher floor 52 may be made of any known suitable plastic or metal material. The pusher paddle and pusher floor may be reinforced using any known reinforcing techniques.

Figure 3:
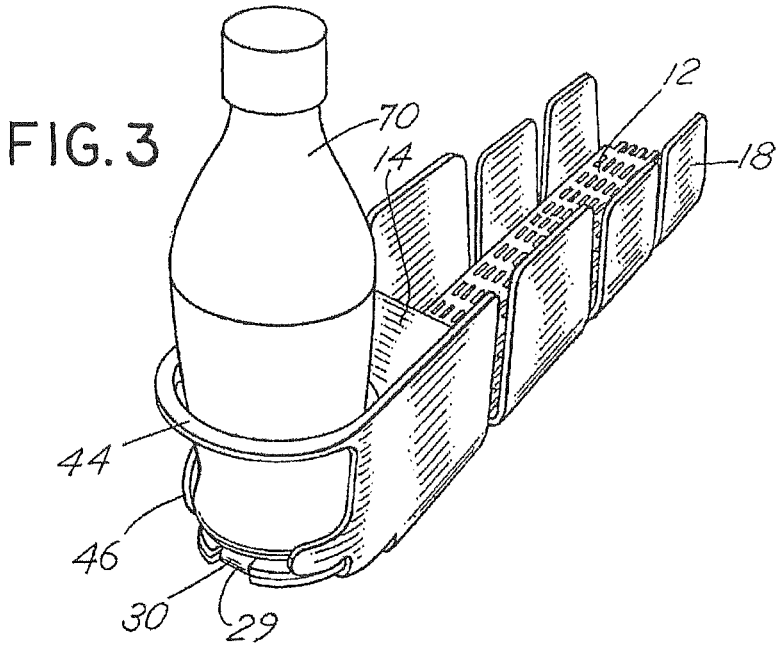
FIG. 3 depicts another isometric view of the system of FIG. 2 with product placed in the system.
Figure 4:
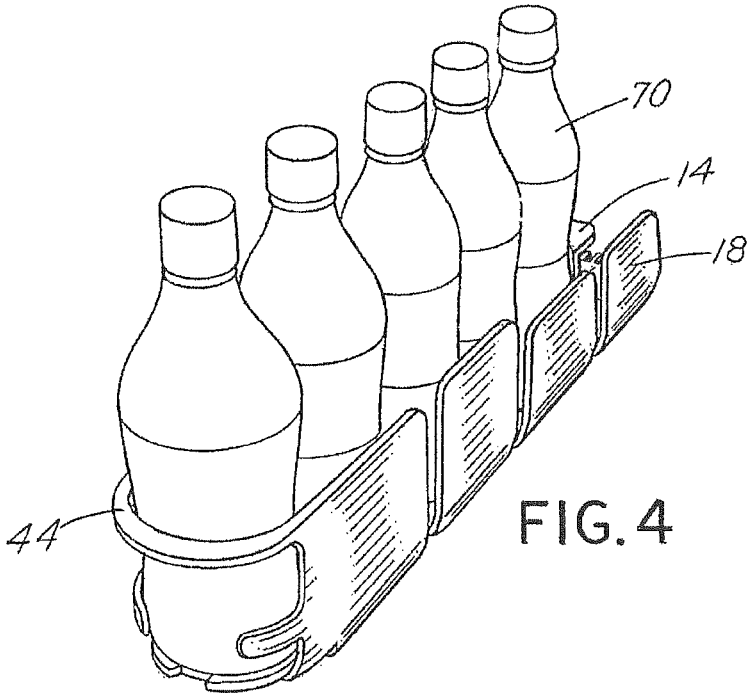
FIG. 4 depicts another isometric view of the system of FIG. 2 with multiple products placed in the system.
Figure 5:
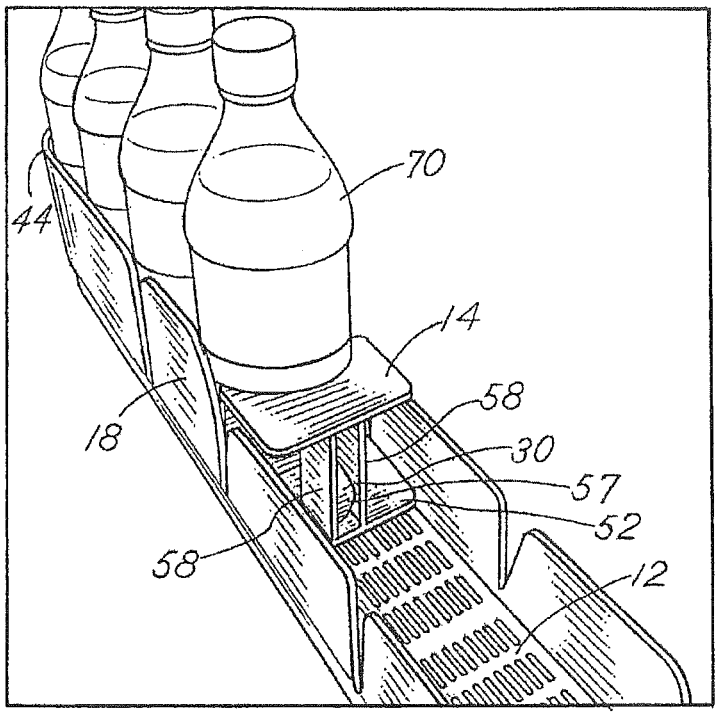
FIG. 5 depicts an isometric rear view of the system of FIG. 4.

In one aspect, the pusher paddle 50 forms a curved-shape pusher surface or face 54 that is configured to match the shape of the product to be merchandised, such as plastic bottles or cans containing a beverage, as depicted in FIGS. 3-5. The curve-shaped pusher surface 54 permits the pusher to remain centrally aligned with the last product in the tray. This configuration reduces friction and drag between the pusher and the divider walls. In an alternative aspect, the pusher surface or face may be a flat surface. In yet another aspect, the flat pusher surface may be accompanied by a curved shaped rib that is positioned near or on the top of the pusher paddle and that may be used to center and align product in the tray, in a manner similar to the curve-shaped pusher surface 54 depicted in FIG. 1. The curve shaped rib may define other shapes and configurations that permit cylindrical or similar shaped products to be properly pushed in the tray. Advertisement, product identification or other product information may be placed on the pusher surface 54.

Positioned behind the pusher surface or face 54 may be one or more support members 58, such as ribs, walls, or gussets. The support members 58 are configured to support the pusher surface 54 and further connect the pusher paddle 50 to the pusher floor 52. As can be seen in FIG. 5, positioned between the support members 58 is the coiled spring 30, and more specifically the coiled end 57 that is used to urge the pusher paddle 50 forward and along the tray 12, as understood in the art. Any technique used to operatively connect the coiled spring to the pusher paddle 50 may be used with the invention.

As shown in FIG. 1, the pusher floor 52 may be positioned below the pusher paddle 50 and may extend forward of the pusher surface 54 of the pusher paddle. The pusher floor 52 may extend any predetermined distance and at any predetermined angle. For example, the pusher floor 52 may extend substantially perpendicular to the pusher surface 54. In the exemplary embodiment, the pusher floor 52 may extend a sufficient distance to permit one product, such as a single bottle or can, to be placed on the pusher floor. In another aspect, the pusher floor 52 may be configured to permit more than one product to be placed on the pusher floor. The pusher floor 52 may define any shape, including the depicted round shape and may define any product retaining features on the surface of the pusher floor, such as ribs, walls, or the like, to further hold the product on the pusher floor.

Figure 2:
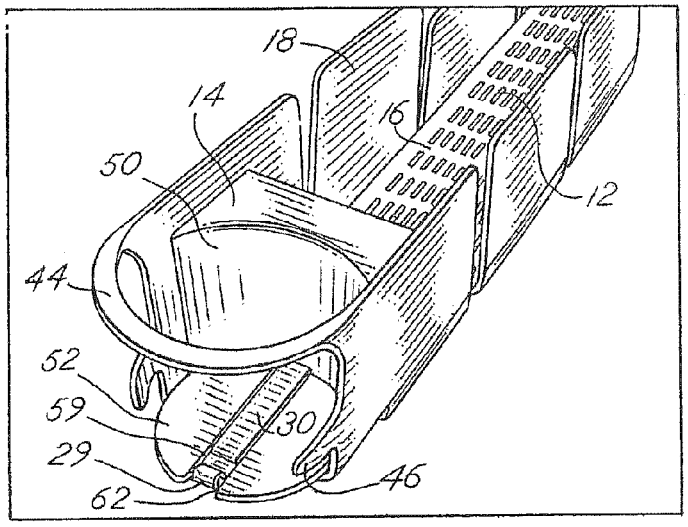
FIG. 2 depicts an isometric view of an exemplary pusher mechanism mounted to an exemplary tray or product channel of the present invention.
Figure 19:
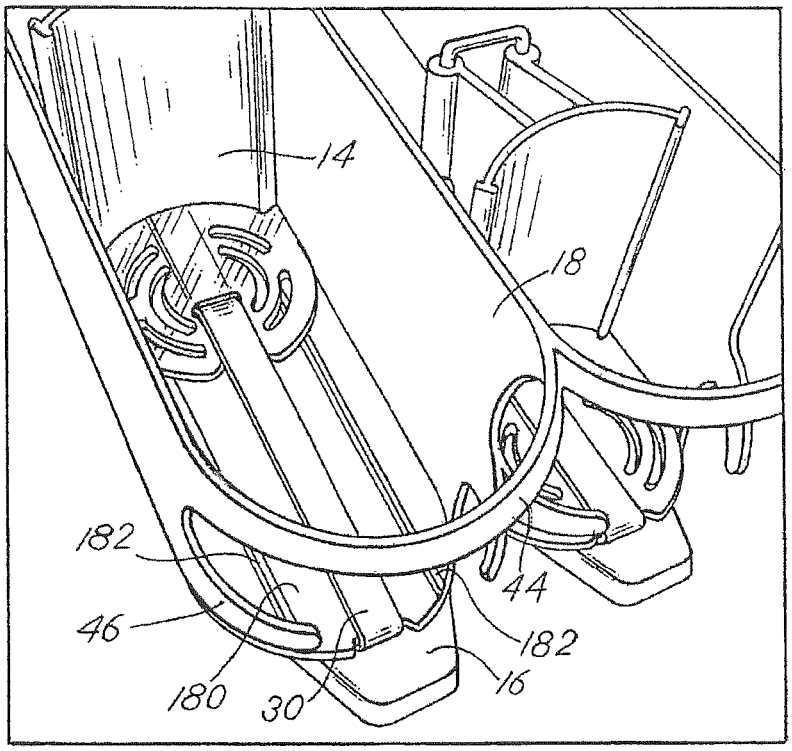
FIG. 19 depicts an isometric view of an installed adaptor of the invention.
Figure 20:
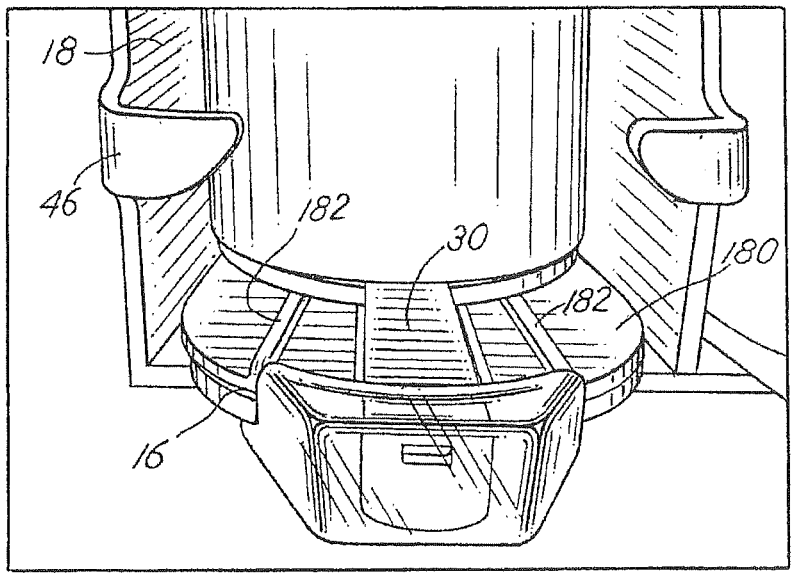
FIG. 20 depicts a front view of an installed adaptor of the invention.

As can be seen in FIG. 2, the pusher floor 52 may define an elongated channel, groove or recessed portion 59 that is sized, shaped and configured to seat the coiled spring 30. In the exemplary embodiment, the channel or groove 59 may extend across the floor 52 and in a substantially perpendicular manner relative to the pusher paddle 50. In an alternative aspect, the groove or channel may extend part-way or across the entire pusher floor 52, as shown in FIG. 19. Such configuration permits the proper alignment and positioning of the pusher paddle 50 in the tray. The groove 59 may define a depth that matches or exceeds the thickness of the coiled spring 30. With this configuration, the coiled spring 30 will seat at or below the pusher floor surface such that product will not sit directly on the coiled spring, rather, such product will sit on the pusher floor surface. As shown in FIG. 19, the pusher floor may include apertures and openings through which debris or other items may pass. Alternatively, the floor may be a solid surface.

Figure 16:
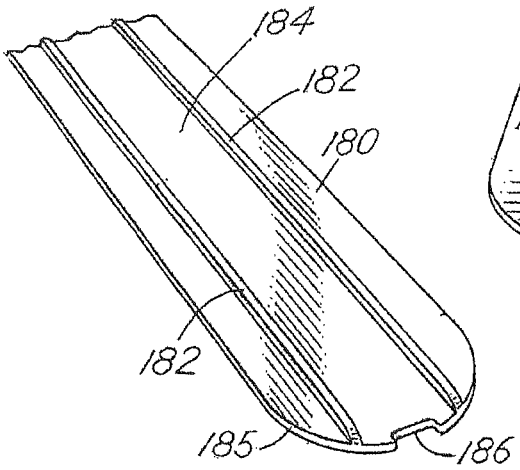
FIG. 16 depicts an isometric view of an adaptor that may be used with the invention.
Figure 17:
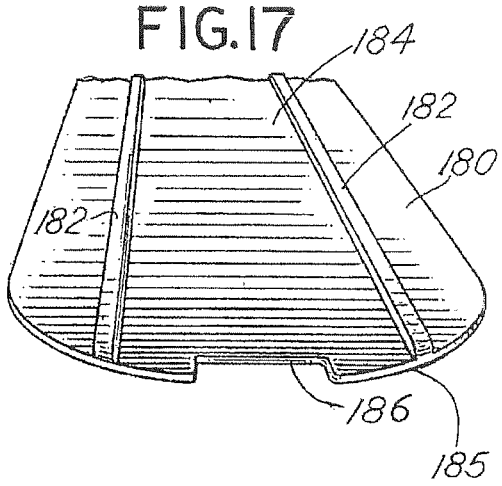
FIG. 17 depicts a front view of the adaptor of FIG. 16.

In an alternative aspect of the invention, as shown in FIGS. 16-20, an adaptor 180 may be positioned on the surface 16. Referring to FIGS. 16 and 17, the adaptor 180 may include one or more raised ribs 182 on which a product may sit. The raised ribs 182 may extend longitudinally along the length of the adaptor 180. The adaptor 180 may be a flat extrusion of plastic material (or any other suitable material) defining a planar surface 184 with the one or more ribs 182 extending outwardly from the planar surface 184. The adaptor 180 may define a rounded end 185 and include a notch or cut-away portion 186 through which or across which the coiled spring may extend. The rounded end 185 may be configured to match the shape of the product that is placed on the tray. Other shapes of the end 185, notch 186 and adaptor 180 may be used with the invention depending on the product to be merchandised. The adaptor 180 may be a separate, insertable piece or, alternatively, a piece formed integral with the surface 16.

Figure 18:
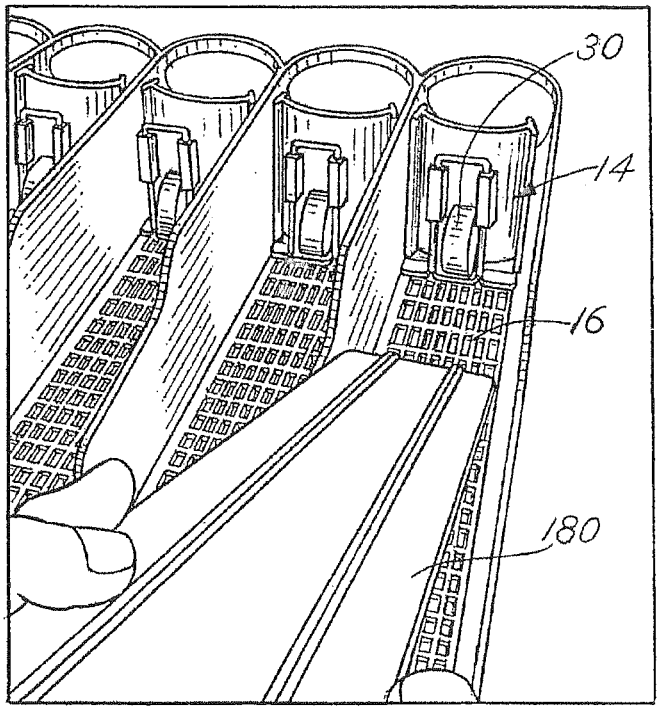
FIG. 18 depicts an exemplary installation of the adaptor of the invention.

Referring to FIG. 18, the adaptor 180 may be easily insertable onto the surface 16 and between the dividers 18. Referring to FIG. 19, once the adaptor 180 is installed, the pusher mechanism 14 may be positioned on top of the adaptor 180 and may slide freely across the ribs 182 of the adaptor 180. The coiled spring 30 may extend in a parallel manner between the ribs 182 and may seat at or below the top surface of the ribs 182, as more clearly shown in FIG. 20. With this configuration, the product to be merchandised may sit on, and slide along, the ribs 182 and not on the coiled spring 30.

In an alternative aspect, the ribs 182 may be a raised bead or raised beads, or a series of fingers that may be used to facilitate the movement of the product on the surface 16. In yet another alternative embodiment, the ribs 182 may be product moving members, such as runners or one or more rollers or rolling members that permit the product to roll across the rolling members and toward the front of the product display system. Exemplary roller assemblies include those disclosed and described in U.S. application Ser. No. 11/257,718 filed Oct. 25, 2005 and assigned to RTC Industries, Inc., which application is incorporated herein by reference. As should be appreciated by those skilled in the art, there are many possible techniques that may be used with the described pusher mechanisms for facilitating the movement of the product on the shelf or floor.

The underneath side of the pusher floor 52 may be a smooth planar surface that will slide freely along the surface 16. Alternatively, and similar to above, the pusher floor 52 may include beads, runners, rollers or the like that will permit the pusher floor to slide along the surface yet raise the pusher floor up off of the surface 16. In another alternative embodiment, the underneath side of the pusher floor may be configured with rail mounting members to permit the mounting of the pusher to a track or rail, as understood in the art.

The pusher floor further defines a notch or cut-out portion 62 through which will pass the coiled spring 30. The end 29 of the coiled spring 30 will pass through the notch 62 and through the notch 26 of the surface 16 and will mount to the tray using any of the techniques described above.

In use, as the pusher mechanism 14 is urged rearward in the tray 12, the end 29 of the coiled spring 30 will be held in position as described above and the coiled end 57 of the spring 30 will begin to uncoil behind the pusher paddle 50. If the pusher 14 is allowed to move forward in the tray 14, such as when product is removed from the front of the tray, the coiled end 57 of the spring 30 will coil and force the pusher paddle 50 forward in the tray 12, thereby urging product toward the front of the tray.

In an alternative embodiment, the coiled spring 30 may extend below and underneath the pusher floor 52 as opposed to above and across the pusher floor, as depicted in the figures. With this configuration, the groove 59 and notch 62 may not be necessary.

The coiled spring 30 may be any biasing element including, without limitation, a flat coil spring commonly used with pusher systems. The present invention may use one or more coiled springs to urge the pusher mechanism 14 forward depending on the desired application. The coil tension of the spring 30 may also vary depending on the particular application.

Referring to FIG. 2, the trackless pusher mechanism 14 is shown mounted to the tray 12. As illustrated, the pusher mechanism 14 fits in the tray 12 between the dividers 18. End 29 of the coiled spring 30 extends through the notch in the pusher floor and mounts to the tray as described above. In use, the pusher mechanism 14 will slide along the surface 16 of the tray 12 without the use of tracks, rails, or guides. As depicted in FIG. 2, the pusher mechanism 14 is shown in a forward position.

Referring to FIG. 3, the pusher mechanism 14 is shown merchandising one product 70 in the merchandise system 10. The product is prevented from tipping out of the tray by the product-retaining member 44. The product 70 may be any product to be merchandised including the depicted soft drink bottle. As shown in this Figure, the product 70 sits on the pusher floor 52 and the coiled spring 30 that extends below the product. The weight of the product on the floor 52 and the positioning of the product across the spring 30 prevent the paddle 50 from tipping in the tray 12.

Referring to FIG. 4, the pusher mechanism 14 is shown merchandising multiple products 70 in the merchandise system 10. As shown in this Figure, the product next to the pusher paddle 50 sits on the pusher floor 52 and the coiled spring 30 that extends below the product. The other products will sit on the coiled spring 30 that will extend below these products. Alternatively, the adaptor 180 may be positioned in the system in which case the product may sit on the ribs 182 of the adaptor as opposed to the coiled spring. Again, the weight of the product on the pusher floor 52 and the positioning of the products across the spring 30 prevent the paddle 50 from tipping in the tray. In use, as one product is removed from the front of the tray near the product-retaining member 44, the pusher mechanism 14 (through the urging of the coiled spring 30) will push the remaining product forward in the tray 12 until the forward-most product contacts the product-retaining member 44. As additional products are removed, the pusher mechanism 14 will continue to push the remaining product toward the product-retaining member 44.

Referring to FIG. 5, a rear view of the pusher mechanism 14 shows the pusher mechanism 14 merchandising multiple products 70 in the merchandise system 10. Again, the product next to the pusher paddle 50 sits on the pusher floor 52 and the coiled spring 30 that extends below the product. The other products will sit on the coiled spring that will extend below these products. Alternatively, the adaptor 180 may be positioned in the system in which case the product may sit on the ribs 182 of the adaptor as opposed to the coiled spring. As one product is removed from the front of the tray near the product-retaining member 44, the coiled end 57 of the spring 30 will urge the pusher paddle 50 of the pusher mechanism 14 forward in the tray 12 until the forward-most product contacts the product-retaining member 44. As can be seen in this Figure, the coiled end 57 may be positioned between two support members 58. The support members will retain the coiled spring between these members. As can be seen in this Figure, the pusher floor 52 may also extend below the support members 58.

Referring to FIG. 6, an alternative embodiment of the pusher tray is depicted. With this embodiment, multiple trays 12 may be formed into a single multi-tray assembly 80. The multi-trays may have a common floor with dividers 18 extending upwardly from the floor to create the multiple trays or rows. In this embodiment, the product-retaining member 44 may be a solid member that extends between two dividers, as discussed above. One or more of the multi-tray assemblies 80 may be coupled or joined together in a side-by-side manner using any known technique, including clips, dovetailing, fasteners, or the like. With this configuration, numerous rows of product can be provided for the merchandising of numerous products.

As stated above, the trackless pusher mechanism 14 may be used with gravity-fed systems, that is, systems having trays or product channels that are mounted on an incline to permit gravity to assist with the merchandising of the product. Alternatively, the trackless pusher mechanism 14 may be used with systems that are mounted in a non-inclined or in a horizontal manner where gravity will provide little or no assistance with the merchandising of the product. The trackless pusher mechanism 14 may also be used to push various shaped products.

FIG. 7 depicts an exemplary tip 60 for the end 29 of a coiled spring 30 that may be used with the merchandise system 10. As illustrated, the tip 60 defines an aperture 61 for receiving the end 29 of the coiled spring and an aperture 63 for mounting to the surface 16 of the tray. As can be seen in FIG. 7, in one aspect of an alternative embodiment, extending beneath the surface 16 may be a tongue or mounting member 65 that may be configured to mate with the aperture 63 and to snap-fit the tip 60 onto the tongue 65 and thus to the surface 16.

Figure 8:
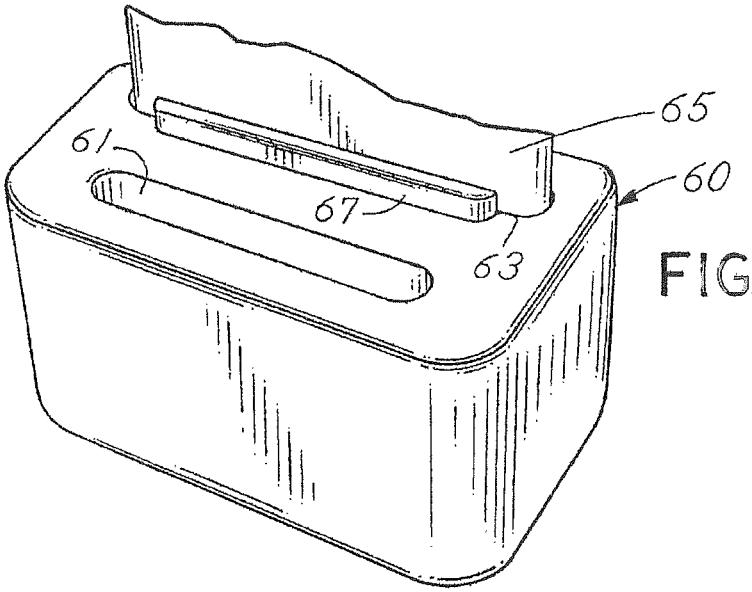
FIG. 8 depicts the exemplary tip of FIG. 7 being mounted to a surface of a tray or product channel.
Figure 15:
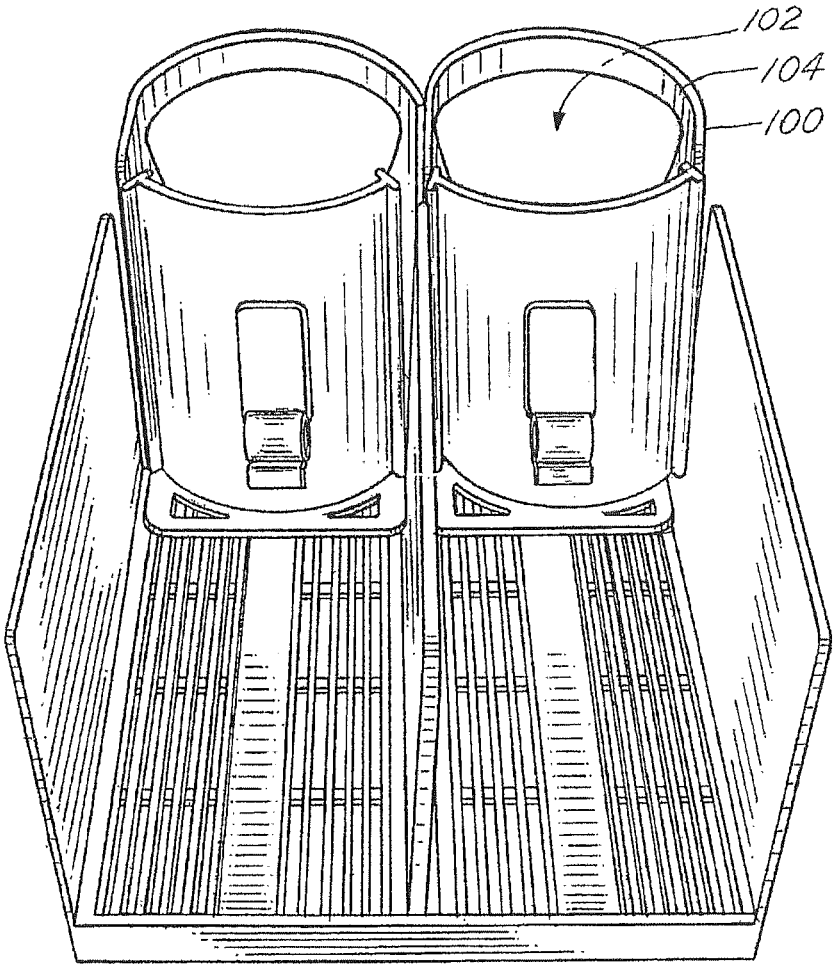
FIG. 15 depicts a rear view of the system of FIG. 11.

Referring to FIG. 8, the exemplary tip 60 of FIG. 7 is shown being mounted to the tongue or mounting member 65. The tongue 65 may include an elongated outwardly extending rib 67 that is used to snap-fit the tip 60 onto the tongue 65. One skilled in the art will appreciate that other techniques may be used to mount the tip 60 to the surface 16 and that the depicted technique is merely an exemplary embodiment of one such technique.

Referring to FIG. 9, the exemplary tip 60 is shown fully mounted in a snap-fit manner to the surface 16, and more specifically to the end portion 24 of the surface 16 of the tray 12. Also depicted is the mounting of the end 29 of the coiled spring 30 to the aperture 61 of the tip 60. As shown in FIG. 9, the end 29 of the coiled spring may be inserted into the aperture 61. The aperture 61 is configured to receive the end 29 of the coiled spring and hold the end 29 in position, and to also permit the removal of the end 29 of the coiled spring from the aperture 61 in those circumstances where it is desirable to disconnect the coiled spring from the tip to permit the removal of the pusher mechanism 14 from the system.

Referring to FIG. 10 there is shown the end 29 of the coiled spring fully mounted to the exemplary tip 60. As illustrated in this figure, the coiled spring 30 is now operatively connected to the surface 16 of the tray 12. As a result, the pusher mechanism 14 is now mounted to the tray 12.

Referring to FIGS. 21-27 there is shown an alternative technique for mounting the end 29 of the coiled spring 30 to the merchandise display system. A mounting member 130 may be used to mount the end 29 of the coiled spring to the floor 131 of the system. For those systems that include spaced-apart glide rails 132 that are joined together by connecting ribs 134 (FIGS. 26-27), the mounting member 130 may be snap-fit to or otherwise mounted on the floor 131 and between the glide rails 132. The mounting member will thus hold the end of the coiled spring in position and to the floor of the system.

Figure 26:
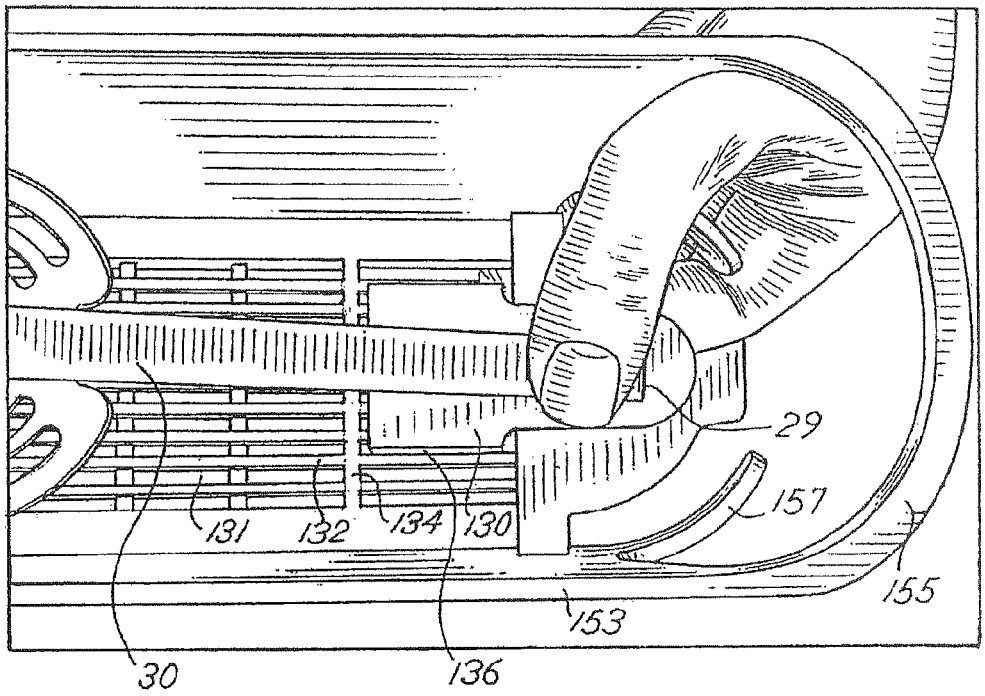
FIG. 26 depicts the exemplary mounting member of FIG. 22 with attached coiled spring being mounted to the floor of the system.
Figure 27:
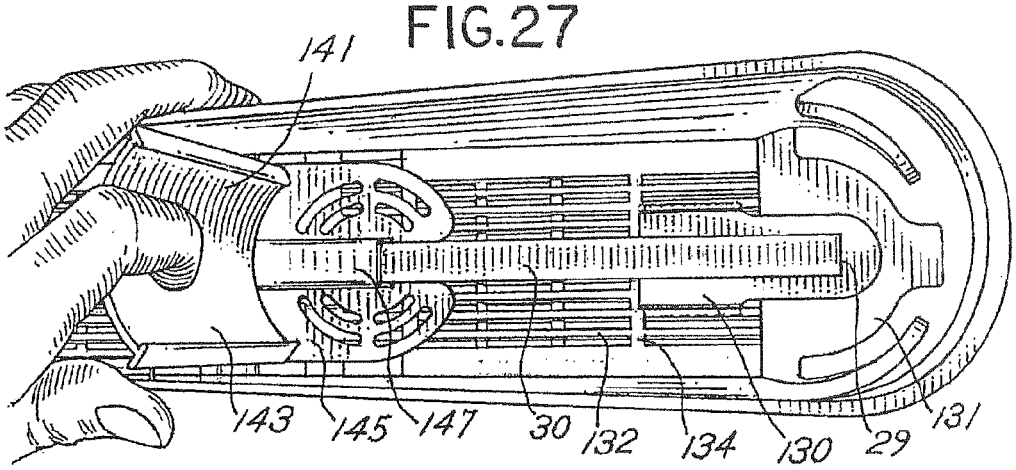
FIG. 27 depicts the exemplary mounting member of FIG. 22 installed on the floor of the system.

Referring to FIGS. 22-23, the mounting member 130 may include one or more legs 136 on one or more sides of the member 130. The legs may be configured to snap-fit to the underside of the rails 132 to thereby hold the mounting member 130 to the floor of the system. The legs 136 may include legs ends 137 defining an L-shape or angled surfaces that are configured to contact the underside of the rail 132 and prevent the mounting member 130 from being lifted up from the floor, except by the intentional flexing of the legs out from the underside of the rail 132. The legs 136 may contact the connecting ribs 134 which will prevent slidable movement of the mounting member 130 relative to the floor. Referring to FIG. 26, the mounting member 130 is shown being mounted to the floor of the system and more specifically to the rails. FIG. 27 illustrates that the mounting member 130 remains in position as the pusher paddle 141 is pulled away from the front of the system. The mounting member 130 may be connected to this type of system floor 131 using other techniques. For example, a separate mounting clip, one or more fasteners, adhesives, or other techniques may be used to secure the mounting member 130 to the floor 131.

Referring to FIGS. 22-23, the mounting member 130 may also include an aperture or opening or slot 138 that will receive the end 29 of the spring. The spring may be mounted using any of the techniques described herein, or other techniques. The configuration of the aperture 138 and mounting member 130 will hold the spring in position on the mounting member 130, similar to the technique described above.

The mounting member 130 may also include glide ribs 139 on a top surface that allow product placed thereon to slide more easily across the mounting member after the mounting member is installed to the floor of the system. The mounting member 130 may also include an elongated flat body 140 that extends forward of the location of the legs 136 to provide stability to the mounting member 130 after it is mounted to the floor of the system.

Figure 24:
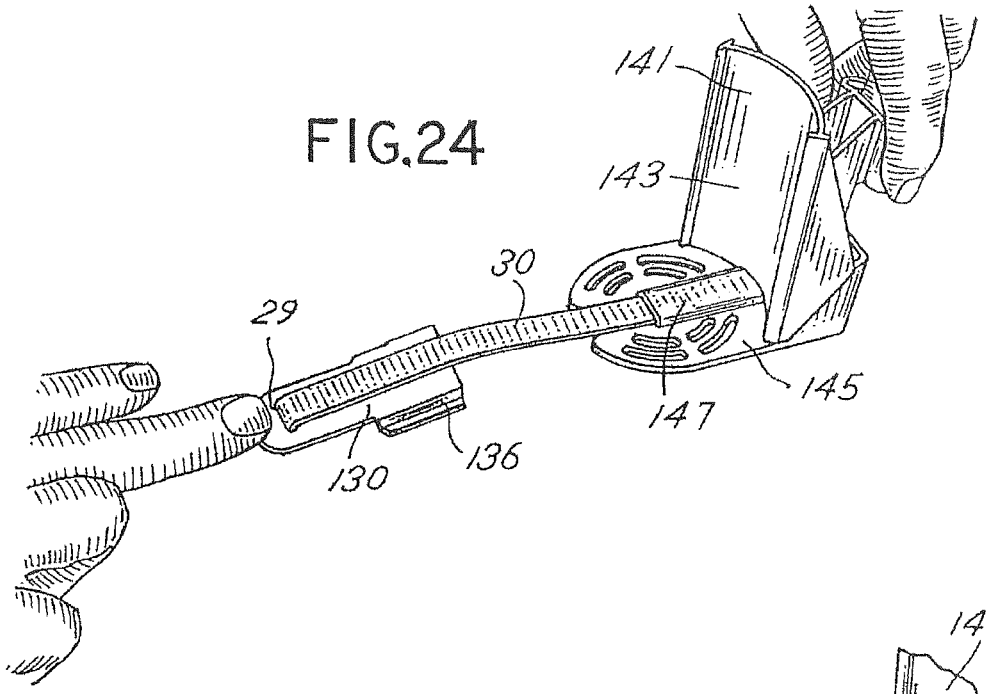
FIG. 24 depicts the exemplary mounting member of FIG. 22 mounted to the end of the coiled spring with the coiled spring mounted to an exemplary pusher paddle.
Figure 25:
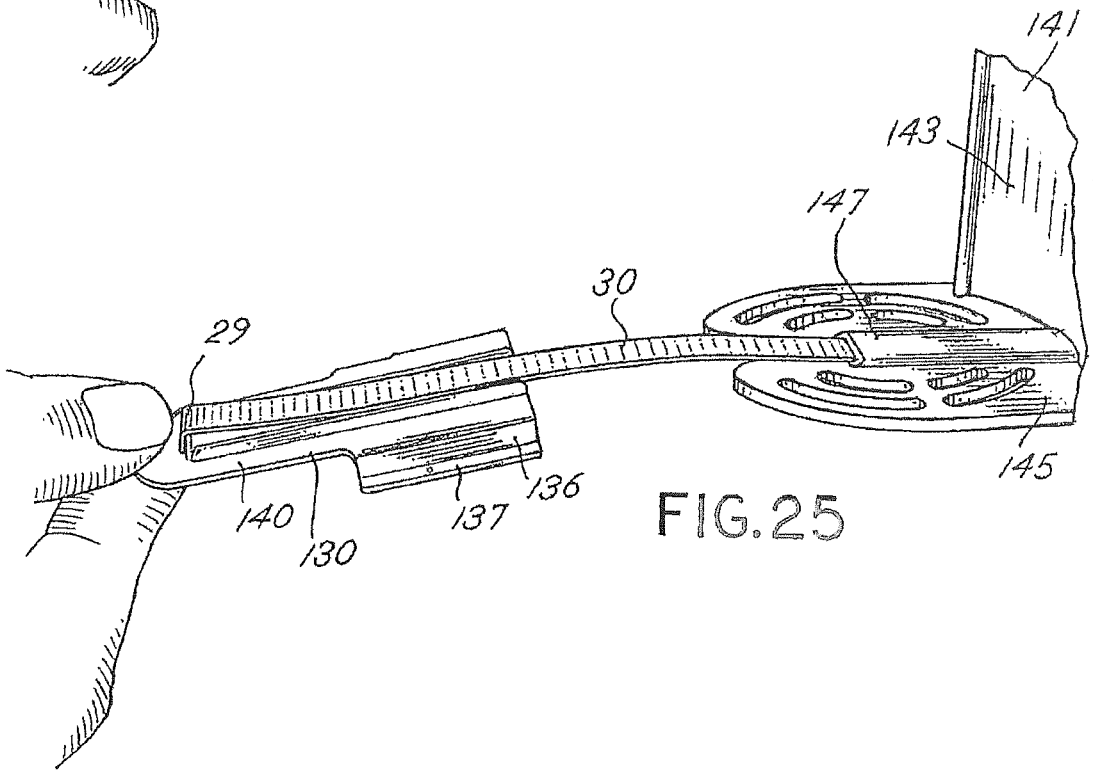
FIG. 25 depicts another view of the exemplary mounting member of FIG. 22 mounted to the end of the coiled spring with the coiled spring mounted to an exemplary pusher paddle.

Referring to FIGS. 24-25 and 27, the pusher paddle or pusher mechanism 141 may include a pusher face 143 configured to match the shape of the product against which it pushes. As illustrated, the pusher face 143 may be curve shaped to match the shape of a bottle or other cylindrical object. The pusher paddle 141 may also include a pusher floor 145 similar to the pusher floor configurations described above. The pusher floor 145 may further include a spring sleeve 147 that receives the coiled spring 30 to shield and protect the spring. The spring sleeve 147 may extend partly or fully across the pusher floor 145 and in the direction of the spring 30. The spring sleeve 147 may have a relatively short height and a flat surface 149 to permit product to sit thereon without significant tipping or leaning of the product.

The pusher paddle 141 may be positioned on top of the floor 131 to glide on top of the surface, as described above. The pusher paddle may be positioned between two product divider walls 153 that are joined together by a product retaining member 155. Additional product retaining members 157 may extend outwardly from the product dividers.

Referring to FIGS. 28 and 29 there is shown yet another alternative technique for mounting the end 29 of the coiled spring 30 to the merchandise display system. In this embodiment, the end 29 is riveted to the tray 216.

Referring to FIGS. 28-32 in an alternative embodiment, the trackless pusher system may be retrofitted to an existing shelf assembly 230, which may have product dividers already built in. For example, in one embodiment, the trackless pusher system may be retrofitted to an existing wire shelf assembly. Referring to FIGS. 30-32, a tray or adaptor 216 may have a glide floor 222 that may be sized to a single lane of the shelf 234 or sized to an entire shelf width. The glide floor 222 may include several raised ribs 224, which help to reduce friction for the products merchandised on the tray 216. It should be understood that one or more raised ribs 224 may be used with the glide floor 222. Alternatively, the glide floor 222 may be a flat, planar surface without raised ribs. The tray or adaptor 216 may be configured similar to the adaptor 180 of FIG. 16.

As shown in FIGS. 28 and 30, the end 29 of coiled spring 30 may be riveted, via a rivet 229, to the front end 228 of the tray 216, or may be attached by any other attachment technique. The tray 216 can be retained to the shelf by any attachment technique suitable for the particular shelf. In one embodiment, and as illustrated in FIGS. 29-32, the tray 216 may include one or more outwardly extending fingers or snaps 220, which may engage one or more individual wires 232 of the shelf 234 to retain the tray 216 on the shelf 234. The fingers or snaps 220 may extend longitudinally along the length of the tray 216, or may be spaced apart along the length of the tray. The snaps 220 may be used to snap-fit the tray 216 to the existing wire shelf. As depicted in FIGS. 29A and 29B, the snaps 220A and 220B may define numerous configurations that permit the tray 216 to be snap fit to the shelf. The embodiment depicted in FIGS. 28-32 allows for the placement of the trackless pusher system in an existing shelving system, such as a wire shelf system, as a low cost alternative to the entire trackless pusher assembly. It should be understood that with this embodiment, any pusher mechanism described herein may be used.

Figure 33:
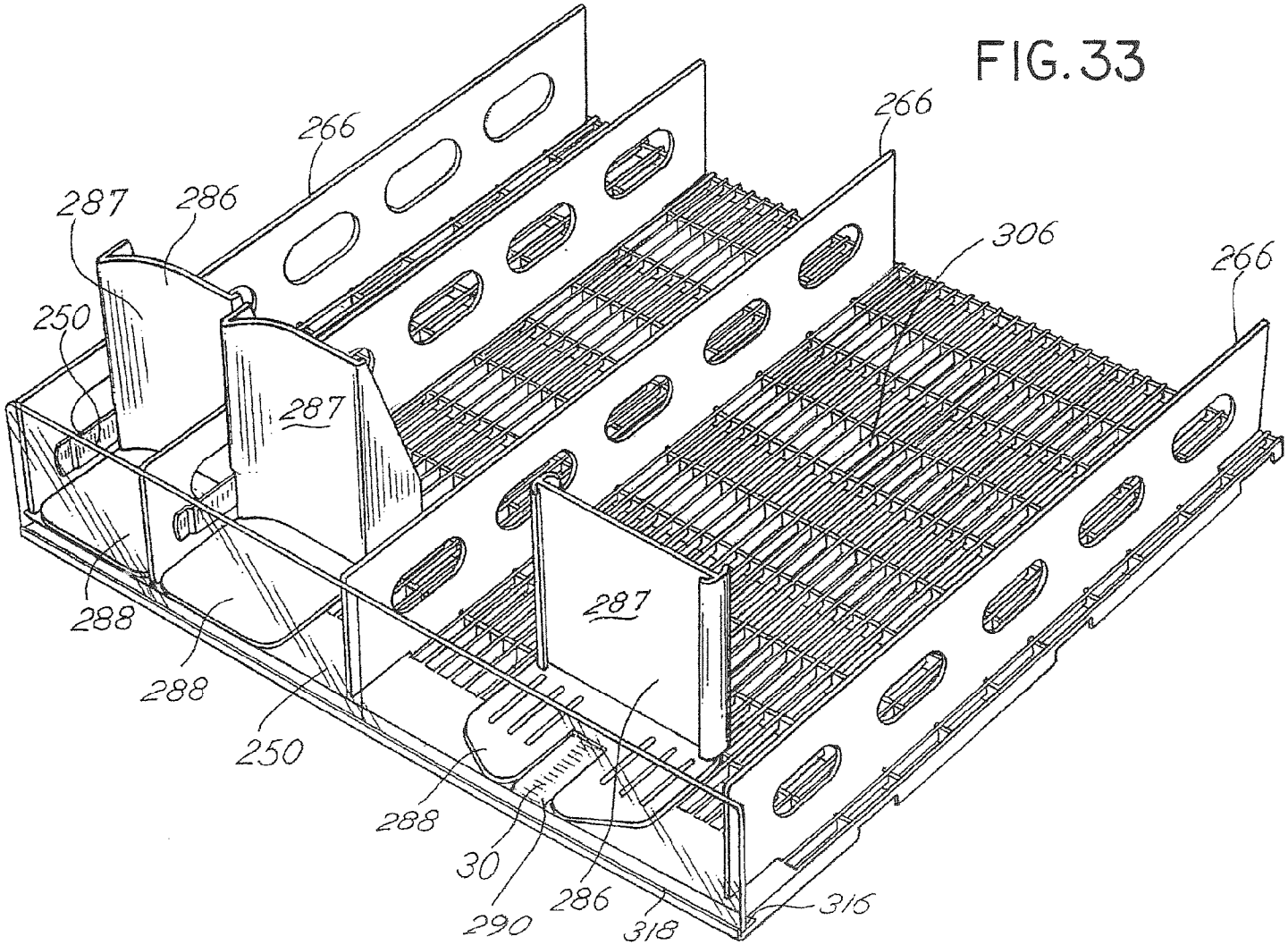
FIG. 33 depicts an isometric view of an exemplary embodiment of the display system.
Figure 44:
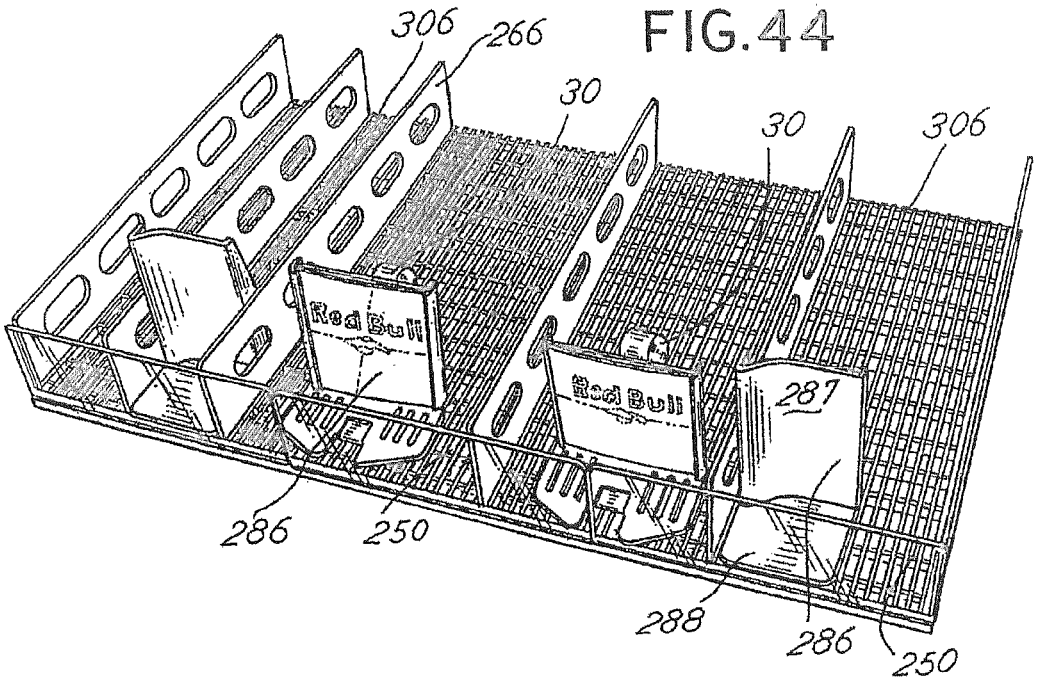
FIG. 44 depicts an isometric view of an exemplary embodiment of a product management display system.

As depicted in FIGS. 33 and 44, in another exemplary embodiment, the display management system comprises one or more pusher mechanisms 286, one or more dividers 266, one or more trays 306, and one or more retainers 250. The pusher mechanisms 286 can be formed of a pusher paddle 287 and a pusher floor 288. Product is placed on the pusher floor 288 and guided to the front of the display management system via the dividers 266 and the pusher paddle 287. The coiled spring 30 biases the pusher mechanism 286 toward the retainer 250 such that product moves to the front of the system.

Figure 34:
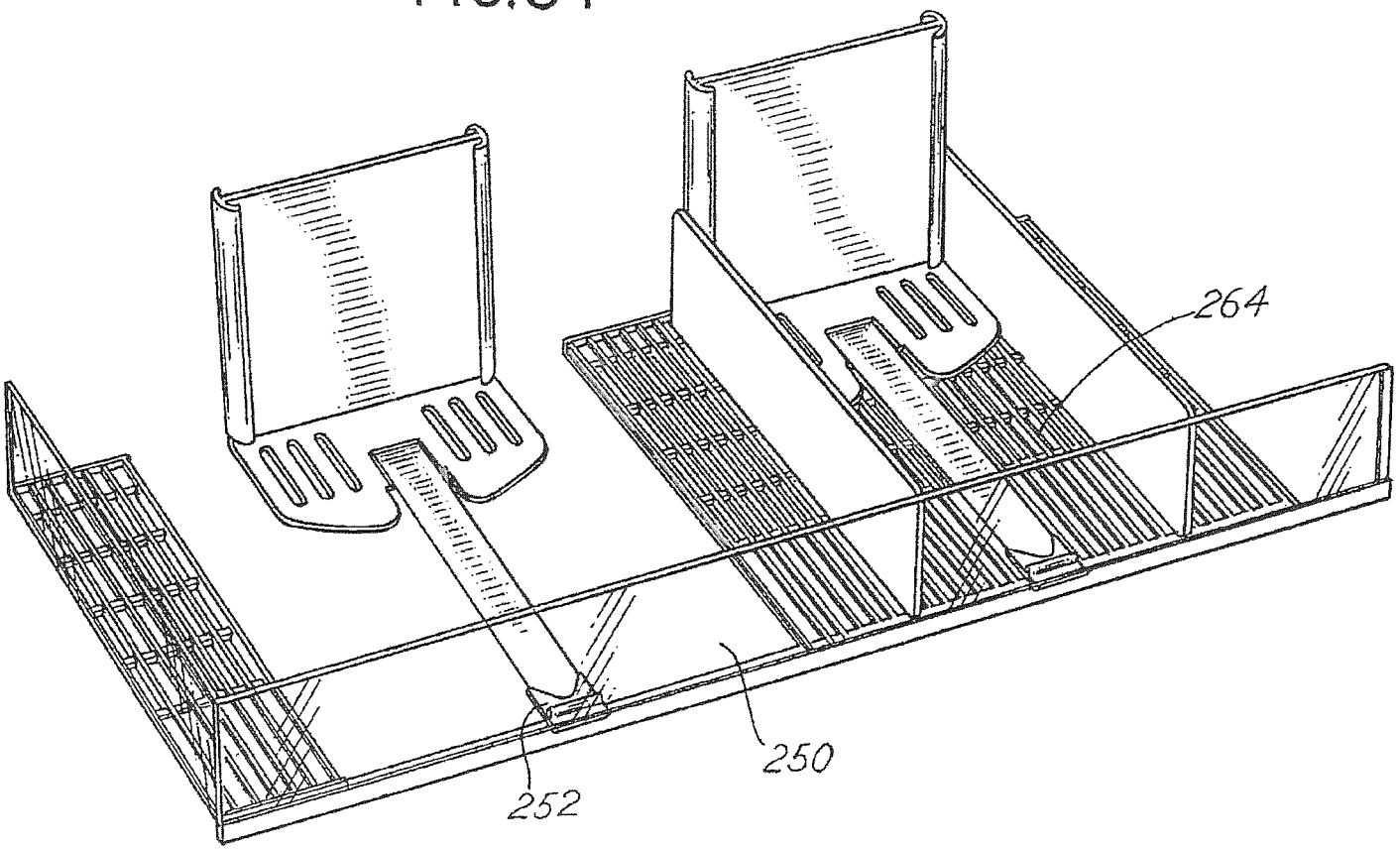
FIG. 34 depicts an isometric view of an exemplary embodiment of the display system.
Figure 48:
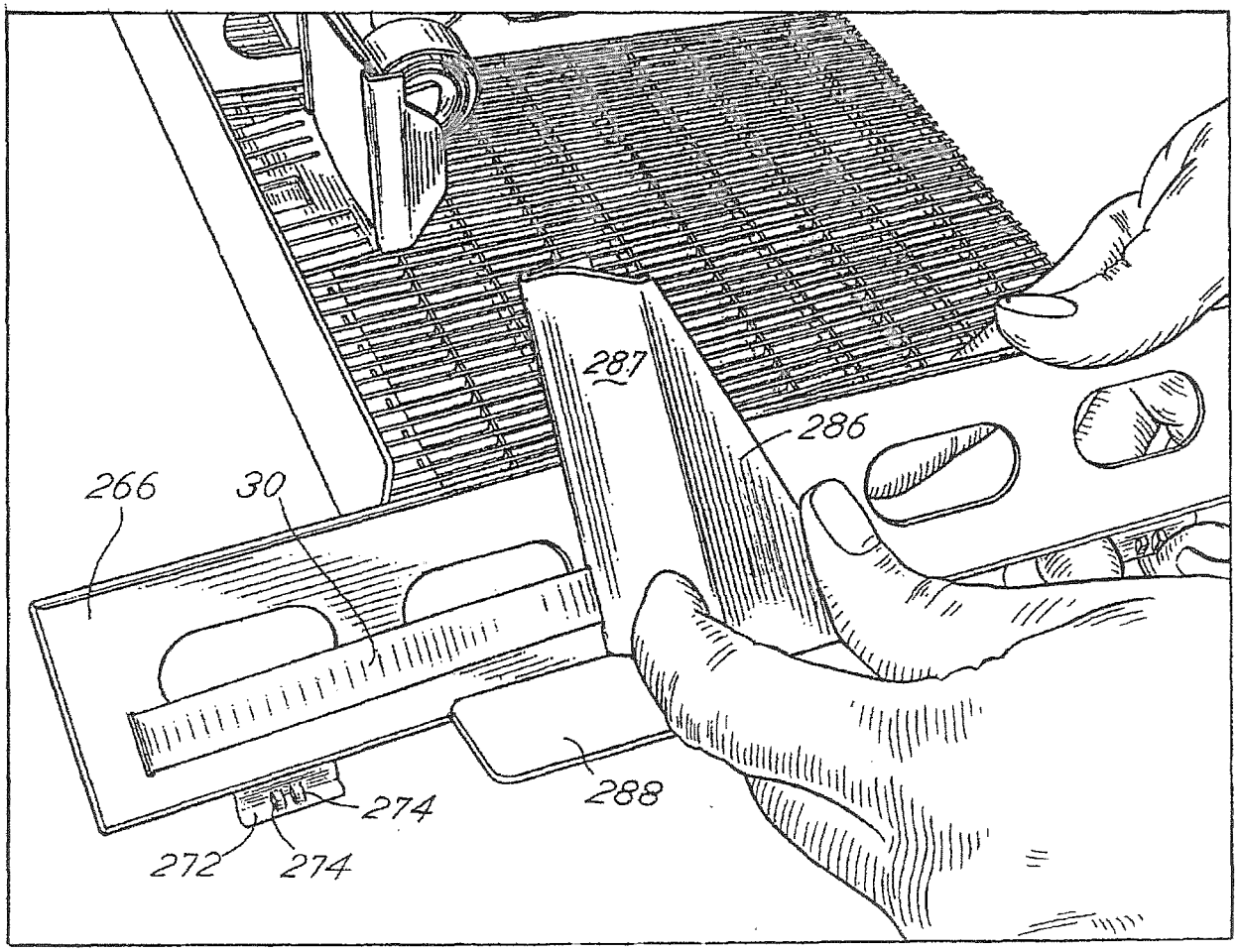
FIG. 48 depicts an isometric view of an exemplary embodiment of the pusher mechanism mounted to a divider.
Figure 49:
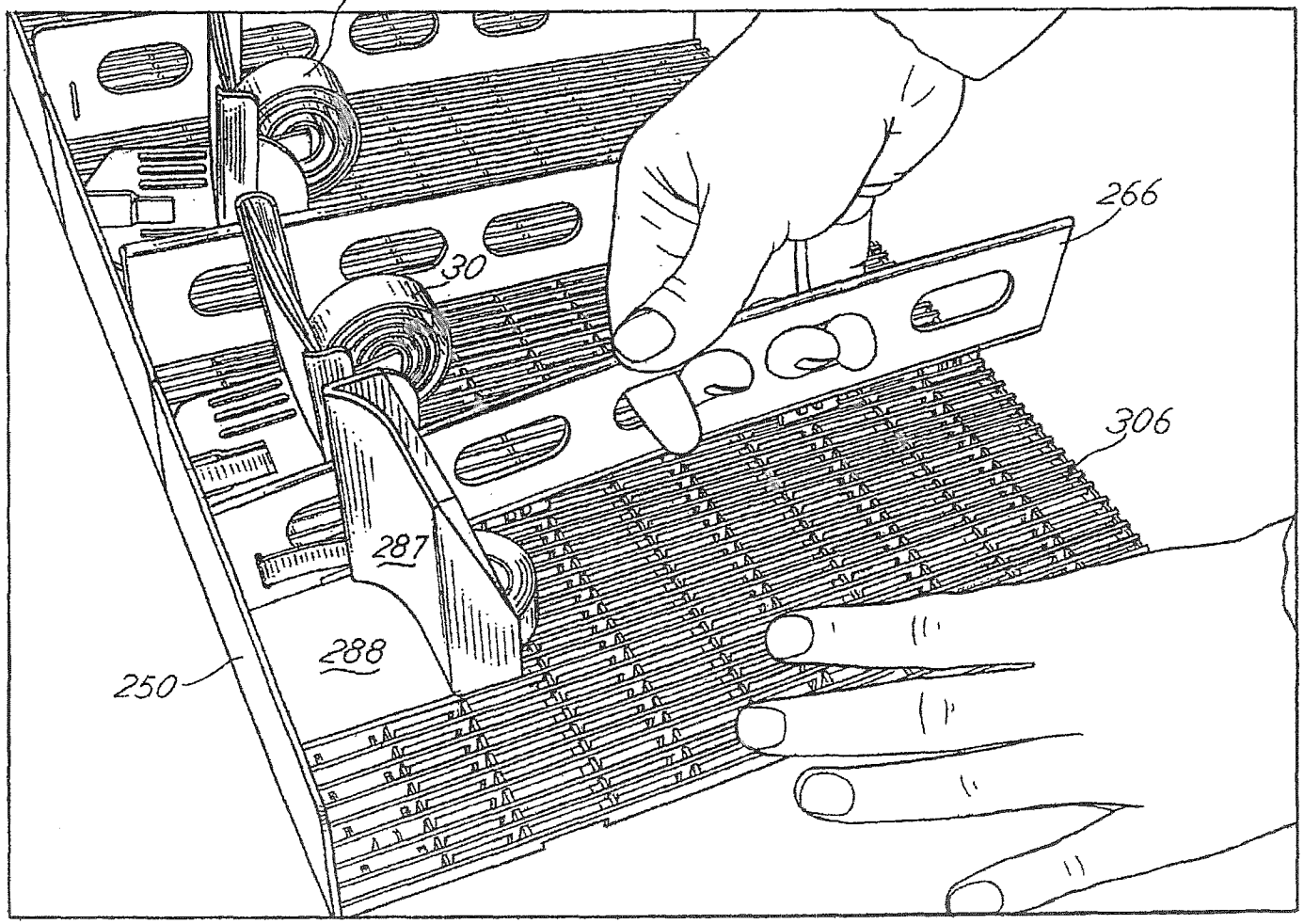
FIG. 49 depicts another isometric view of the divider and pusher mechanism being assembled to the product management display system.

In one exemplary embodiment, depicted in FIG. 33, the coiled spring 30 can be mounted to the retainer 250. Alternatively, the coiled spring 30 can be mounted to a divider 266 (also shown in FIGS. 48 and 49). The coiled spring 30 can be directly mounted to the retainer 250, as depicted in FIG. 33, or can be mounted to the retainer 250 via a separate adapter 252, as depicted in FIG. 34.

Figures 35, 36:
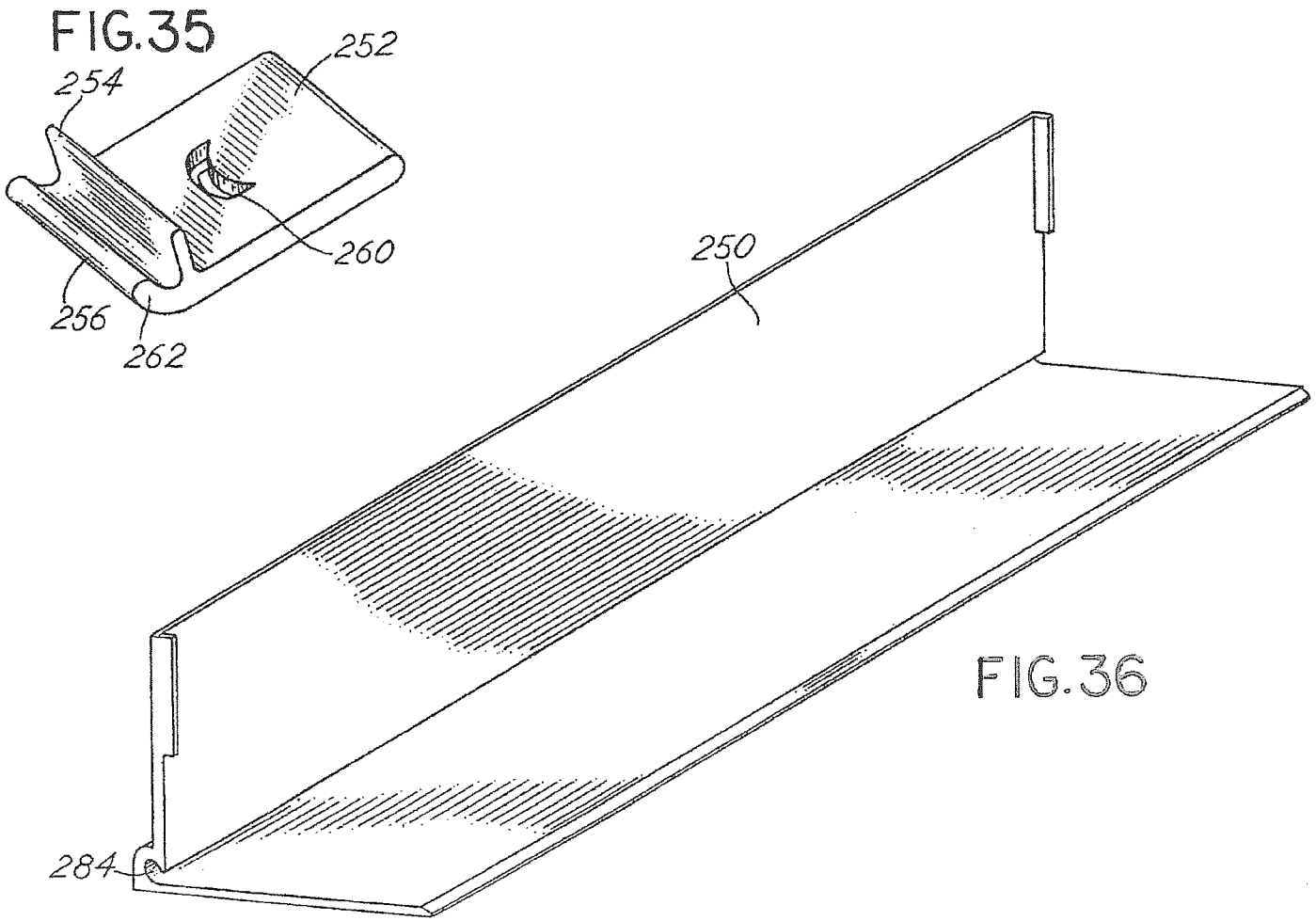
FIG. 35 depicts an isometric view of an exemplary embodiment of an adapter.
FIG. 36 depicts an isometric view of an exemplary embodiment of a retainer.

As depicted in FIG. 35, the adapter 252 has a wall 254 proximate a first end 256. The first end 256 has a curved portion 262, which curves upwardly. The middle portion of the adapter 252 may be provided with a curved slot 260, which is adapted to receive a correspondingly shaped spring end (not shown).

The coiled spring 30 at one end can be secured to the middle portion of the adapter 252. In an exemplary embodiment, the curved slot 260 corresponds in shape and size of the first spring end. Additionally, the first spring end of the coiled spring 30 can be crimped or bent to provide for additional fastening. Nevertheless, any sufficient fastening method can be used to fix the first spring end of the coiled spring 30 to the adapter 252.

Figure 37:
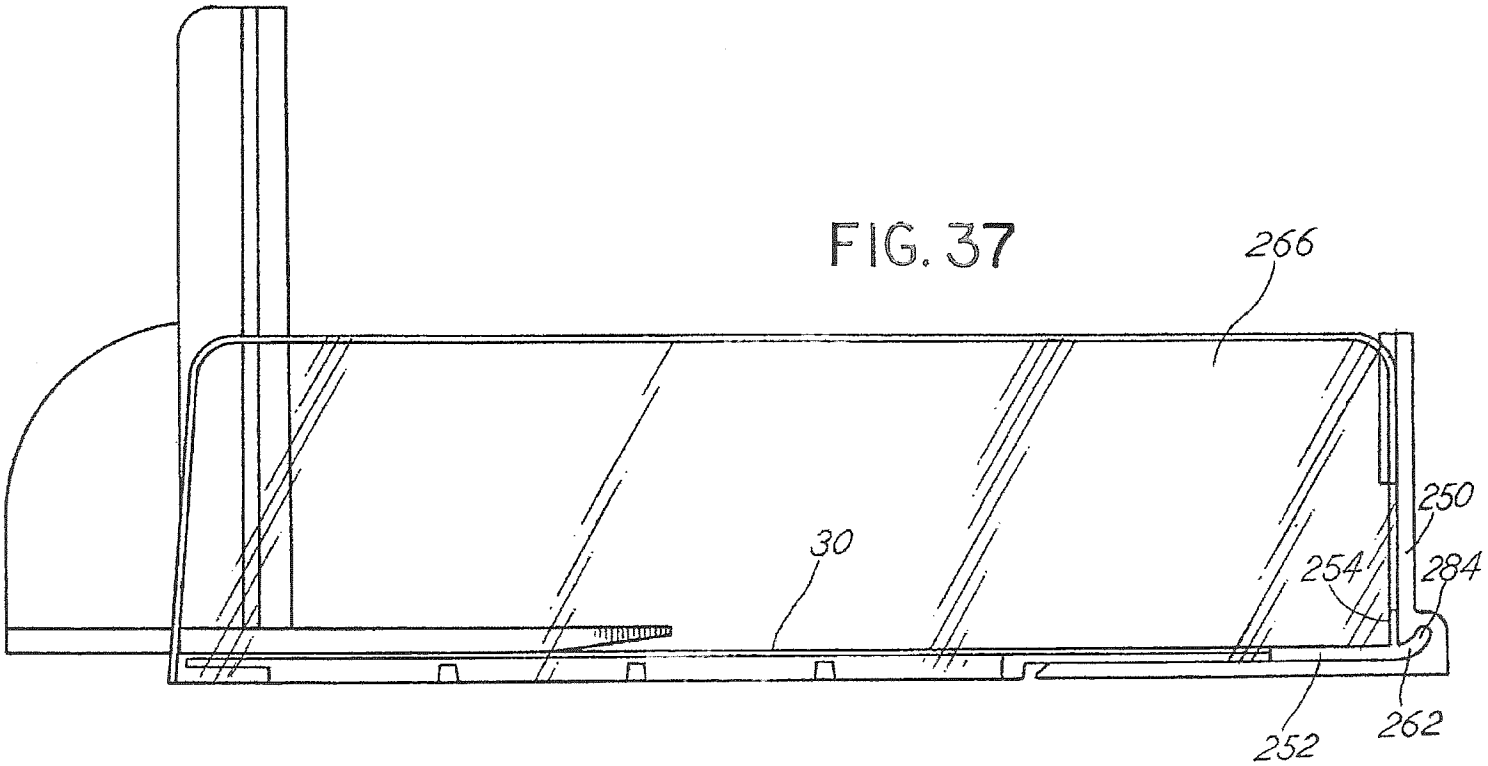
FIG. 37 depicts a side view of an exemplary embodiment of the display system.
Figure 38:
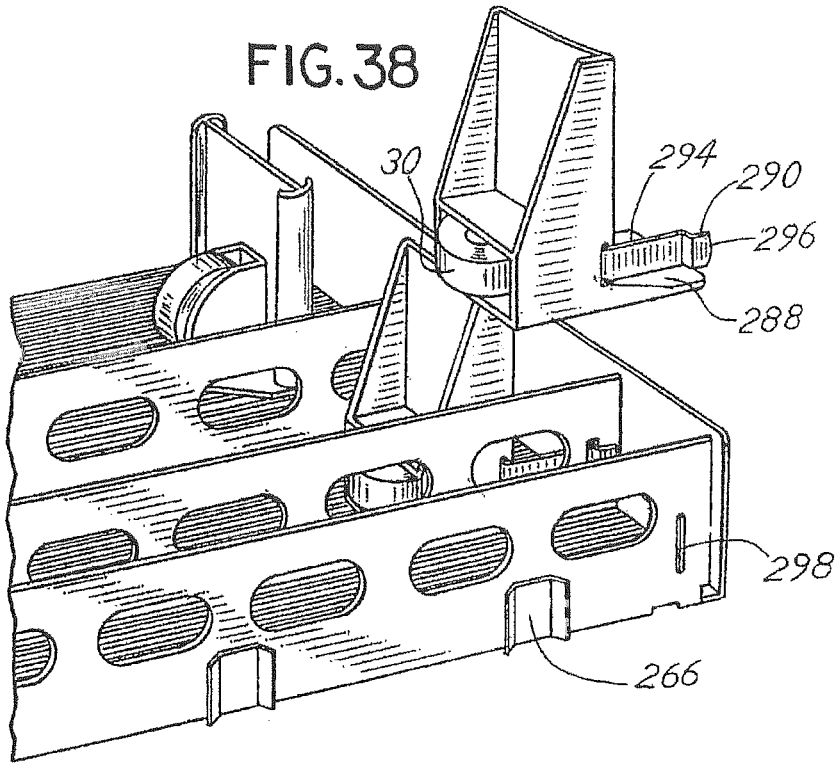
FIG. 38 depicts an isometric view of an exemplary embodiment of the display system.
Figure 39:
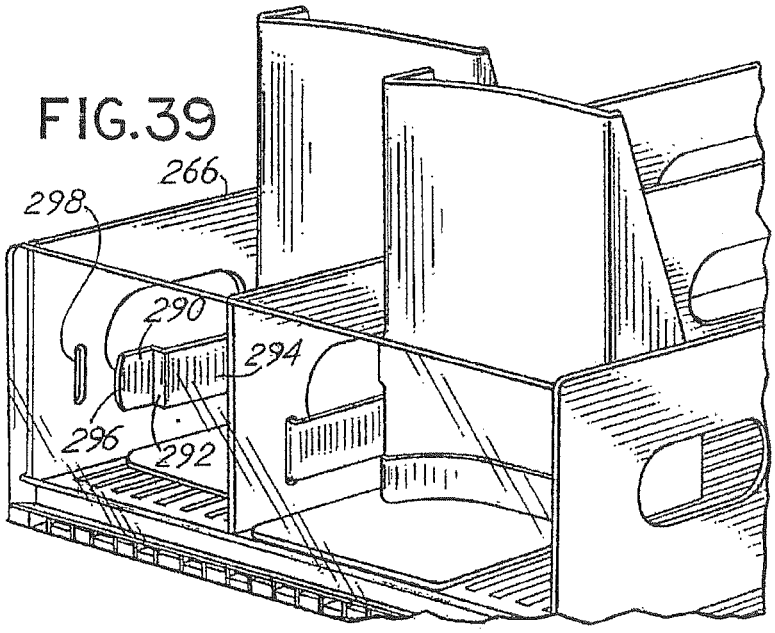
FIG. 39 depicts an isometric view of an exemplary embodiment of the display system.

In an exemplary embodiment, shown in FIGS. 36 and 37, the retainer 250 has a curved slot 284 corresponding in shape and size to the curved portion 262 of the adapter 252. The curved slot 284 extends the length of the retainer to allow for unlimited positioning of the adapter 252 along the length of the retainer 250.

To secure the first spring end of the coiled spring 30 to the retainer 250, the curved portion 262 of the adapter 252 is placed into the curved slot 284 of the retainer 250. The curved slot 284 secures the adapter 252 and the first spring end of the coiled spring 30 to the retainer 250 and provides for a quick and easy assembly of the display system. The wall 254 provides additional stability in the connection between the retainer 250 and the adapter 252. Other methods, however, can be used to secure the adapter 252 and/or the first spring end of the coiled spring 30 to the retainer 250.

Alternatively, as depicted in FIGS. 33 and 44 the coiled spring 30 of the pusher paddle 287 can be mounted directly to the front of the tray 306. The first spring end 290 of the coiled spring 30 is provided with a curved portion. The curved portion curves downwardly from the pusher floor 288 and is adapted to be received in a recess 316 (shown in FIG. 33) defined by a lip 318 of the front surface of the dispensing tray 306 and the retainer 250. A vertically oriented surface of the retainer 250 and the lip 318 are spaced such that a gap is formed between the vertically oriented surface and a front edge of the lip 250. To secure the coiled spring 30 and the pusher mechanism 286 to the assembly, the first spring end 290 is inserted into the gap formed between the vertically oriented surface of the retainer 250 and the front edge of the lip 318 and placed into the recess 316 formed by the lip 318 of the dispensing tray 306 and the retainer 250.

In another exemplary embodiment depicted in FIGS. 38, 39, 48 and 49, the coiled spring 30 can be directly mounted to a divider 266. In addition, in this exemplary embodiment the coiled spring 30 can be mounted perpendicular to the pusher floor 288 such that the axis, about which the coiled spring 30 is coiled, is perpendicular to the pusher floor 288. This orientation has the benefit of preventing the pusher paddle from tipping back. The first spring end 290 can be provided with an angled portion 292 and a tip portion 296. In one exemplary embodiment, the angled portion 292 can be bent perpendicular to the coiled spring body 294. The divider can be provided with a slot 298, which is adapted to receive the tip portion 296 of the first spring end 290.

To secure the coiled spring to the divider, the tip portion 296 is inserted into the slot 298. Once the tip portion 296 is fully inserted into the slot 298, the angled portion 292 engages the slot 298 so as to secure the first spring end 290 to the divider 266.

As depicted in FIG. 33, various pusher mechanism designs can be implemented. The pusher paddle 287 can be formed flat to accommodate correspondingly shaped product. Alternatively, the pusher paddle 286 can have a curved first end and a flat second end. This serves to accommodate a variety of cylindrical products having a variety of different sized diameters and to facilitate the operation of the pusher mechanism 286. During operation, the product in the pusher mechanism 286 and the curved first end together force the pusher mechanism against the divider 266, such that the coil spring 30 remains flat against the divider 266 holding the first spring end 290, while in tension or in operation. This allows for a smoother operation of the pusher mechanism and ensures that the product is properly dispensed as users remove the product from the system.

Figure 40:
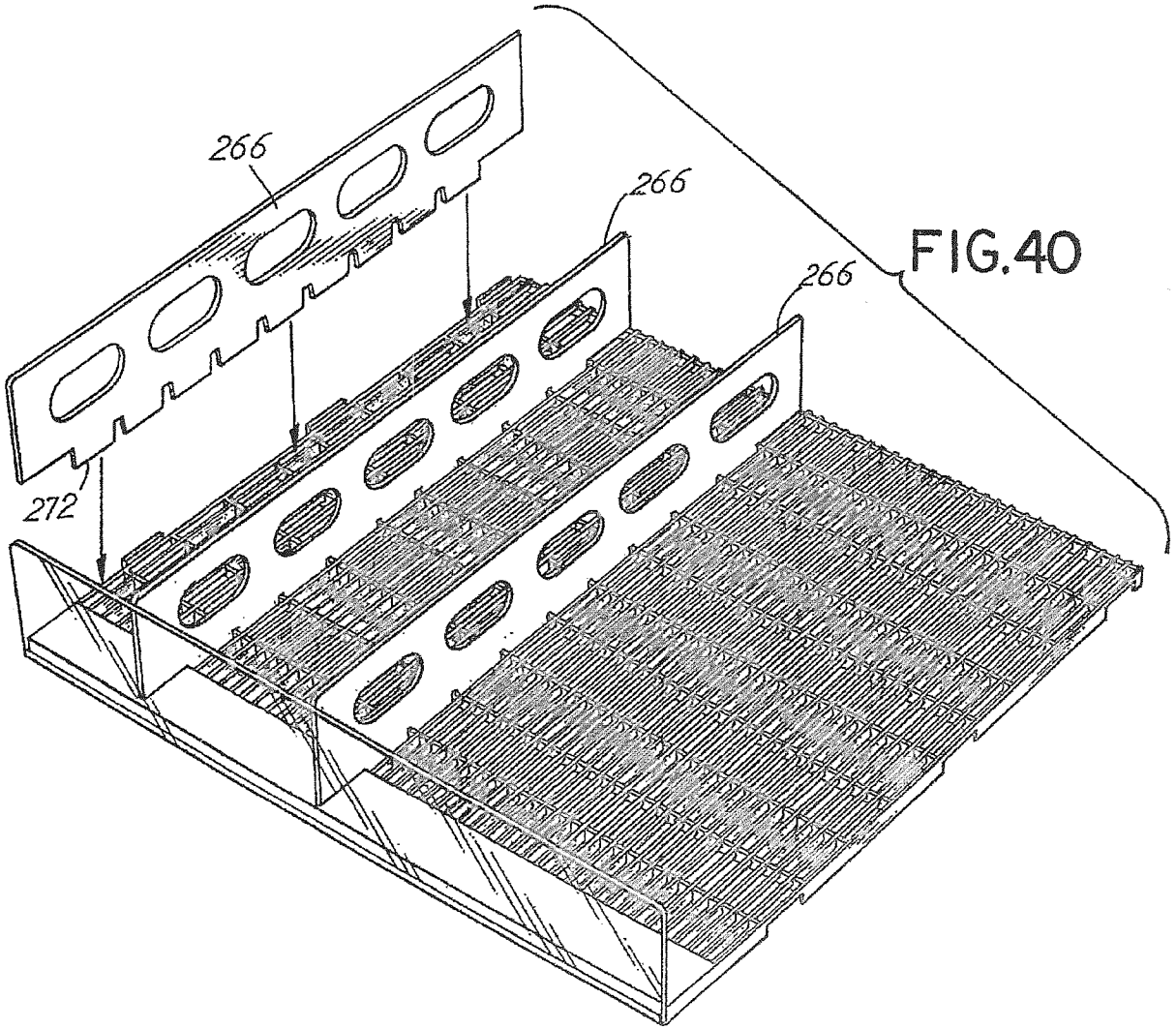
FIG. 40 depicts an isometric view of an exemplary embodiment of the display system.
Figure 41A:
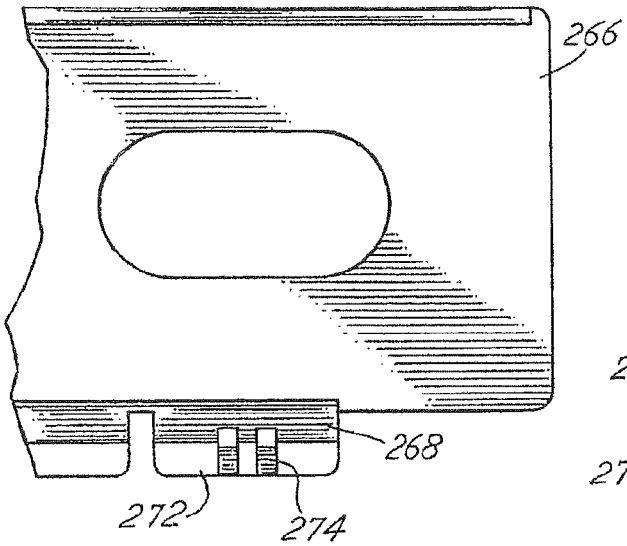
FIG. 41A depicts a sectional side view of an exemplary embodiment of a divider.
Figure 41D:
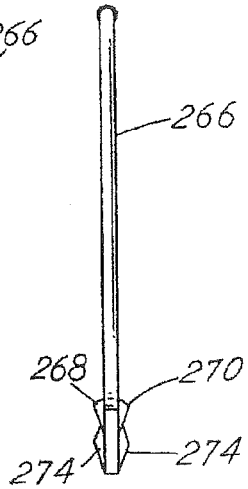
FIG. 41D depicts a front view of an exemplary embodiment of a divider.

In another exemplary embodiment depicted in FIGS. 40-41D, the distance between the dividers 266 can be adjusted to accommodate different sized containers. The dividers 266 can be provided with connecting portions 272. The connecting portions 272 can be provided with a first elongated angled surface 268 and a second elongated angled surface 270. Additionally, the connecting portions 272 can be provided with a plurality of projections 274. As depicted in FIG. 41B, the rails can be formed of teeth 278 having face surfaces 280 and flank surfaces 282.

Figure 41C:
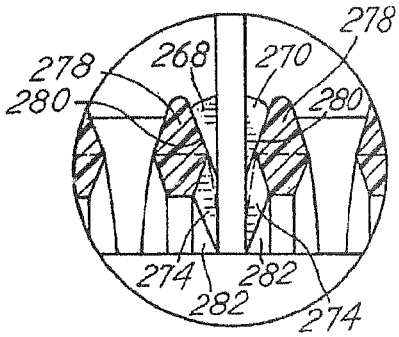
FIG. 41C depicts a close up view of a section of FIG. 41B.
Figure 41B:
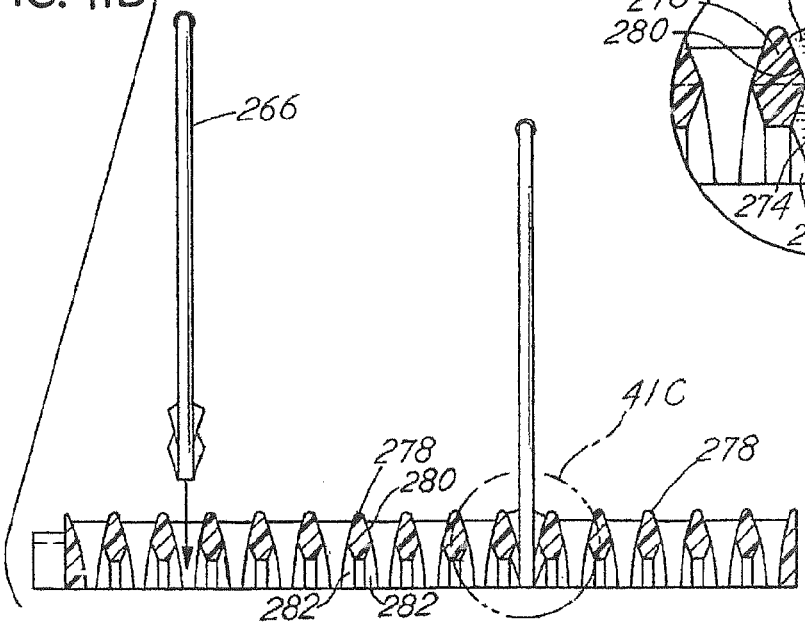
FIG. 41B depicts a front view of an exemplary embodiment of the display system.

When assembled, as depicted in FIG. 41C, the connecting portions 272 are received between the teeth 278 of the rails. Additionally, the elongated angled surfaces 268 and 270 and the projections 274 are wedged between the teeth 278. Also as shown in FIG. 41C, the elongated angled surfaces 268 and 270 engage the face surfaces 280, and the projections 274 engage the lower surfaces of the teeth 278. Flank surfaces 282 contact the connecting portion 272.

Figure 42:
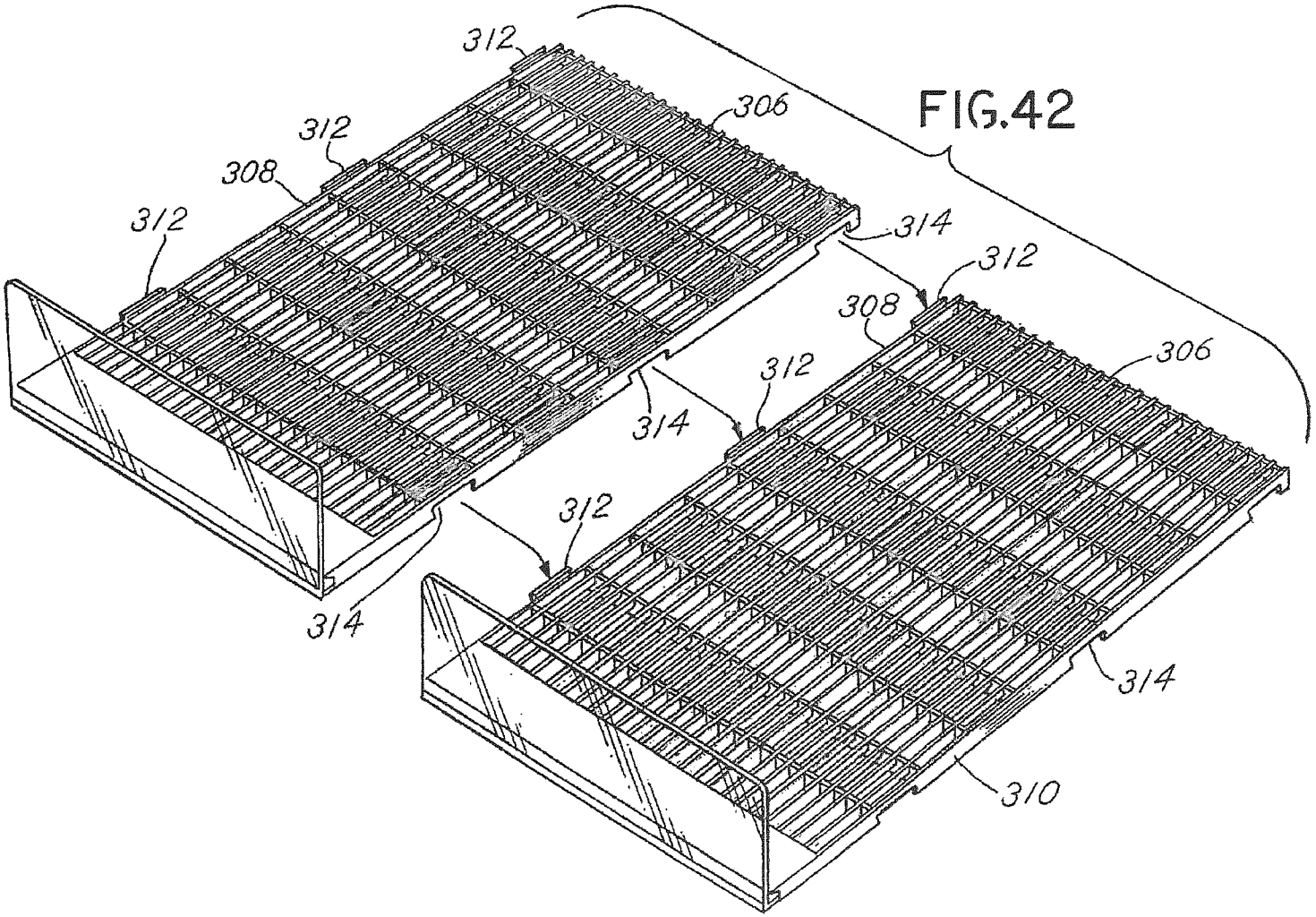
FIG. 42 depicts an isometric view of an exemplary embodiment of the display system.

In an exemplary embodiment depicted in FIG. 42, the trays 306 are provided with dovetail connections. A first side 308 of the trays 306 is provided with tongues 312 adapted to fit within grooves 314 located on a second side 310 of the trays 306. To connect the trays, the grooves 314 are aligned with tongues 312 such that the tongues 312 are firmly secured within the grooves 314.

Figure 43:
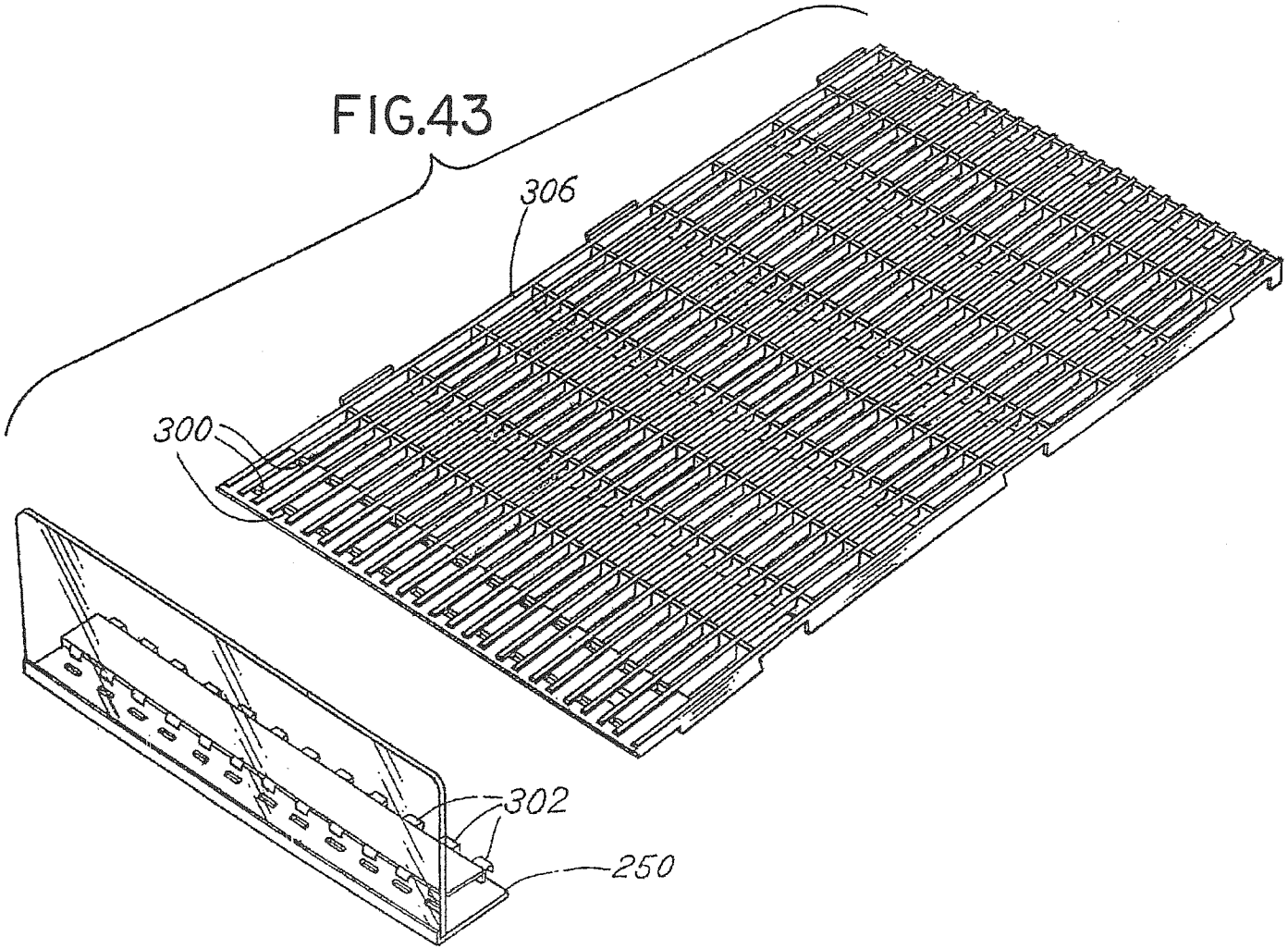
FIG. 43 depicts an isometric view of an exemplary embodiment of the display system.

In an exemplary embodiment depicted in FIG. 43, the trays 306 are configured to receive the retainer 250 at a front end. The retainer can be provided with rectangular holes 300, and the retainer is provided with correspondingly shaped and sized projections 302. To secure the retainer 250 to the tray 306, the projections 302 fit into holes 300 to lock the retainer into place on the tray 306.

Figure 45:
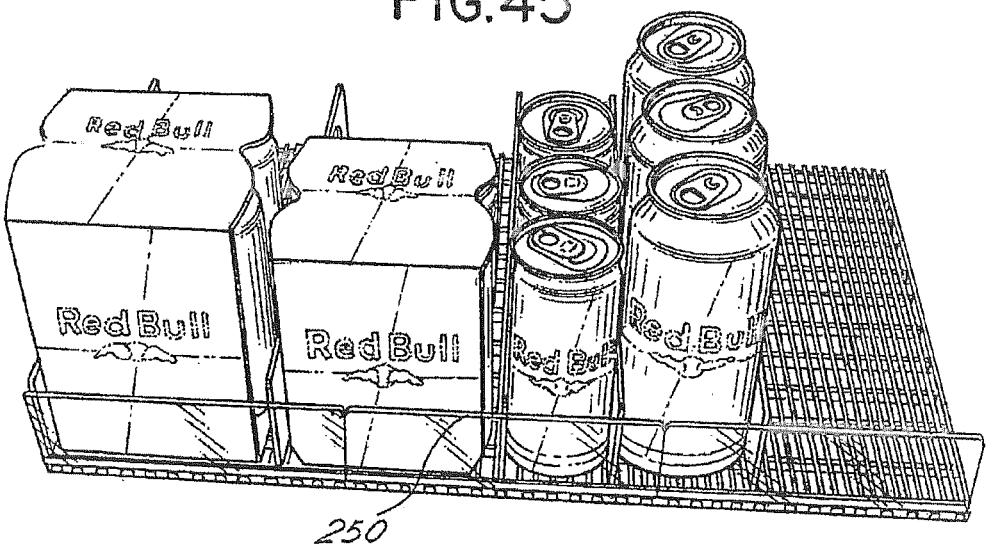
FIG. 45 depicts another isometric view of an exemplary embodiment of a product management display system with product in the system.
Figure 46:
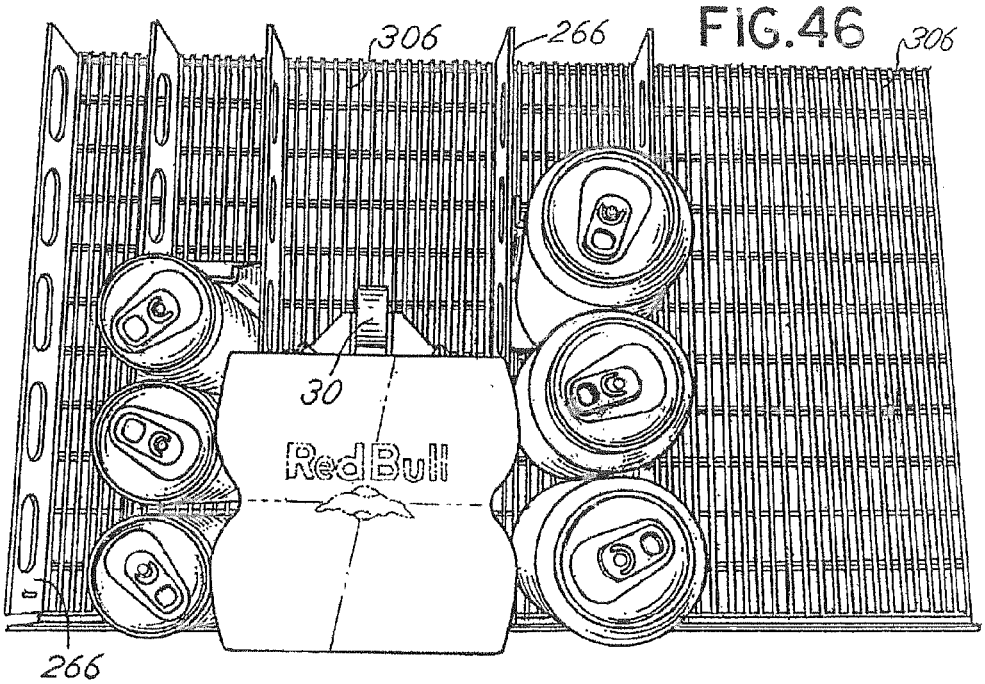
FIG. 46 depicts a top view of another exemplary embodiment of a product management display system with product in the system.
Figure 47:
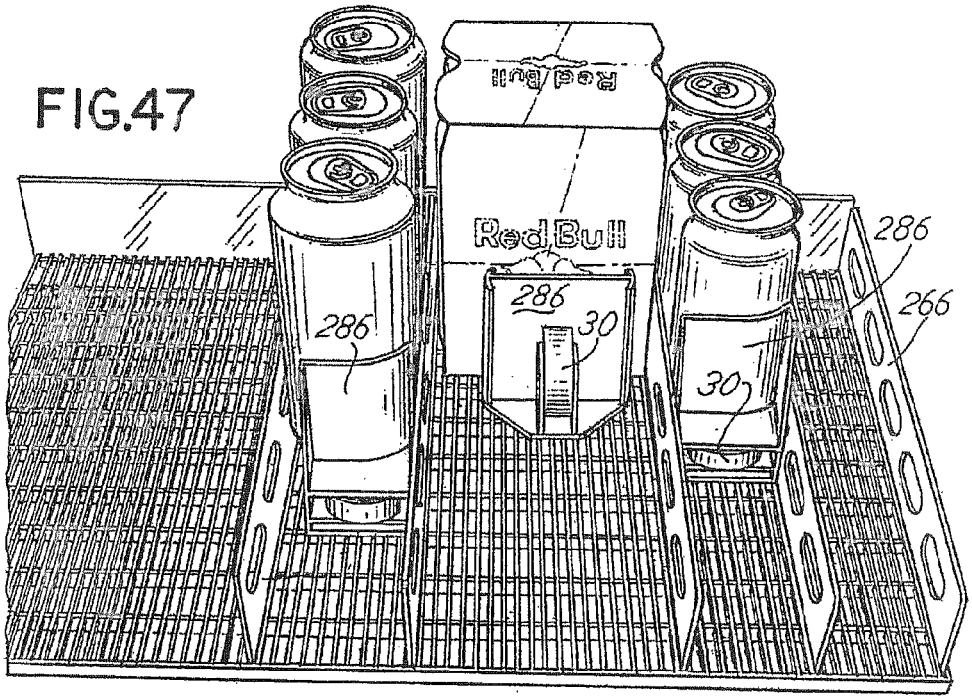
FIG. 47 depicts an isometric-rear view of an exemplary embodiment of a product management display system with product in the system.

As depicted in FIGS. 45-47, after the product management display system is assembled, product is loaded into the system. By adjusting the dividers 266 a wide variety of product sizes and shapes can be loaded into the system. As shown in FIGS. 46 and 47, the coil spring 30 in conjunction with the pusher paddle 287 push the product toward the retainer 250. As a user takes product out of the system, the pusher paddle 287 pushes the remaining product such that the product slides along the floor 264 to the retainer 250. This assures that all product remains at the front of the display system.

Figure 50:
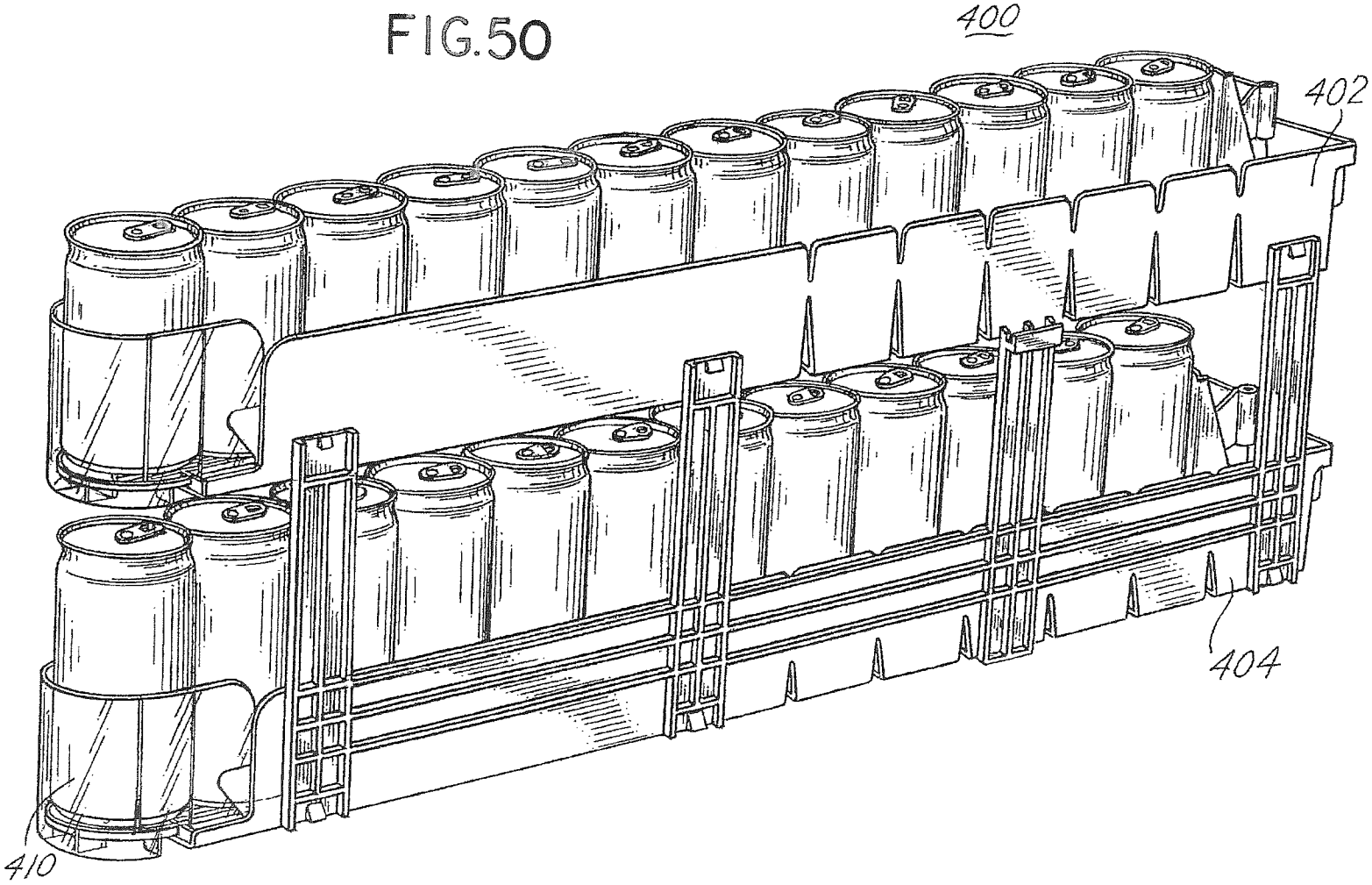
FIG. 50 depicts an isometric view of yet another exemplary embodiment of the product management display system.
Figure 51:
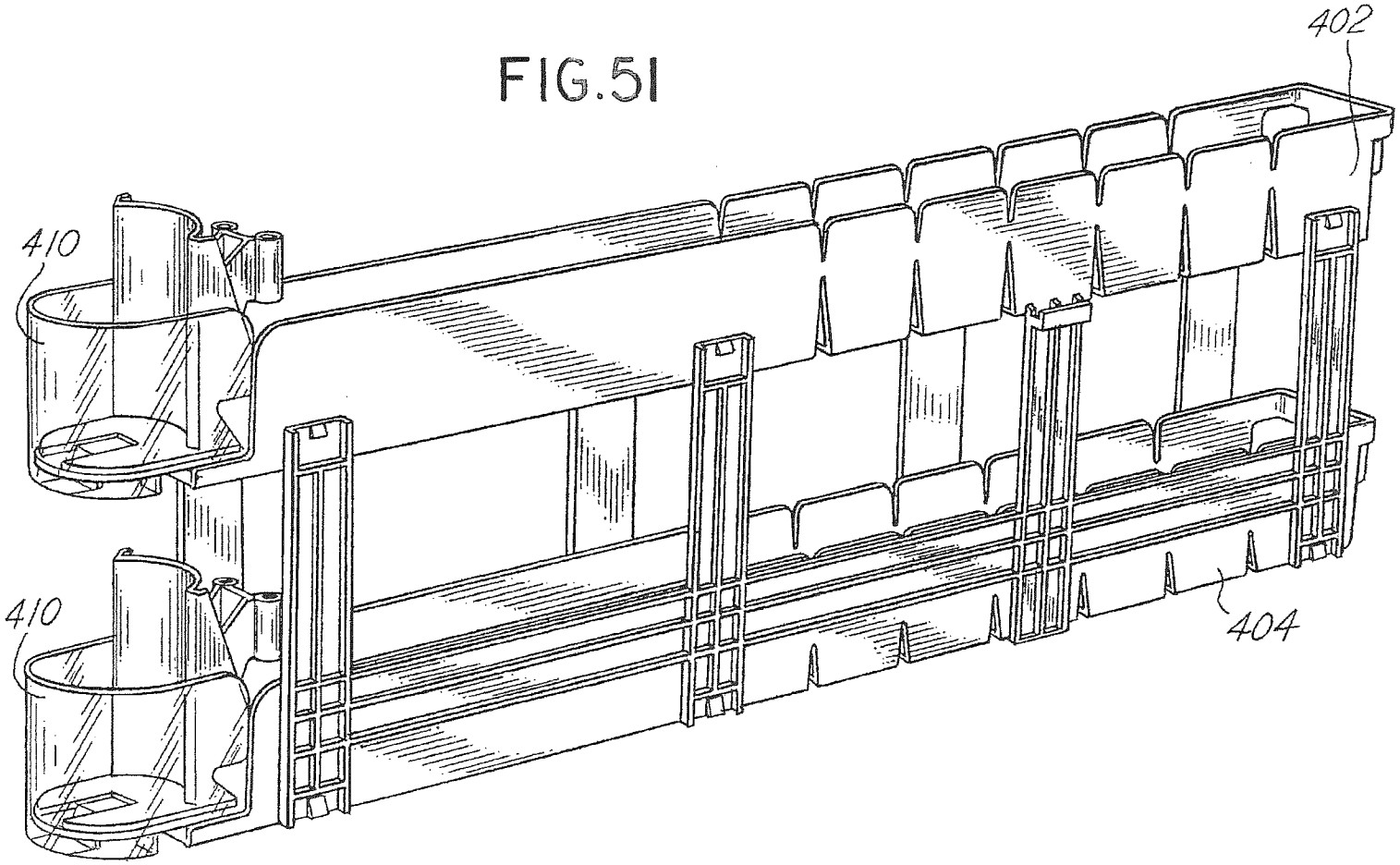
FIG. 51 depicts another isometric view of the exemplary embodiment of the product management display system of FIG. 50 without product.
Figure 52:
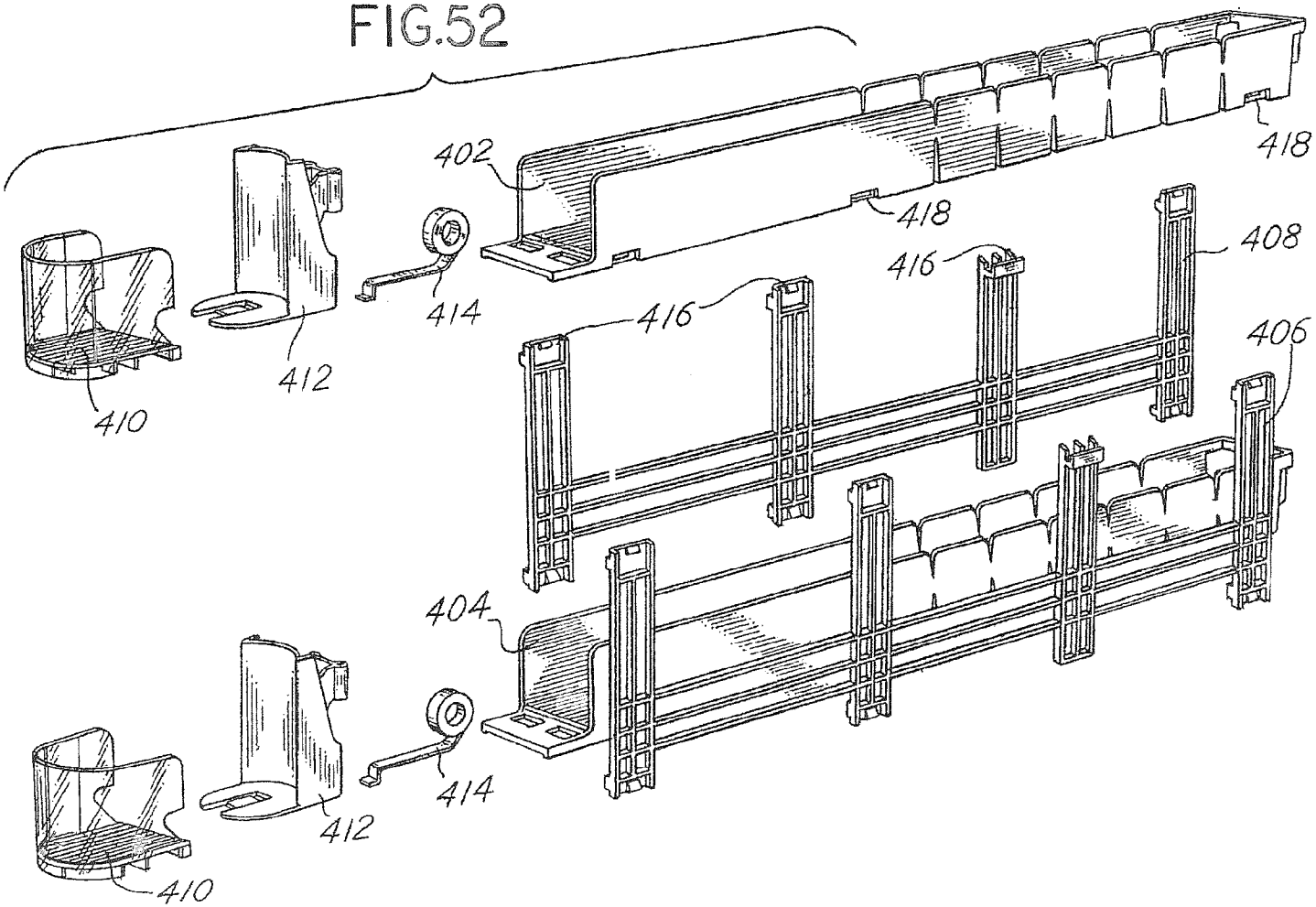
FIG. 52 depicts an exploded isometric view of the exemplary embodiment of the product management display system of FIG. 50.
Figure 53:
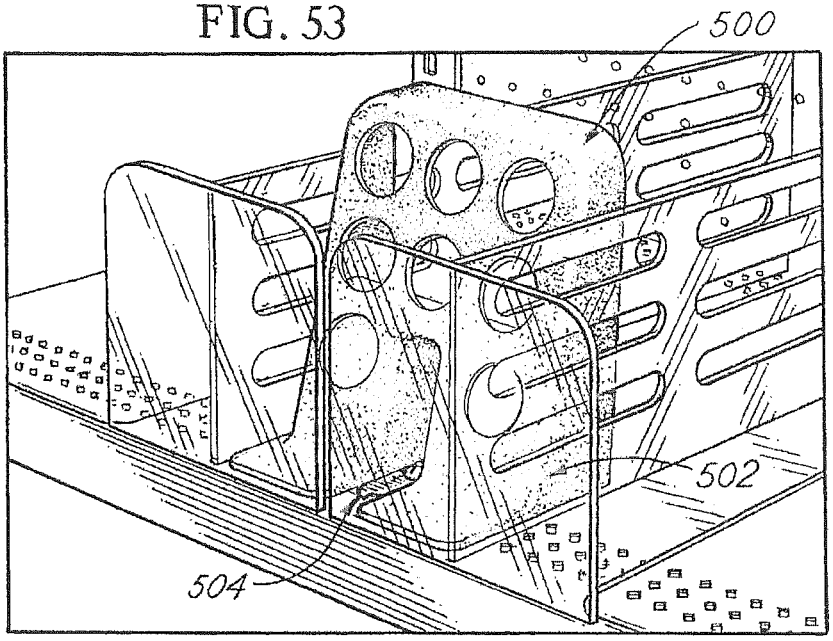
FIG. 53 depicts an isometric view of yet another exemplary embodiment of the product management display system.

As depicted in FIGS. 50-52, the product management display system 400 can be arranged such that trays 402, 404 can be stacked on top of one another. This embodiment can consist generally of a first tray 402, a second tray 404, a first spacer 406, and a second spacer 408.

The trays 402, 404 are each arranged to house product to be dispensed. The first tray 402 and the second tray 404 can be each provided with a clear retainer 410, a pusher mechanism 412, first and second guiding walls, and a coil spring 414.

The pusher mechanism 414 is arranged in a similar fashion as the embodiments discussed above, such that it slides product along the surface of the trays 402, 404, while product is removed. Additionally, any of the alternative arrangements of the pusher mechanism discussed above may be implemented in a stackable tray arrangement.

To provide for an easy assembly and disassembly, the stackable product management display system can be provided with a dovetail connection or any other suitable connection, such as a snap-fit connection, screw-thread connection, or a rivet connection. The first and second trays are provided with detents 416 for assembling the first and second spacers 406, 408 to the first and second trays 402, 404. Each of the first and second trays 402, 404 can be provided with sockets 418 on their respective outside surfaces for receiving the correspondingly shaped detents 416 located on the first and second spacers 406, 408.

To assemble the stackable product management display system, the detents 416 located on the first and second spacers 406, 408 are placed into the correspondingly shaped sockets 418 on the outside surfaces of the first and second trays 402, 404 in a locking arrangement. This provides for a stackable arrangement that can be implemented in conjunction with any of the embodiments discussed above.

In another exemplary embodiment depicted in FIGS. 53-57, a pusher paddle 500 may be mounted directly to a shelf 508 and held to the shelf by the end of the coiled spring 504. The pusher paddle 500 will slide along and on top of the surface of the shelf. One or more dividers 502 that define a T-shaped configuration may be positioned next to the pusher paddle 500. In an alternative aspect, the base of the divider 502 may be positioned on the shelf such that the base is located underneath the pusher paddle 500. With this configuration, the pusher paddle 500 may slide along the base of the divider. If the dividers 502 are positioned sufficiently far away from the paddle 500, the paddle 500 will slide directly on the surface of the shelf 508. The dividers 502 may define numerous configurations including those described herein and may be secured to the shelf using any known technique, including push pins, rivets, fasteners, adhesives and the like.

In one aspect, the end 510 of the coiled spring 504 is positioned within a hole or aperture 506 located on the shelf 508. The end 510 may define a spring tip that may further define any suitable configuration that permits the spring end to pass into the hole 506 and remain secured to the hole. For example, the spring tip of end 510 may define a hook-shaped configuration that permits the end 510 to wrap around the edges of the hole 506. Alternatively, the spring tip may define one or more catches that hook onto the edges of the hole 506. Still other spring tip configurations are possible.

Figure 54:
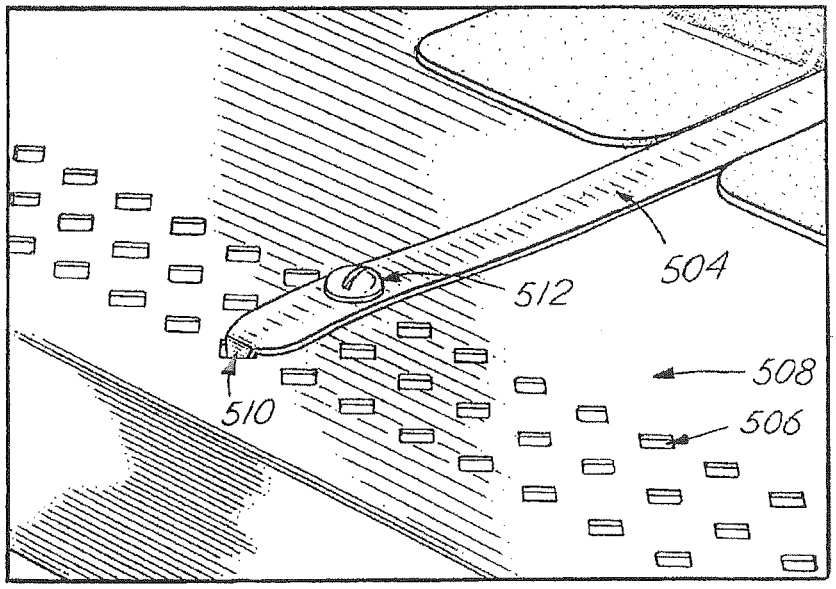
FIG. 54 depicts an isometric view of an exemplary attachment of the pusher spring to a shelf of the product management display system of FIG. 53.

As shown in FIG. 54, to further secure the spring 504 to the shelf 508, a fastener 512, pin, rivet or the like may be used. This fastener 512 will provide a second spaced-apart anchoring point for the spring that will hold the spring in the desired alignment during the full operation of the spring 504 as the paddle 500 moves back and forth on the shelf 508. It will be appreciated that depending on the shelf type and the number and spacing of existing holes on the shelf, even more anchoring points are possible.

Figure 55:
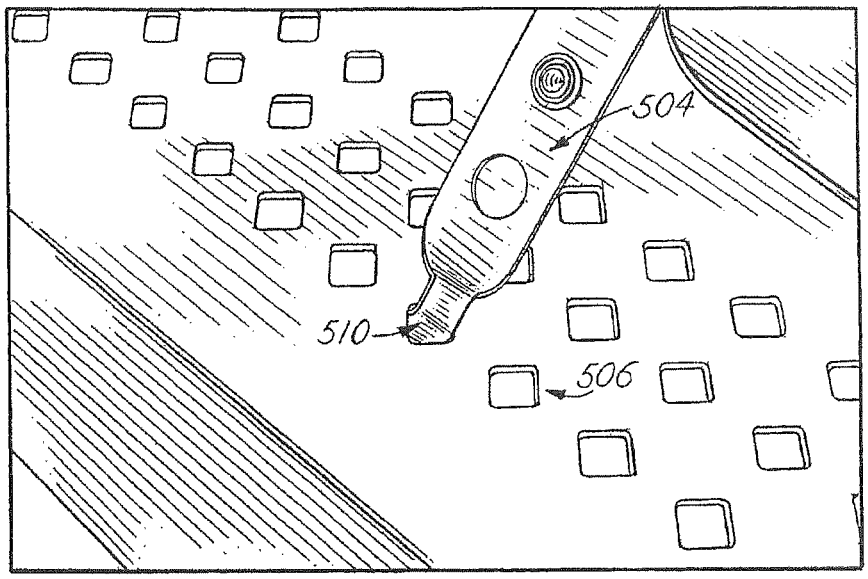
FIG. 55 depicts an isometric view of an exemplary attachment of the pusher spring to a shelf of the product management display system of FIG. 53.
Figure 56:
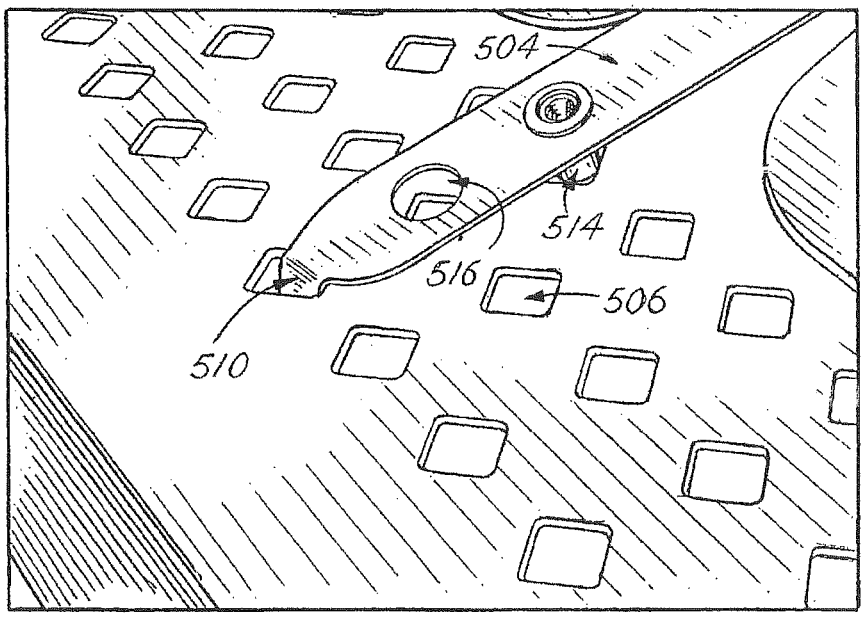
FIG. 56 depicts an isometric view of an exemplary attachment of the pusher spring to a shelf of the product management display system of FIG. 53.
Figure 57:
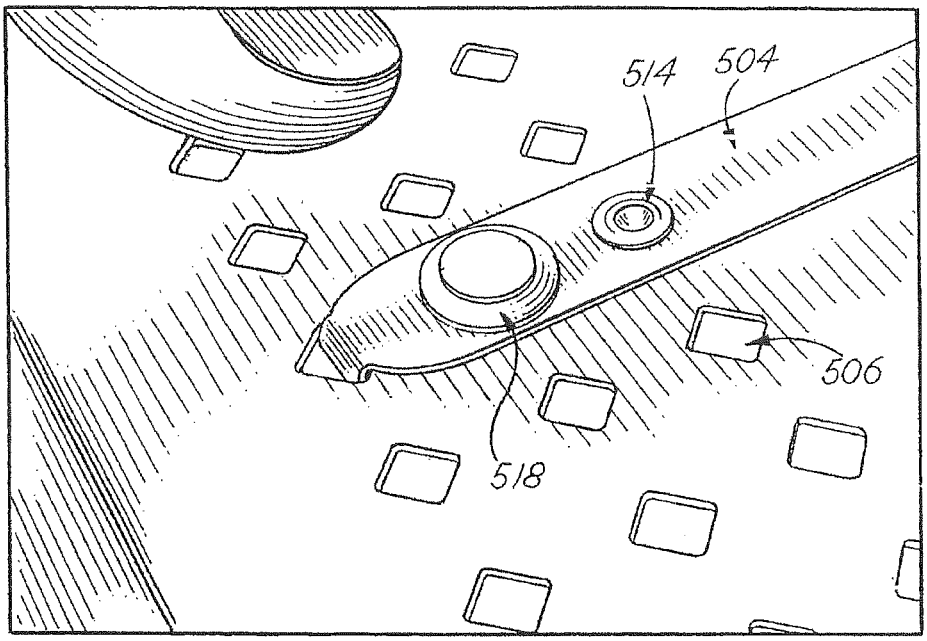
FIG. 57 depicts an isometric view of an exemplary attachment of the pusher spring to a shelf of the product management display system of FIG. 53.

Referring to FIGS. 55-57, there is depicted an exemplary mounting technique for mounting the spring 504 of the paddle 500 onto a shelf. As shown in FIG. 55, the end 510 of the spring 504 is inserted into the hole 506 on the shelf. The end 510 may define a spring tip as described herein to hold the end 510 to the edges of the hole 506. As shown in FIG. 56, the spring 504, which in this embodiment includes a rivet or stud 514, is lowered onto the shelf such that the rivet or stud 514 fits within another hole 506 located on the shelf. This rivet or stud provides another anchoring point for the spring. As shown in FIGS. 56 and 57, the spring 504 may define an aperture 516 for receiving yet another rivet or stud 518 to even further secure the spring 504 to the shelf. With these multiple anchoring points, the spring 504 will be secured to the shelf, and thus the paddle will be secured to the shelf. Also, with these multiple anchoring points, the spring will retain the desired alignment during the full operation of the spring as the paddle moves back and forth on the shelf. It should be understood that other anchoring techniques are possible to secure the end of the spring 504 to the shelf, including any of the technique described herein, or any combination of the techniques described herein. It should be appreciated that if a shelf does not have pre-existing holes that could be used to anchor the spring 504, one or more holes could be drilled into the shelf at the desired locations.

With the embodiment depicted in FIG. 53-57, it can be appreciated that a trackless pusher paddle may be retrofitted directly onto existing store shelves with very minimal effort or extra mounting pieces. Additionally, this embodiment is easily removable to permit the repositioning of the pusher paddle at any location on the shelf to accommodate any size and type of product being merchandised on the shelf. One of skill in the art will also appreciate that any of the pusher paddles described herein may be mounted directly to the shelf using the techniques described herein, or by using any combination of the techniques described herein.

Figure 58:
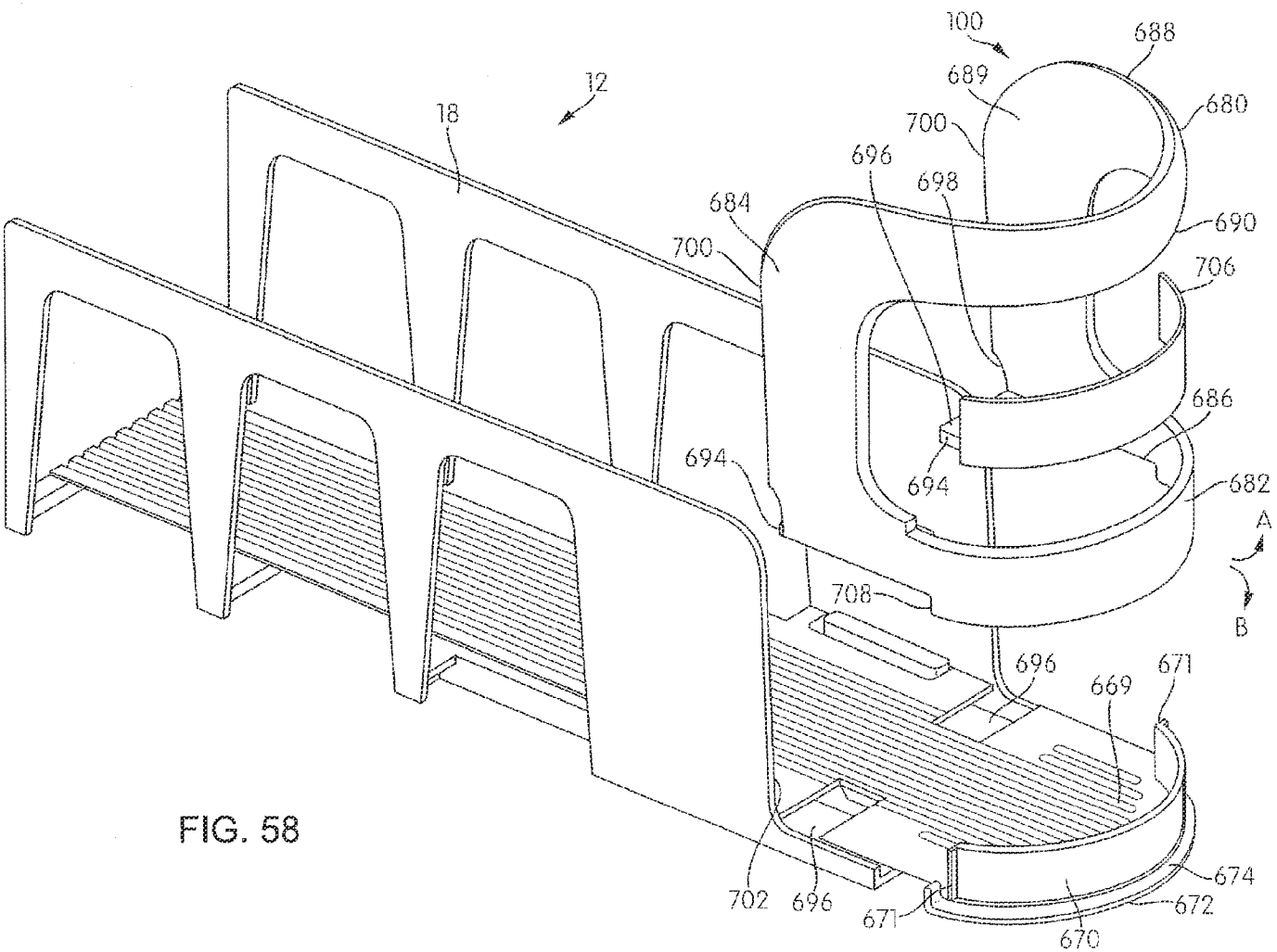
FIG. 58 depicts an isometric view of an exemplary embodiment of a product management display system and aspects thereof.
Figure 59:
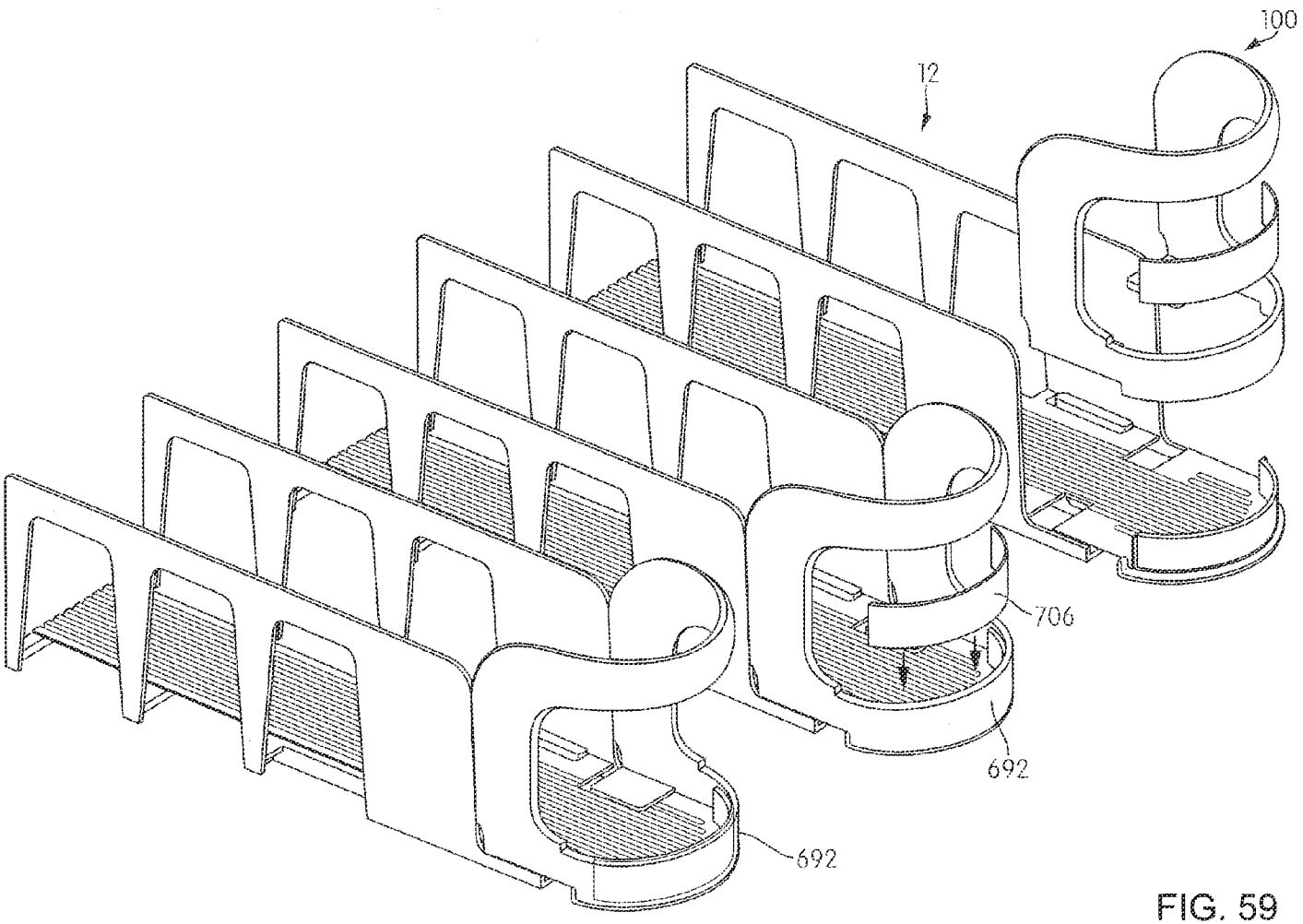
FIG. 59 depicts isometric views of embodiments of the product management display system of FIG. 58.
Figure 60:
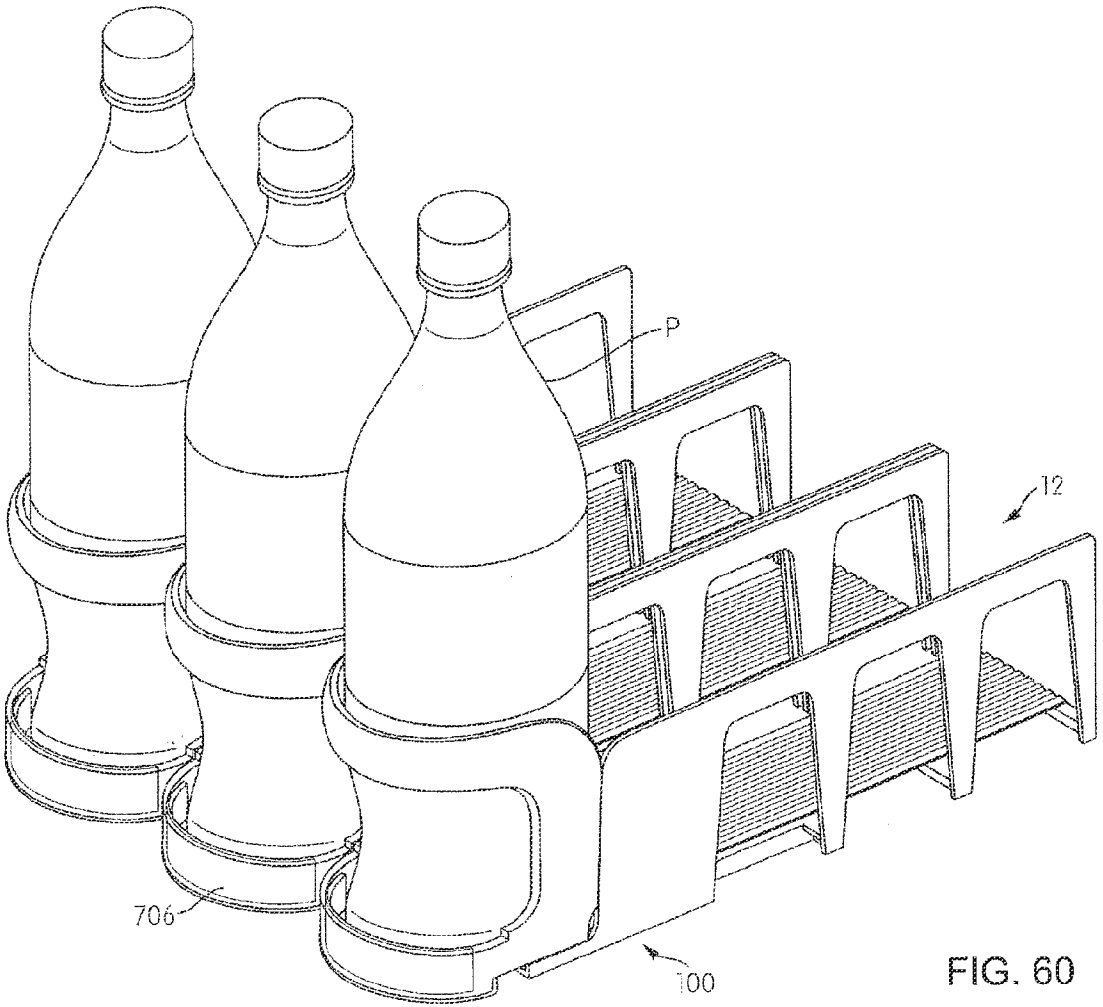
FIG. 60 depicts an isometric view of an embodiment of the product management display system of FIG. 58.

In another embodiment, depicted in FIGS. 58-60, a tray 12 includes a front rounded portion 669. As illustrated in FIG. 58, the tray 12 also includes a forward lip 670 that is located adjacent the front of the front rounded portion 669. The forward lip 670 can be rounded and can extend perpendicularly in an upward direction from the tray 12. The forward lip can have different heights and in an embodiment has a height of 0.5 inches from the tray 12. The forward lip includes a raised edge or wall portion 671 at each lateral end of the forward lip. The wall portions serve to close off the side portions of the caption pocket that is described later.

The tray also can include a shelf 672 that is located immediately adjacent and in a frontward direction of the forward lip 670. The shelf 672 can be curved and can match the curvature of the forward lip 670. The shelf 672 includes a horizontal surface 674. The shelf 672 also includes protrusions 676 that are perpendicular to the horizontal surface 674 of the shelf 672. The shelf 672 and the forward lip 670 add strength to the front portion of the pusher tray. In addition, the horizontal surface 674 of the shelf 672 serves to close off the bottom portion of the caption pocket that is described later.

In an embodiment, a front wall 100 includes a top wall 680 and a bottom wall 682. The top wall and the bottom wall are connected by two side legs 684. The top wall 680 and the bottom wall 682 are curved. An aperture 686 is defined by the top wall 680, bottom wall 682 and side legs 684. This aperture can be sized such that a product P will not fit through the aperture. The top wall also can contain a contour from the top 688 of the top wall to the bottom 690 of the top wall. This contour assists in limiting or preventing scratches to the top wall. The contour also increases the strength of the top wall. The bottom wall includes a side wall 708 that in operation is adjacent to and may be in contact with protrusion 676. The side legs include notches 698 at the bottom portion of the side legs 684. The notches assist in allowing the hooks 694 to be inserted into apertures 696. The front wall can be constructed of clear material which will not obstruct the view of product P being merchandised in trays 12.

A graphic pocket 692 is defined by (a) the bottom wall 682 of the front wall 100, (b) the curved portion of lip 670, (c) wall portions 671 at the lateral ends of lip 670 and (d) the horizontal surface 674 of shelf 672. This graphic pocket is sized to contain a graphic strip or other advertising. Once the graphic strip is placed in the pocket 692, it is protected from all sides other than the top.

The front wall further comprises two hooks 694. These hooks are configured to fit within with apertures 696 of tray 12. In an embodiment, to fit the hooks 694 within the apertures 696 the front wall first is rotated in the direction of the arrow "A" as depicted in FIG. 101 with the hooks 694 not in engagement with the apertures 696. The hooks 694 are then initially inserted into the apertures 696 while the hooks 694 are at an angle to the apertures. The front wall is then rotated in the direction of the arrow "B" until the front wall comes to the position shown in FIG. 102-B. In this position, upper portions 696 of the hooks 694 are parallel to the underside of the surface 16 of tray shelf 12 and the hooks 694 are fully inserted through the apertures 696. The hooks 694 are thereby mounted to the tray 12. In an embodiment, the rear edge 700 of side legs 684 is adjacent to the front edge 702 of the divider 18. The rear edge 700 of side legs 684 may be in contact with the front edge 702 of divider 18.

FIGS. 59A-C disclose different mounting states of the front wall 100 and a graphic caption 706. FIG. 59A discloses the front wall 100 not mounted with the tray 12. Instead, front wall 100 is shown elevated above tray 12. Graphic caption 706 also is shown in an unmounted state. FIG. 59B discloses front wall 100 mounted with tray 12. In FIG. 59B graphic caption 706 is unmounted. The downward arrows in FIG. 59B show the direction graphic caption 706 will move in to mount with the graphic pocket 692. FIG. 59C discloses the graphic caption 706 mounted in graphic pocket 692. When several trays 12 are connected to each other, the graphics caption 706 can form a continuous or near-continuous strip of graphics advertising. Trays 12 can be formed individually and connected together, such as through dovetail connections. In an embodiment, multiple trays can be formed as a unit to create a single unit for merchandising numerous rows of products.

FIG. 60 discloses several front walls 100 mounted with several trays 12. The near-continuous nature of the graphics advertising from the graphics caption 706 is seen in FIG. 60. In addition, FIG. 60 discloses product P being maintained on trays 12 and constrained by front walls 100.

Variations and modifications of the foregoing are within the scope of the present invention. For example, one of skill in the art will understand that multiples of the described components may be used in stores and in various configurations. The present invention is therefore not to be limited to a single system, nor the upright pusher configuration, depicted in the Figures, as the system is simply illustrative of the features, teachings and principles of the invention. It should further be understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention.

What is claimed is:

1. A product management display system comprising:

a tray having a front rounded portion and a surface defining a plurality of apertures;

a lip extending upward from the front rounded portion of the tray;

a front shelf extending forward from the lip;

a front wall having a top wall portion, a bottom wall portion, and two side leg portions, wherein the front wall portion, bottom wall portion, and two side leg portions form a wall aperture, wherein the front wall includes a plurality of projections configured to engage with the plurality of apertures on the surface of the tray; and a pusher mechanism configured to slide across at least a portion of the surface of the tray, the pusher mechanism mounted to and held onto the tray by a coiled spring.

2. The product management display system of claim 1, further comprising:

two wall portions, each of the two wall portions extending from an opposite end of the lip, wherein a graphic pocket is formed by the bottom wall portion, the lip, and the two wall portions.

3. The product management display system of claim 2, wherein the graphic pocket houses a graphic strip.

4. The product management display system of claim 1, wherein the front wall is curved.

5. The product management display system of claim 1, wherein the front wall portion and the bottom wall portion prevent a product placed on the surface of the tray from fitting through the wall aperture.

6. The product management display system of claim 1, wherein the front wall is removable from the tray.

7. A product management display system comprising:

a tray having a front rounded portion and a surface defining a plurality of apertures;

a lip extending upward from the front rounded portion of the tray;

a front shelf extending forward from the lip;

a front wall having a top wall portion, a bottom wall portion, and two side leg portions, wherein the front wall portion, bottom wall portion, and two side leg portions form a wall aperture, wherein the front wall includes a plurality of projections configured to engage with the plurality of apertures on the surface of the tray; and a plurality of dividers attached to the tray, the plurality of dividers configured to separate product into one or more rows;

wherein an edge of the each of the side leg portions abut an edge of one of the plurality of dividers.

8. The product management display system of claim 1, wherein the front wall is translucent.

9. A product management display system comprising:

a tray having a front rounded portion and a surface defining a plurality of apertures;

a lip extending upward from the front rounded portion of the tray;

a front shelf extending forward from the lip;

a pusher mechanism configured to slide across at least a portion of the surface of the tray, the pusher mechanism mounted to and held onto the tray by a coiled spring;

a removable front wall having a top wall portion, a bottom wall portion, and two side leg portions, wherein the front wall portion, bottom wall portion, and two side leg portions form a wall aperture; and two wall portions, each of the two wall portions extending from an opposite end of the lip;

wherein the front wall includes a plurality of projections configured to engage with the plurality of apertures on the surface of the tray; and wherein a graphic pocket is formed by the bottom wall portion, the lip, and the two wall portions.

10. The product management display system of claim 9, further comprising:

two dividers, each of the two dividers extending upwardly from opposite side edges of the tray.

11. The product management display system of claim 9, wherein the pusher mechanism sits on top of and does not extend below the surface of the tray.

12. The product management display system of claim 9, wherein the surface of the tray defines a plurality of openings to permit debris or other materials to pass through.

13. The product management display system of claim 12, wherein the front wall is translucent.

14. A product management display system comprising:

a plurality of trays, each tray having a front rounded portion and a surface defining a plurality of apertures, each of the plurality of trays having two sides;

a lip extending upward from the front rounded portion of each of the plurality of trays;

a front shelf extending forward from the lip of each of the plurality of trays;

a plurality of dividers, each of the plurality of trays having one divider extending upwardly from each of the two sides; and a plurality of front walls, each of the front walls having a top wall portion, a bottom wall portion, and two side leg portions, wherein the front wall portion, bottom wall portion, and two side leg portions form a wall aperture;

wherein each of the plurality of front walls includes a plurality of projections configured to engage with the plurality of apertures on the surface of one of the plurality of trays;

wherein the graphic pockets of each of the front walls form a nearly continuous strip of advertising.

15. The product management display system of claim 14, further comprising:

two wall portions extending from an opposite end of the lip on each of the plurality of front walls, wherein each of the front walls includes a graphic pocket formed by the bottom wall portion, the lip, and the two wall portions.

16. The product management display system of claim 15, wherein a side of each of the plurality of trays are positioned adjacent a side of another one of the plurality of trays on a shelf.

* * * * *